US007547252B2

(12) United States Patent
Peterson et al.

(10) Patent No.: US 7,547,252 B2
(45) **Date of Patent: *Jun. 16, 2009**

(54) GAMING DEVICE HAVING PLAYER-SELECTABLE AWARD DIGITS AND AWARD MODIFICATION OPTIONS

(75) Inventors: Lance R. Peterson, Reno, NV (US); Joseph E. Kaminkow, Reno, NV (US); Anthony J. Baerlocher, Reno, NV (US); Cari L. Blomquist, Reno, NV (US); Darren Maya, Reno, NV (US); Robert N. Silva, III, Reno, NV (US); Randall D. Mead, Reno, NV (US)

(73) Assignee: IGT, Reno, NV (US)

( * ) Notice: Subject to any disclaimer, the term of this patent is extended or adjusted under 35 U.S.C. 154(b) by 794 days.

This patent is subject to a terminal disclaimer.

(21) Appl. No.: 10/660,281

(22) Filed: Sep. 10, 2003

(65) Prior Publication Data

US 2004/0082378 A1 Apr. 29, 2004

Related U.S. Application Data

(63) Continuation-in-part of application No. 09/934,003, filed on Aug. 20, 2001.

(51) Int. Cl.
*A63F 9/24* (2006.01)

(52) U.S. Cl. ..... 463/20; 463/16; 463/17; 463/18; 463/21; 463/22; 463/25; 463/26

(58) Field of Classification Search ..... 463/22, 463/26, 17, 21, 23, 25, 27
See application file for complete search history.

(56) References Cited

U.S. PATENT DOCUMENTS 2,743,108 A 4/1956 Sander (Continued)

FOREIGN PATENT DOCUMENTS

AU 97/39339 3/1998

(Continued)

OTHER PUBLICATIONS

A Salute to Game Shows-The Price is Right-Pricing Games. Retrieved from the Internet:<http://ben-schumin.simplenet.com/game-shows/shows/price-is-right/pricing-games.htm>, Aug. 16, 2000.

(Continued)

*Primary Examiner*—John M Hotaling
*Assistant Examiner*—Sunit Pandya
(74) *Attorney, Agent, or Firm*—K & L Gates LLP

(57) ABSTRACT

A gaming device that incorporates mechanical display devices to provide a player-selectable award feature that may be implemented with a primary or bonus game. The gaming device randomly generates a plurality of digit positions or places of an award and enables the player to pick which position or digit receives a first randomly generated number, which digit receives a second randomly generated number, etc., until each of the positions have a number, whereby the gaming device determines the player's original award. The player can elect to modify the original award using a plurality of methods to create an ultimate award. The gaming device display the digits, digit positions, and modification methods.

60 Claims, 30 Drawing Sheets

U.S. PATENT DOCUMENTS 3,618,952 A 11/1971 Talarido
4,624,459 A 11/1986 Kaufman
4,669,731 A 6/1987 Clarke
4,695,053 A 9/1987 Vazquez, Jr. et al.
4,811,953 A 3/1989 Jeng
4,978,129 A 12/1990 Komeda et al.
4,991,848 A 2/1991 Greenwood et al.
5,116,055 A 5/1992 Tracy
5,205,555 A 4/1993 Hamano
5,342,047 A 8/1994 Heidel et al.
5,344,144 A 9/1994 Canon
5,377,973 A 1/1995 Jones et al.
5,393,057 A 2/1995 Marnell, II
5,397,125 A 3/1995 Adams
5,456,465 A 10/1995 Durham
5,511,781 A 4/1996 Wood et al.
5,580,309 A 12/1996 Piechowiak et al.
5,584,764 A 12/1996 Inoue
5,611,535 A 3/1997 Tiberio
5,645,485 A 7/1997 Clapper, Jr.
5,700,009 A 12/1997 Meoni
5,722,891 A 3/1998 Inoue
5,769,716 A 6/1998 Saffari et al.
5,788,573 A 8/1998 Baerlocher et al.
5,816,918 A 10/1998 Kelly et al.
5,817,172 A 10/1998 Yamada et al.
5,823,873 A 10/1998 Moody
5,823,874 A 10/1998 Adams
5,823,879 A 10/1998 Goldberg et al.
5,833,536 A 11/1998 Davids et al.
5,848,932 A 12/1998 Adams
5,882,261 A 3/1999 Adams
5,910,048 A 6/1999 Feinberg
5,947,820 A 9/1999 Morro et al.
5,967,893 A 10/1999 Lawrence et al.
5,980,384 A 11/1999 Barrie
5,993,316 A 11/1999 Coyle et al.
5,997,401 A 12/1999 Crawford
6,004,207 A 12/1999 Wilson, Jr. et al.
6,012,982 A 1/2000 Piechowiak et al.
6,012,983 A 1/2000 Walker et al.
6,015,346 A 1/2000 Bennett
6,062,980 A 5/2000 Luciano
6,089,976 A 7/2000 Schneider et al.
6,102,400 A 8/2000 Scott et al.
6,102,798 A 8/2000 Bennett
6,109,610 A 8/2000 Cherry et al.
6,110,041 A 8/2000 Walker et al.
6,113,098 A 9/2000 Adams
6,120,031 A 9/2000 Adams
6,126,542 A 10/2000 Fier
6,142,873 A 11/2000 Weiss et al.
6,146,273 A 11/2000 Olsen
6,155,925 A 12/2000 Giobbi
6,158,741 A 12/2000 Koelling
6,159,095 A 12/2000 Frohm et al.
6,159,097 A 12/2000 Gura
6,159,098 A 12/2000 Slomiany et al.
6,162,121 A 12/2000 Morro et al.
6,168,520 B1 1/2001 Baerlocher et al.
6,168,522 B1 1/2001 Walker et al.
6,168,523 B1 1/2001 Piechowiak et al.
6,173,955 B1 1/2001 Perrie et al.
6,174,233 B1 1/2001 Sunaga et al.
6,174,234 B1 1/2001 Seibert, Jr. et al.
6,174,235 B1 1/2001 Walker et al.
6,186,894 B1 2/2001 Mayeroff
6,190,255 B1 2/2001 Thomas et al.
6,203,429 B1 3/2001 Demar et al.
6,210,277 B1 4/2001 Stefan
6,210,279 B1 4/2001 Dickinson
6,217,022 B1 4/2001 Astaneha
6,224,482 B1 5/2001 Bennett
6,224,483 B1 5/2001 Mayeroff
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,244,957 B1 6/2001 Walker et al.
6,251,013 B1 6/2001 Bennett
6,254,482 B1 7/2001 Walker et al.
6,261,177 B1 7/2001 Bennett
6,270,409 B1 8/2001 Shuster
6,283,855 B1 9/2001 Bingham
6,299,165 B1 10/2001 Nagano
6,302,791 B1 10/2001 Frohm et al.
6,309,299 B1 10/2001 Weiss
6,309,300 B1 10/2001 Glavich
6,312,331 B1 11/2001 Tamaki
6,312,334 B1 11/2001 Yoseloff
6,315,662 B1 11/2001 Jorasch et al.
6,315,663 B1 11/2001 Sakamoto
6,322,309 B1 11/2001 Thomas et al.
6,328,649 B1 12/2001 Randall et al.
6,334,814 B1 1/2002 Adams
6,335,815 B1 1/2002 Kobayashi
6,336,862 B1 1/2002 Byrne
6,346,043 B1 2/2002 Colin et al.
6,347,996 B1 2/2002 Gilmore et al.
6,358,147 B1 3/2002 Jaffe et al.
6,364,767 B1 4/2002 Brossard et al.
6,394,902 B1 5/2002 Glavich et al.
6,398,218 B1 6/2002 Vancura
6,413,161 B1 7/2002 Baerlocher et al.
6,428,412 B1 8/2002 Anderson et al.
6,439,995 B1 8/2002 Hughs-Baird et al.
6,443,837 B1 9/2002 Jaffe et al.
6,514,141 B1 2/2003 Kamkinow et al.
6,565,436 B1 5/2003 Baerlocher
6,569,016 B1 5/2003 Baerlocher
6,575,830 B2 6/2003 Baerlocher et al.
6,582,306 B1 6/2003 Kaminkow
6,589,114 B2 7/2003 Rose
6,609,972 B2 8/2003 Seelig et al.
6,659,864 B2 12/2003 McGahn et al.
6,688,977 B1 2/2004 Baerlocher et al.
6,712,694 B1 3/2004 Nordman
6,722,981 B2 4/2004 Kaminkow et al.
6,722,982 B2 4/2004 Kaminkow et al.
6,776,711 B1 8/2004 Baerlocher
6,796,901 B2 9/2004 Baerlocher
6,811,483 B1 11/2004 Webb et al.
6,811,485 B2 11/2004 Kaminkow
6,875,108 B1 4/2005 Hughs-Barid
6,966,833 B2 11/2005 Kaminkow et al.
6,971,955 B2 12/2005 Baerlocher et al.
6,979,263 B2 12/2005 Baerlocher et al.
7,131,908 B2 11/2006 Baerlocher
7,172,506 B2 2/2007 Baerlocher et al.
2002/0094861 A1 7/2002 Seelig et al.
2003/0027623 A1 2/2003 Rose
2003/0036422 A1 2/2003 Baerlocher et al.
2003/0162579 A1 8/2003 Gauselmann
2004/0053671 A1 3/2004 Nordman
2004/0053687 A1 3/2004 Nordman
2004/0214628 A1 10/2004 Boyd et al.
2005/0164774 A1 7/2005 Gauselmann

FOREIGN PATENT DOCUMENTS

AU 99/17318 9/1999
AU 200069612 10/2000

| | | | |
|---|---|---|---|
| AU | 1 861 897 | | 1/2003 |
| CA | 2140949 | | 10/1995 |
| EP | 0945837 | A2 | 9/1999 |
| EP | 0984409 | A2 | 3/2000 |
| GB | 2366435 | | 6/2002 |
| JP | 7275432 | | 10/1995 |
| WO | WO 85/00910 | | 2/1985 |
| WO | WO 97/32285 | | 4/1997 |
| WO | WO 97/32285 | | 9/1997 |
| WO | WO 98/09259 | | 3/1998 |
| WO | WO 00/12186 | | 3/2000 |
| WO | WO 00/17831 | | 3/2000 |
| WO | WO 0119476 | A1 | 3/2001 |
| WO | WO 0158546 | A1 | 8/2001 |
| WO | WO 03/015881 | | 2/2003 |
| WO | WO 03/015883 | | 2/2003 |
| WO | WO 03/102885 | | 12/2003 |

OTHER PUBLICATIONS

Description of Let's Make a Deal Television Show written by www.ballygaming.com, printed Mar. 16, 2001.
Jazzy Jackpots Advertisement written by Atonic, published prior to 2002.
Take Your Pick-Anchor Games, written by Strictly Slots, p. 50, published Mar. 2001.
Texas Tea Advertisement written by IGT, published in 2000.
Top Dollar, Technical Brochure, pp. 1-2, written by IGT, published in 1998.
Top Dollar Advertisement written by IGT, published in 1998.
Who Dunnit Advertisement written by WMS Gaming, Inc., published Jun. 26, 2001.
Winning Bid Advertisement written by WMS Gaming, Inc., published prior to 2002.
By George Advertisement, written IGT, published 2002.
Fortune Cookie Brochure, written by IGT, published in 2000.
Jumble Advertisement, written by WMS Gaming, Inc., published prior to 2000.
Jumble Article, written by Strictly Slots, published in Dec. 2000.
Jumble Website Printout, written by WMS Gaming, Inc., printed Mar. 21, 2001.
Loaded Dice Advertisement, written by Konami Gaming, published in 2000.
Rainbow Riches 5 Liner Advertisement, written by BSCI Corporation, undated.
Slot Machine Game With Roaming Wild Card, undated.
Sphinx Magic Advertisement, written by Atronic Casino Technology, Ltd., published 1997.
Wheel of Fortune Brochure, written by IGT, published in 1998.
A List of The Price is Right Pricing Games, http://en.wikipedia.org (website), printed on Aug. 8, 2007, available prior to 2003.
A Salute to Game Shows-The Price is Right-Pricing Games (website). Retrieved from the Internet on Aug. 8, 2007: http://benschumin.simplenet.com/game-shows/shows/price-is-right/pricing-games-2.htm, available prior to 2003.
A Salute to Game Shows-The Price is Right-Pricing Games (website). Retrieved from the Internet on Aug. 8, 2007: http://benschumin.simplenet.com/game-shows/shows/price-is-right/pricing-games-3.htm, available prior to 2003.
A Salute to Game Shows-The Price is Right-Pricing Games (website). Retrieved from the Internet on Aug. 8, 2007: http://benschumin.simplenet.com/game-shows/shows/price-is-right/pricing-games-4.htm, available prior to 2003.
Any Number Game Description, (website), printed on Aug. 8, 2007, available prior to 2003.
Babooshka Advertisement in Gaming for Africa, written by Atronic, published in May 2002.
Black Swan Wagering Description and Pay-table, written by IGT, published prior to 2002.
Fey, Marshall, Slot machines—A Pictorial History of the First 100 Years, Liberty Bell Books, 5th Ed, 1997.
Free Fall Poker Description written by IGT, available prior to 2003.
Groundbreaking Mr. Cashman™ Latest Innovation Advertisement, written by International News, available prior to 2003.
Jackpot Party Brochure and Articles, written by WMS Gaming, Inc, published in 1988.
Jazzy Jackpots Article, written by Strictly Slots, published Mar. 2002.
Marketplace—Aristocrat Mr. Cashman Advertisement, p. 44, published Nov. 2002.
Montecasino Gets Mr. Cashman Article, written by Gaming for Africa, p. 10, available prior to 2003.
Mr. Cashman Advertisement, written by Reel Power, available prior to 2003.
Mr. Cashman article, written by Australian News, p. 32, available prior to 2003.
Neon Nights Advertisement, written by IGT, published in 2000.
Office Action dated Oct. 2, 2002 for U.S. Appl. No. 09/933,843.
Office Action dated Oct. 17, 2002 for U.S. Appl. No. 09/934,003.
Office Action dated Feb. 4, 2003 for U.S. Appl. No. 09/933,843.
Office Action dated Jun. 26, 2003 for U.S. Appl. No. 09/934,003.
Office Action dated Jul. 30, 2003 for U.S. Appl. No. 09/933,843.
Office Action dated Jan. 2, 2004 for U.S. Appl. No. 09/934,003.
Office Action dated Oct. 4, 2004 for U.S. Appl. No. 09/934,003.
Office Action dated Nov. 4, 2004 for U.S. Appl. No. 10/160,687.
Office Action dated Oct. 17, 2005 for U.S. Appl. No. 10/160,687.
Office Action dated Nov. 9, 2005 for U.S. Appl. No. 09/934,003.
Office Action dated Feb. 15, 2006 for U.S. Appl. No. 09/933,843.
Office Action dated May 4, 2006 for U.S. Appl. No. 10/160,687.
Office Action dated Jun. 9, 2006 for U.S. Appl. No. 09/933,843.
Office Action dated Nov. 29, 2006 for U.S. Appl. No. 09/934,003.
Office Action dated Nov. 30, 2006 for U.S. Appl. No. 09/933,843.
Office Action dated Feb. 21, 2007 for U.S. Appl. No. 09/934,003.
Office Action dated Mar. 15, 2007 for U.S. Appl. No. 10/160,687.
Price is Right "Bump" Description, written by gscentral.net (web site), available prior to 2003.
Price is Right "Coming or Going" Description, written by gscentral.net (web site), available 2003.
Price is Right "Flip Flop" Description, written by gscentral.net (web site), available Feb. 25, 2005.
Price is Right "Freeze Frame" Description, written by gscentral.net (web site), available prior to 2003.
Price is Right "Push Over" Description, written by gscentral.net (web site), available prior to 2003.
Price is Right "Side by Side" Description, written by gscentral.net (web site), available prior to 2003.
Price is Right "Squeeze Play" Description, written by gscentral.net (web site), available prior to 2003.
Take Your Pick Game Brochure, written by IGT, published 1999.
Tetris Game Description, written by Radica, published in 2000.
The Price is Right Game Description, http://en.wikipedia.org (website), printed on Aug. 8, 2007, available prior to 2003.
Three Strikes Game Description, http://en.wikipedia.org (website), printed on Aug. 7, 2007, available prior to 2003.
Tokenization Game Description, written by IGT, available prior to 2003.
Vision Bonus Games Advertisement includes "Diamond Fives Buy-A-Bonus Spin," written by IGT, published 1999.
Wild Streak Game Avertisement, written by WMS Gaming, Inc., published Mar. 2001.

FIG. 22

Probability of Adding "2" to Digit Position(s) in a Three-Digit Award

| | Digit Positions | | | |
|---|---|---|---|---|
| Scenario | 100s | 10s | 1s | Probability |
| A | - | - | +2 | 5% |
| B | - | +2 | - | 5% |
| C | +2 | - | - | 10% |
| D | - | +2 | +2 | 10% |
| E | +2 | - | +2 | 20% |
| F | +2 | +2 | - | 20% |
| G | +2 | +2 | +2 | 30% |

GAMING DEVICE HAVING PLAYER-SELECTABLE AWARD DIGITS AND AWARD MODIFICATION OPTIONS

PRIORITY CLAIM

This application is a continuation-in-part of and claims the benefit of U.S. patent application Ser. No. 09/934,003, filed Aug. 20, 2001, the contents of which are incorporated in its entirety herein.

CROSS REFERENCE TO RELATED APPLICATIONS

The present invention relates to the following co-pending commonly owned U.S. patent applications; "Gaming Device Having A Bonus Scheme With Alternative Ending Sequences," Ser. No. 10/160,687, "Gaming Device Having Player Selectable Award Digits And Award Modification Options," Ser. No. 09/934,003, "Gaming Device Having A Game With A Moving Digit Generated Outcome," Ser. No. 11/222,914; and "Gaming Device Having Award Modification Options For Player Selectable Award Digits," Ser. No. 11/626,632.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having player-selectable awards and award modification options.

BACKGROUND OF THE INVENTION

Gaming devices currently exist with bonus rounds in which a player has one or more opportunities to choose masked bonus values from a pattern of masked values displayed to the player. When the player chooses a masked value from the pattern, the game removes the mask and either provides the player with a bonus value or terminates the bonus round with a bonus terminator. The outcome depends upon whether the player selects a value or a terminator.

In the above game, the controller of the gaming device randomly places a predetermined number of masked values and terminators in the pattern at the beginning of the bonus round and maintains the positioning until the bonus round terminates. When the player selects a masked value, the player receives the value, and the game typically displays a message that the player may continue and enables the player to select another masked award. The player then selects another masked value, and the process continues until the player selects a masked terminator. U.S. Pat. No. 6,190,255 B1, which issued on Feb. 20, 2001, and which is assigned on its face to WMS Gaming Inc., discloses a bonus game of this type.

Gaming machines also currently exist with bonus rounds in which the game selects or determines the player's award. PCT application PCT/AU97/00121 entitled, Slot Machine Game with Roaming Wild Card, having a publication date of Sep. 4, 1997, discloses an example. In this game, a slot machine having a video display contains a plurality of rotatable reels with game symbols. When the player receives a triggering symbol or combination, the game produces a bonus symbol. The bonus symbol moves from game symbol to game symbol temporarily changing the game symbol to a bonus symbol. If the change results in a winning combination, the player receives an award.

In the first known game, the "go-until" or "do-until" bonus can end quite quickly if the player selects a bonus terminator early in the bonus round. The player selects masked symbols until selecting the bonus terminator, which is immediately displayed. The player's involvement in the bonus round is thus limited. The player has no opportunity to undo or redo an undesired pick. The player has no opportunity to optimize or maximize the bonus round award. In the second known game, the game completely determines the bonus round award, and the player has no effect on the outcome.

Gaming devices provide enjoyment and excitement to the player, in part, because they may ultimately lead to a monetary award for the player. Gaming devices also provide enjoyment and excitement to the player because they are fun to play. Bonus games, in particular, provide gaming device manufacturers with the opportunity to add enjoyment and excitement to that which is already expected from a base game of the gaming device. Bonus games provide extra awards to the player and enable the player to play a game that is different than the base game.

A continuing need exists for gaming devices that provide awards in an exciting and enjoyable manner. In this respect, it is desirable to enable the player to have an impact on, or a hand in, determining the player's award. It is also desirable to enable a player to optimize an award. It is further desirable to increase the level of player interaction. Each of these features is desirable in a base or primary game and in a bonus or secondary game.

SUMMARY OF THE INVENTION

The present invention provides a gaming device that has a player-selectable award feature that may be implemented with a primary or bonus game. More specifically, the present invention provides a processor-controlled gaming device that randomly generates a plurality of positions or digits of an award and enables the player to pick which position or digit receives a first randomly generated number, which digit receives a second randomly generated number, etc., until each of the positions have a number, whereby the gaming device determines the player's ultimate award based on the order of the number in the positions. This sequence or feature may be employed in a bonus game, in a known base or primary game or in any stand alone game.

In one embodiment, the gaming device randomly generates a number and does not disclose or reveal the number to the player. The game prompts the player to pick one of the award positions or digits. When the player selects one of the award positions or digits, the game reveals the number in the selected position or digit. The player hopes that higher numbers will be generated in positions or digits having a relatively high order of magnitude, e.g., the hundred's digit for a three digit award.

In another embodiment, the gaming device randomly generates and displays a plurality of player selectable masked numbers or selections and enables the player to place the selections or masked numbers in an order (i.e., in the positions or digits of an award). During or after the player directs the placement of the selections or masked numbers, the game reveals the numbers and the player's award.

The gaming device may be adapted to provide an equal amount of selections and digits, more selections than digits or less selections than digits. The present invention provides several different visual techniques for enabling the player to place masked numbers into the award positions or digits. In certain embodiments, the gaming device enables the player to change the order of masked numbers before revealing the player's award. When the player is certain of the desired masked number arrangement, the game reveals the numbers.

In a preferred embodiment, the player's award is the displayed value, which is the combination of the revealed numbers in the selected digits. In other embodiments, the game can multiply one or more of the digits, add one or more of the digits and/or use the face value of other digits to form some or all of the player's award.

In one bonus game embodiment, the game initially randomly generates and displays a number of inputs and prompts the player to select one of the inputs. When the player selects an input, the game generates and displays a number of masked numbers. In one embodiment, the game also displays how many numbers are to be displayed, e.g., the number "three," before displaying three masked numbers.

When this sequence is combined with the base game of slot, the initial random generation of the number of masked numbers may be replaced by the intermittent random generation of the masked numbers or selections on the reels of the slot machine. The slot game provides a secondary or jackpot award having a number of positions or digits (preferably three). As one or more players play the base slot game, they generate a required set of masked numbers and fill in the positions or digits of the jackpot award in a desired order. The game eventually reveals the masked numbers and awards the jackpot award to the player who completes the required set. It should be appreciated that the jackpot award may be progressive, e.g., incrementally built using a percentage of the player's wager.

The present invention further provides for modification of the player's award. The modification may be randomly triggered, provided as an option to the player or automatically executed based on the expected value of the current award. When randomly triggered, the gaming device in one embodiment provides a modifier upon a player's selection of a masked number or upon the player's selection of an award position or digit. That is, when the player selects an award position or digit or selects one of the selections or masked numbers, the gaming device, instead of providing or revealing a number, provides or reveals a modifier. Alternatively, the game may be adapted to randomly generate an award modifier based on some other triggering mechanism, such as the generation of a particular number or set of numbers.

When provided as an option, the player decides whether to keep the currently generated award or risk the award and let the award modification take place. In one embodiment, the gaming device automatically provides the award modification option to the player. In another alternative embodiment, the gaming device randomly determines whether or not to provide an award modification option based on the player's selection or upon another triggering event.

Several different modification sequences or methods are provided by the present invention. In one preferred embodiment, the gaming device randomly generates one of the modification methods when the player decides to modify rather than keep a generated award. The modification methods include, among others: scrambling or rearranging the digits of an original award, completely regenerating the award, adding a digit to the award, subtracting a digit from the award and multiplying the award.

In the scramble or rearrangement modification method, the processor rearranges the digits of a currently generated award. In the option embodiment, once the player chooses to modify the current award, and the game randomly generates the rearrangement option, the player is provided the rearranged award regardless of whether the award is higher or lower. In another embodiment, the game determines the expected value for the originally generated set of digits and automatically rearranges the player's award if the expected value exceeds the current award.

In the award regeneration modification method, the gaming device enables the player to replay the game and generate a new award. In the option embodiment, once the player chooses to modify the current award, and the game randomly generates the regeneration option, the player is provided the regenerated award regardless of whether the award is higher or lower.

The add a digit modification method in one embodiment adds a one's digit of five to the end of the player's current award and slides each existing digit up an order of magnitude, thus, the award 416 becomes 4165. The subtract a digit modification method in one embodiment removes the lowest number or value from the player's current award. For example, the award 416 becomes 46. The multiply modification method in one embodiment randomly selects a multiplier and multiplies the player's current award, e.g., a multiplier of three times 416.

In an alternative embodiment, a mechanical display device is used to display the symbols, images, or other indicia, such as the numbers. In one embodiment, the gaming device generates a number and reveals that number to the player using the mechanical display. The gaming device instructs the player to place the displayed number in one of a plurality of predetermined or randomly generated digit positions of an award preferably before the gaming device proceeds to generate the next number. In an alternative embodiment, the player selects the award positions for the displayed number before the number is generated or displayed. In one embodiment, after all of the positions in the award have received a generated number, the award is provided to the player. Alternatively, the award may be modified by one or more of a plurality of modification methods to produce a modified award to be provided to the player.

In one embodiment, the award modification functions or methods are also displayed by a mechanical modifier display device. In one such embodiment, the modifier display includes a three-sided elongated prism-shaped display and a modifier indicator. In one embodiment, the prism-shaped display rotates on a substantially horizontally extending rotational axis to reveal a plurality of groups of award modification methods adjacently arranged along the length of the display. In one embodiment, the mechanical modifier display device includes a modifier indicator which simultaneously or sequentially moves relative to the modifier display, such as back and forth along the length of the modifier display, to designate the particular generated modification method to be applied to the player's award.

In one embodiment of the present invention, the gaming device includes additional modification methods in addition to those previously described and adapted to modify the award. The additional methods include replacing or removing the lowest or highest digits of the award, decreasing an award by a fraction or percentage of the award, adding an amount to at least one of the digits of an award, subtracting an amount from at least one of the digits of an award, rearranging the digits to create the lowest possible value, rearranging the digits to create the highest possible value, replacing all the digits with the lowest digit, and replacing all the digits with the highest digit.

The remove the lowest digit modification method removes only the number in the player's award having the lowest value. The remove the lowest digit modification method, in one embodiment, eliminates one of the positions in the award value and shifts the remaining digits together, preferably, in the direction of the one's place, thereby, decreasing the award value by an order of magnitude. If two or more of the numbers in the award value are the same and are the lowest value, the gaming device can randomly select which digit of the two or more digits is to be removed. Alternatively, if more than one of the lowest digits is the same, each of those digits is removed, thereby, decreasing the award by more than one order of magnitude. Other alternatives can be employed in accordance with the present invention.

The remove the highest digit modification method removes only the number in the player's award having the highest value. The remove the highest digit method eliminates one of the positions in the award value and shifts the remaining digits together, preferably in the direction of the one's place to decrease the award value by an order of magnitude. If two or more of the numbers in the award value are the same and are the highest value, the gaming device can randomly select which digit of the two or more digits is to be removed. Alternatively, if more than one of the highest digits are the same, each of those digits is removed, thereby, decreasing the award by more than one order of magnitude. Other alternatives can be employed in accordance with the present invention.

The replacement of the lowest digit modification method selects the lowest digit in the award value and replaces the digit with another randomly generated digit. Again, if two or more of the numbers in the award value are the same and are the lowest value, the gaming device can employ any suitable method such as randomly selecting which digit of the two or more digits is to be replaced or replace all of the same digits.

Similarly, the replacement of the highest digit modification method selects the highest digit in the award value and replaces the digit with another randomly generated digit. If two or more of the numbers in the award value are the same and are the highest value, the gaming device can employ any suitable method such as randomly selecting which digit of the two or more digits is to be replaced or replace all of the same digits.

The reduction of the award by a fractional amount modification method reduces the original award value by a predetermined fractional amount such as one-half of the original value of the award.

The add or subtract an amount modification methods, increases or decreases, respectively, one or more of the digits in each digit position of the award by an amount either predetermined or randomly generated. In one embodiment, whether a particular digit position or combination of digit positions is modified by this method is randomly determined based on a probability. In an embodiment, if, for example, the digit in a digit position is an 8 or 9, and that digit is to be increased by the amount of 2 (equaling 10 or 11, respectively) or more, the 1 can be carried over to the next highest digit position. In an alternative embodiment, the 1 is not carried over and no other digit position is increased by a carried-over amount.

The subtract an amount modification methods decreases one or more of the digits in each digit position of the award by an amount either predetermined or randomly generated. Whether a particular digit position or combination of digit positions is modified by this method is based on a probability. In one embodiment, if, for example, the digit in a digit position is a 0 or 1, and that digit is to be decreased by the amount of 2 (equaling −2 or −1, respectively) or more, the 1 can be borrowed from the next highest digit position to reduce the next highest digit position by 1 and increase the modified digit position by 10 before subtracting the amount from the modified digit position. In an alternative embodiment, the 1 is not borrowed from the next highest digit position and the modified digit position retains the absolute value of the modification.

The lowest possible value modification method creates the lowest possible value using the digits generated in the game by rearranging the digits in the digit positions. The digits with the lowest value are rearranged to the digit positions with the highest magnitude to create the lowest value. Similarly, the highest possible value modification method creates the highest possible value using the digits generated in the game by rearranging the digits in the digit positions. The digits with the highest value are rearranged to the digit positions with the highest magnitude to create the highest value.

The replacing the other digits with the lowest value digit modification method selects the lowest digit in the award value generated in the game and replaces all of the digits with the lowest value digit. Similarly, the replacing the other digits with the highest value digit modification method selects the highest digit in the award value generated in the game and replaces all of the digits with the highest value digit.

It is therefore an advantage of the present invention to provide a gaming device that enables a player to have a direct impact on determining an award.

Another advantage of the present invention is to provide a gaming device that selectively enables the player to keep or modify an award.

A further advantage of the present invention is to randomly employ one of a number of award modification methods to provide a varied and exciting gaming device.

Yet another advantage of the present invention is to provide a gaming device that increases the level of player interaction.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 22 is a table illustrating an example of the distribution of probabilities among the permutations of a three-digit award of adding "2" to one or more digit positions.

DETAILED DESCRIPTION OF THE INVENTION

Gaming Device and Electronics

Figure 1A:
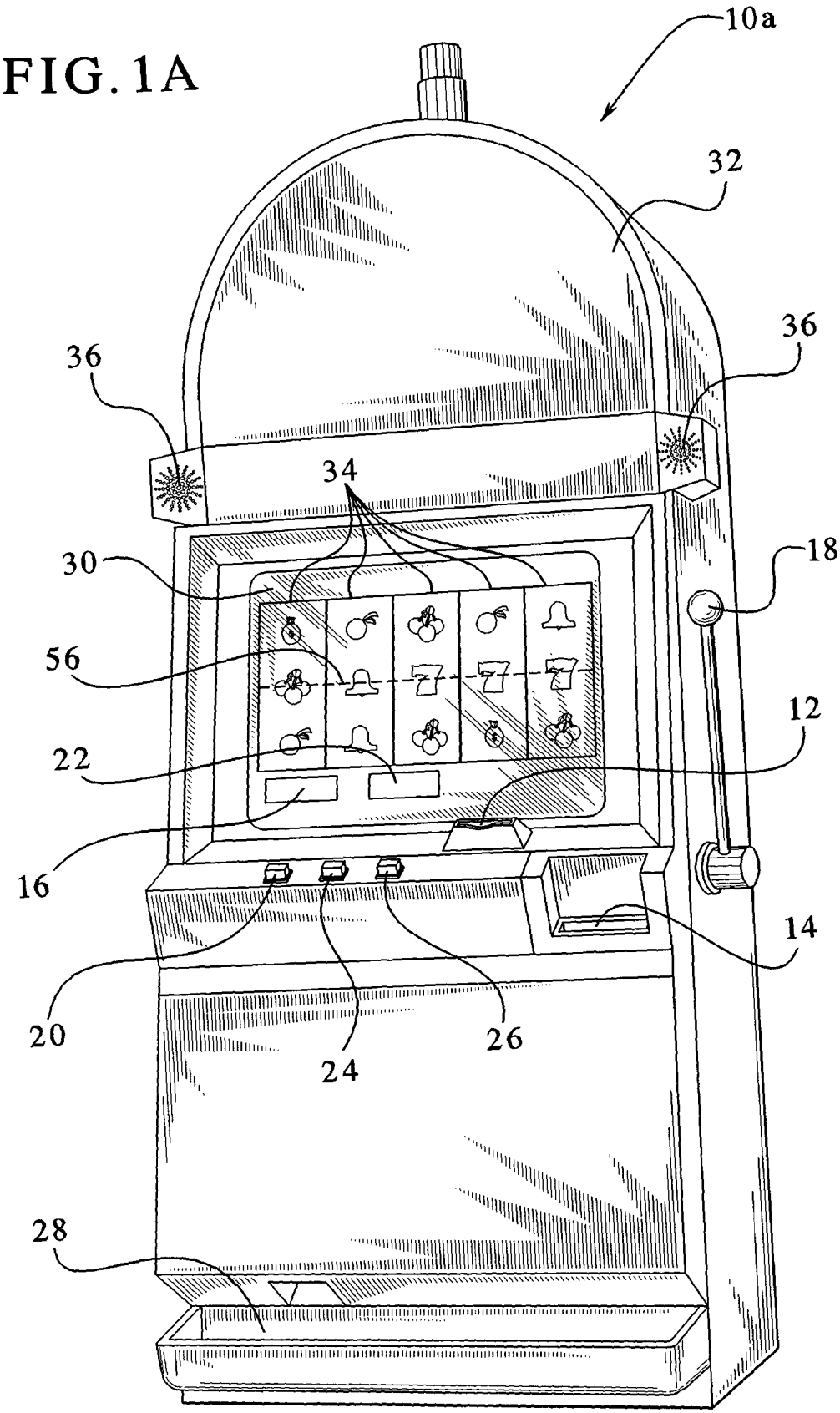
FIGS. 1A and 1B are perspective views of alternative embodiments of the gaming device of the present invention.
Figure 1B:
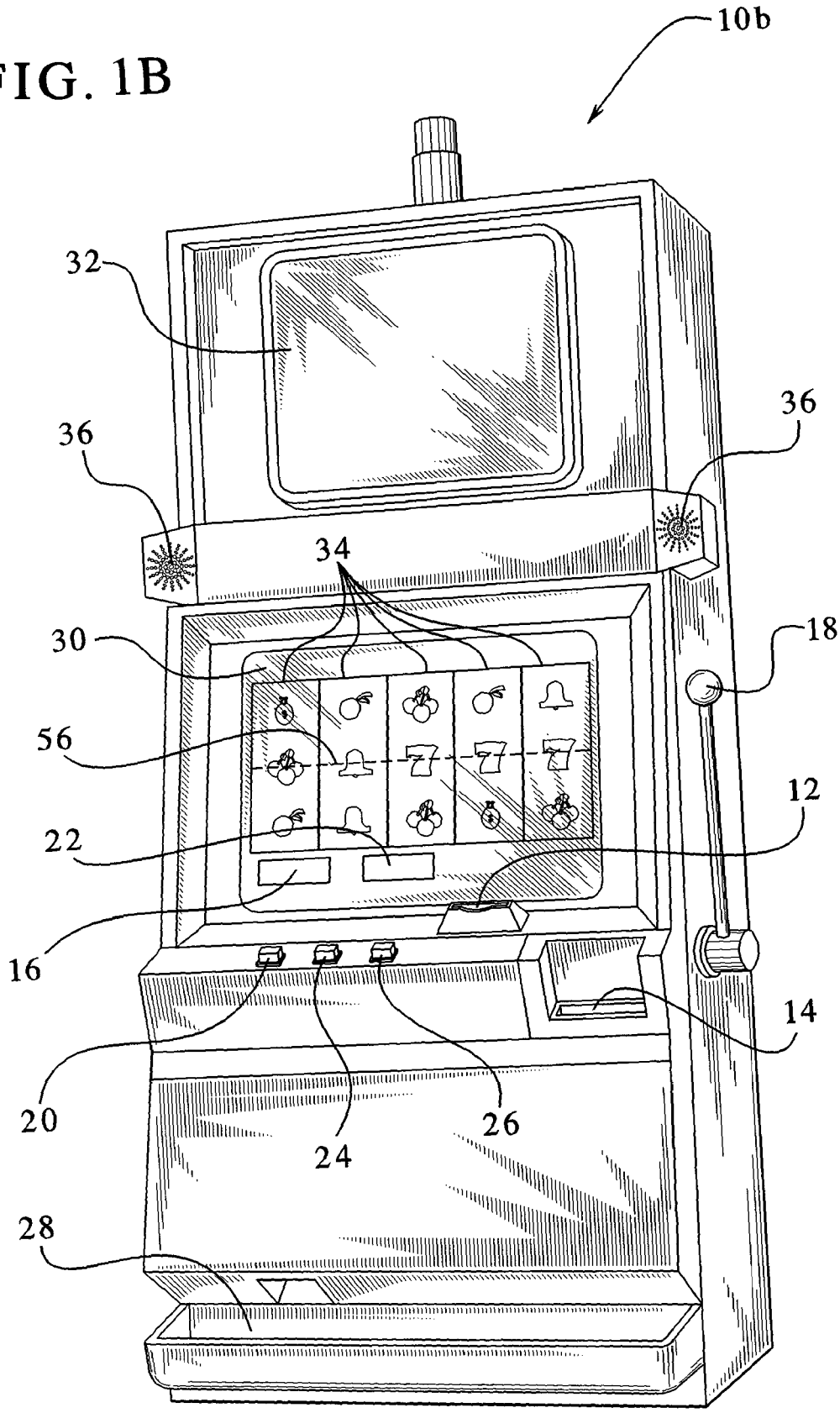

Referring now to the drawings, and in particular to FIGS. 1A and 1B, gaming device 10*a* and gaming device 10*b* illustrate two possible cabinet styles and display arrangements and are collectively referred to herein as gaming device 10. The present invention includes the game (described below) being a stand alone game or a bonus or secondary game that coordinates with a base game. When the game of the present invention is a bonus game, gaming device 10 in one base game is a slot machine having the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The gaming device 10 also embodies any bonus triggering events, bonus games as well as any progressive game coordinating with these base games. The symbols and indicia used for any of the base, bonus and progressive games include mechanical, electrical, electronic or video symbols and indicia.

In a stand alone or a bonus embodiment, the gaming device 10 includes monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time during the game, a player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially in the slot machine base game of the gaming device 10, includes speakers 36 for making sounds or playing music.

Figure 2:
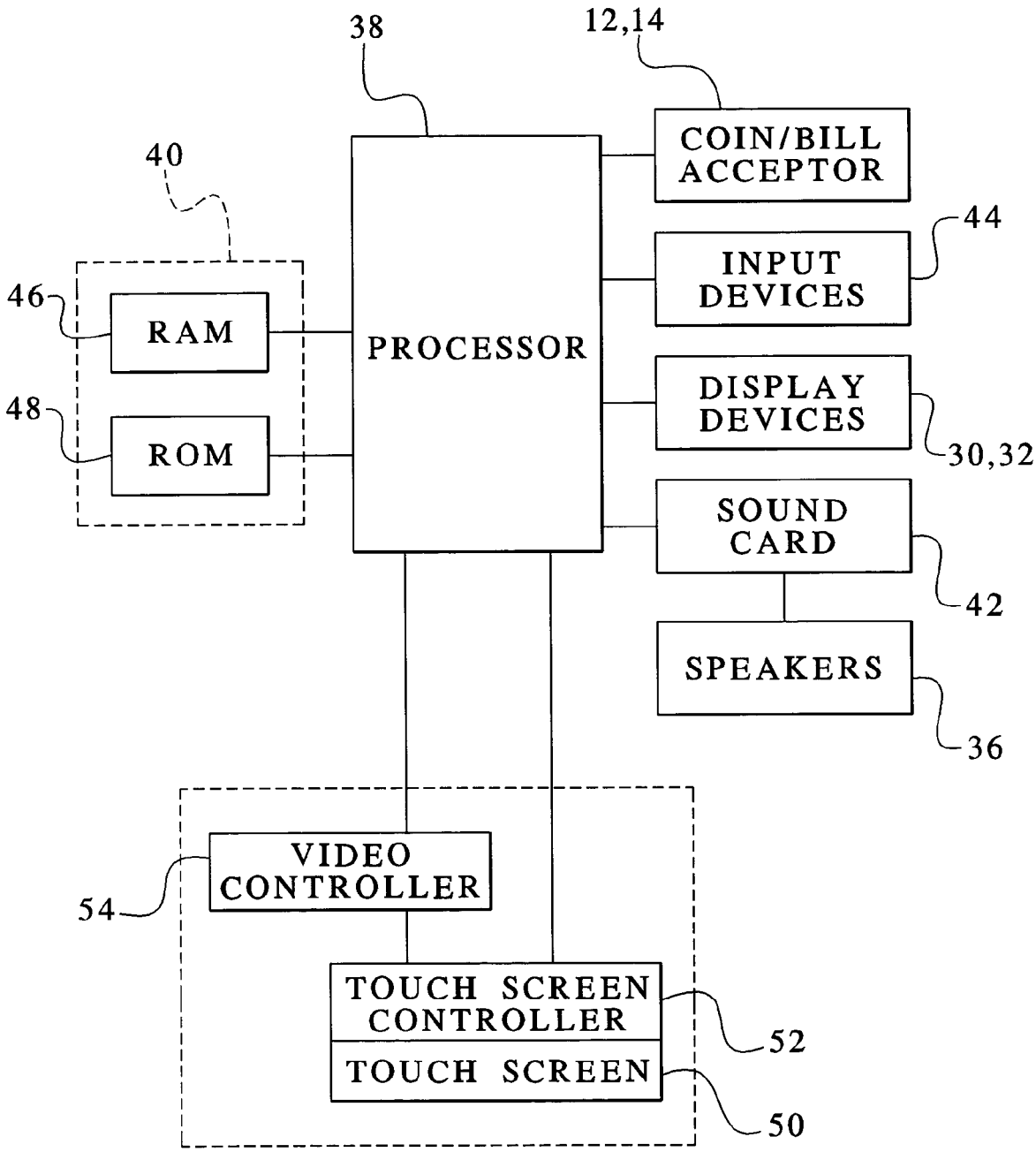
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively or alternatively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 preferably employs a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

Masked Numbers

Figure 3A:
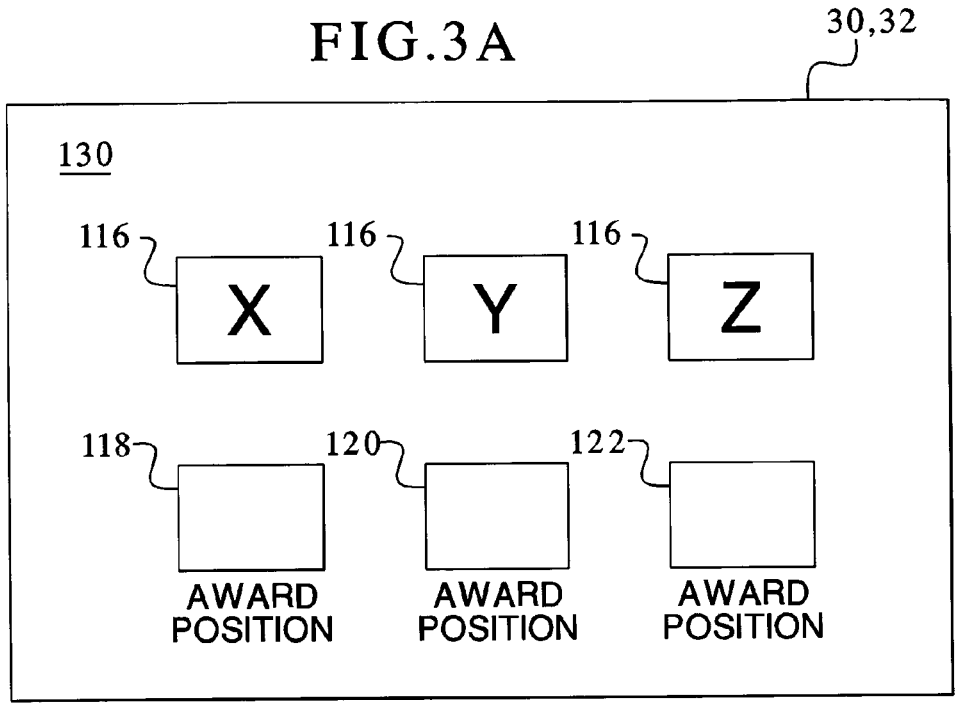
FIGS. 3A and 3B are front elevation views of one of the display devices that illustrate the player's placement of masked numbers into award positions.
Figure 3B:
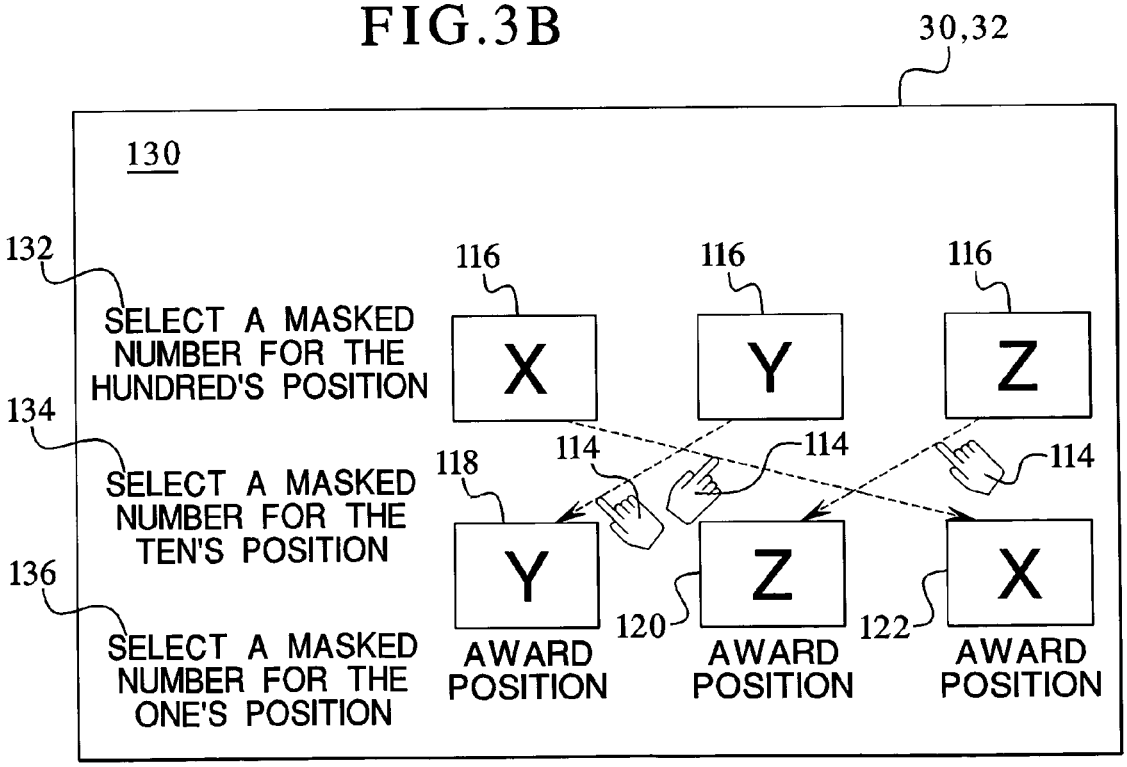

Referring now to FIGS. 3A and 3B, the game displays three selectable selections or masked numbers 116, namely, the "X," "Y" and "Z" selections or masked numbers 116. The selections or masked numbers 116 illustrated generally on the screen 130, as well as other inputs and indicators, preferably contain indicia that relate to a theme of the gaming device. The selections or masked numbers 116 hide numbers or digits that are revealed and become part of the player's award. That is, the player's award is based on the order of numbers or digits associated with the selections or revealed when the masked numbers are unmasked. For purposes of this application, "selections" and "masked numbers" are used interchangeably.

In an embodiment, at the same time that the "X," "Y" and "Z" selections 116 are displayed, the game also displays a number of positions 118, 120 and 122, which correspond to digits of the player's award. The positions 118, 120 and 122 do not initially contain or display numbers. In one preferred embodiment, the game displays the same number of positions or digits, such as positions or digits 118, 120 and 122, as there are masked numbers 116. That is, the game displays the same number of masked numbers 116 as the positions or digits. In this embodiment, the number of selections 116 sets the order of magnitude of the player's award. For reasons which become apparent below, the game of the present invention preferably displays an award having at least two positions or digits.

In another embodiment, the game displays more masked numbers 116 than positions or digits. That is, the player will not be able to select or use each displayed selection 116. This alternative embodiment may be implemented in a number of ways. In one implementation, the game generates a number of positions or digits, such as the positions 118, 120 and 122, which is equal to or less than the number of masked numbers 116. That is, if the game displays four selections 116, the game generates and displays two, three or four positions (preferably at least two). In this implementation, the game may be adapted to weight the selection, e.g., provide a 60% chance of selecting three numbers, provide a 20% chance of selecting two numbers and provide a 20% chance of selecting four numbers.

In another implementation, the game always displays the same number of positions or digits, e.g., the three positions 118, 120 and 122. The game then generates at least that number of masked numbers 116. This implementation sets the number of digits or the order of magnitude of the player's award, even though the first and second digits may turn out to be zero.

In a further implementation, the game displays less selections 116 than positions or digits. In this embodiment, the game may randomly generate the number of positions or digits or maintain a preset number as described above. This implementation may require the player to use or select a masked number 116 more than once. For instance, the game displays the "X" and "Y" numbers 116 and the positions 118, 120 and 122, wherein the player must use either the "X" or the "Y" twice. This implementation may also be adapted so that the game supplies one of the numbers. For instance, the game displays the "X" and "Y" numbers 116 and the positions 118, 120 and 122, wherein the one's digit 122 automatically has a value of zero. In this implementation, the player only determines the hundred's and the ten's digits.

In FIG. 3A, one of the display devices 30 or 32 displays a screen 130 that illustrates the player's choices of masked numbers 116 and award positions 118, 120 and 122. In one embodiment, upon generating the masked numbers 116 and the positions or digits 118, 120 and 122, the game preferably provides a visual, audio or audio-visual message 132 informing the player to select one of the selections 116 for the hundred's digit or position 118 as illustrated in FIG. 3B. In this example, the player 114 selects that the masked number 116 having the "Y" symbol or masking indicia be placed in the hundred's award position 118. The game then provides a visual, audio or audio-visual message 134 informing the player to select one of the selections 116 for the ten's digit or position 120. As illustrated in FIG. 3B, the player 114 selects that the masked number 116 having the "Z" symbol or masking indicia be placed in the ten's position 120.

The game thereafter provides a visual, audio or audio-visual message 136 informing the player to select one of the numbers 116 for the one's digit or position 122. As illustrated in FIG. 3B, the player 114 selects that the selection 116 having the "X" symbol masking indicia be placed in the one's position 122. The player selected masked award is thus "Y," "Z," "X" as illustrated in FIG. 3B by the positions 118, 120 and 122, respectively.

In one preferred embodiment, the game does not enable the player to reselect a previously selected masked number 116. For instance, when the player 114 picks the "Y" number 116 for the hundred's position 118, the game removes, grays out, darkens or otherwise indicates that the "Y" number 116 is no longer selectable. In this embodiment, the game may be adapted to fill in the last digit, e.g., the position 122, after the player makes the second to last pick, since there is only one other choice. In another embodiment, the player is able to pick the same masked number 116 a predefined number of times or any amount of times, so that the selected masked award can thus be "Z," "Z," "Z," if desired.

Upon providing the message 132, 134 or 136, the game highlights, flashes or otherwise indicates the hundred's 118, ten's 120 and one's 122 positions, respectively, and/or grays out or otherwise indicates that the other positions are not to be currently filled. The present invention includes a selection ordering device that enables the player to order the selections. The selection orderer may be adapted a plurality of ways. In one embodiment, the selection orderer is adapted so that the selections 116 are selectable areas of a touch screen 50 that are each individually adapted to send a discrete input to the processor 38. When the game highlights the hundred's position 118 and the player selects the "Y" number 116, the game places the "Y" in the hundred's digit. The game alternatively uses separate electromechanical devices (not illustrated) representing each of the numbers 116 in a like manner as the touch screen 50 areas.

In another embodiment, the selection orderer is adapted so that the touch screen 50 enables the player to press and drag or place a number 116 on a position or digit. The selection orderer in one implementation visually displays the number 116 moving to the desired digit, so that the player can discern when it is in position. In another implementation, the selection orderer maintains an area in the memory device 40 that acts similar to the Microsoft™ clipboard, whereby the game remembers the last number 116 that the player selected. For instance, if the player selects the "X" number 116, the game stores the "X" on the clipboard. When the player touches the one's digit 122, the game remembers that the "X" is on the clipboard and places the "X" in the one's position 122. If the player selects two numbers 116 sequentially, the game may be adapted to either write over or maintain the original selection.

The select and drag or select and place embodiments of the selection orderer are not time dependent and may be advantageous in that they let the player fill in the award digits as desired by the player. These selection orderers may further be adapted to allow players to change their minds and move the selections 116 after they have been placed in a position or digit. If the player moves a number 116 to an empty position or digit, the game needs to take no further action and awaits the player's next selection. If the player moves a selection 116 to an occupied position or digit, however, the game preferably writes over the previous selection, redisplays the removed selection 116 on the display device 30 or 32, ungrays it or otherwise indicates that it is once again selectable. The game may be adapted to allow the player to change masked numbers a limited or unlimited number of times. This embodiment preferably includes a "keep it" or select button (not illustrated), which enables the player to send a signal to the processor to indicate that the current positioning or ordering is satisfactory and to reveal the award as selected.

Figure 3C:
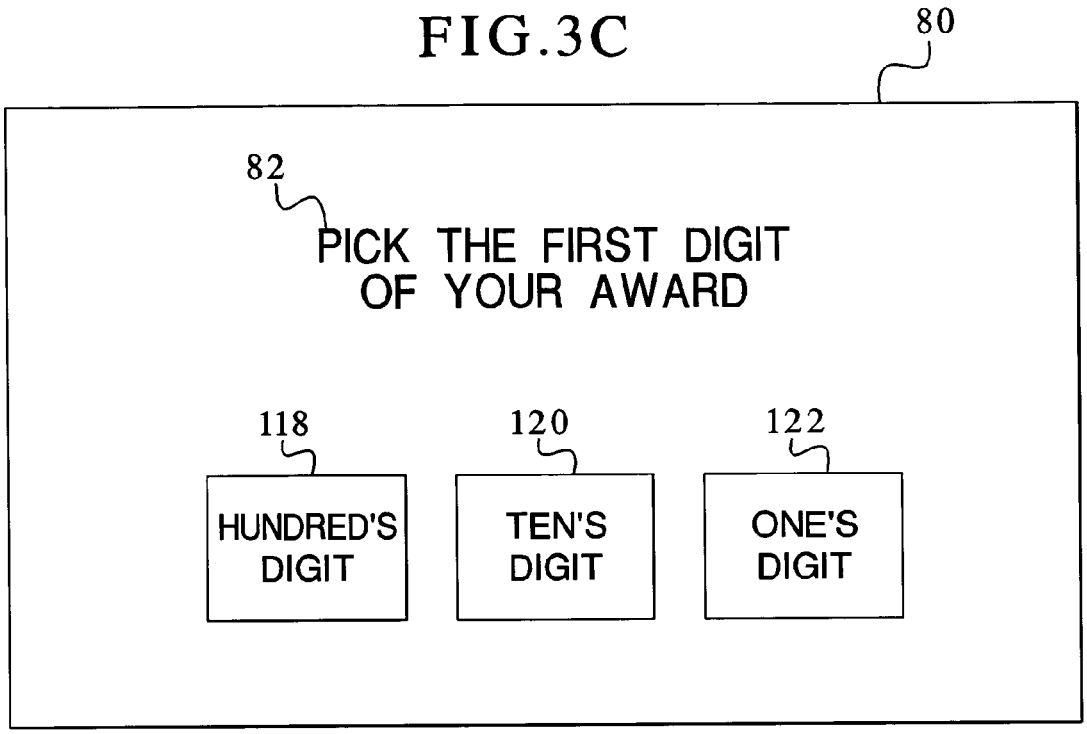
FIGS. 3C and 3D are front elevation views of one of the display devices that illustrate one preferred embodiment wherein the gaming device assigns a hidden number to the player's pick and the player selects which digit receives the number.
Figure 3D:
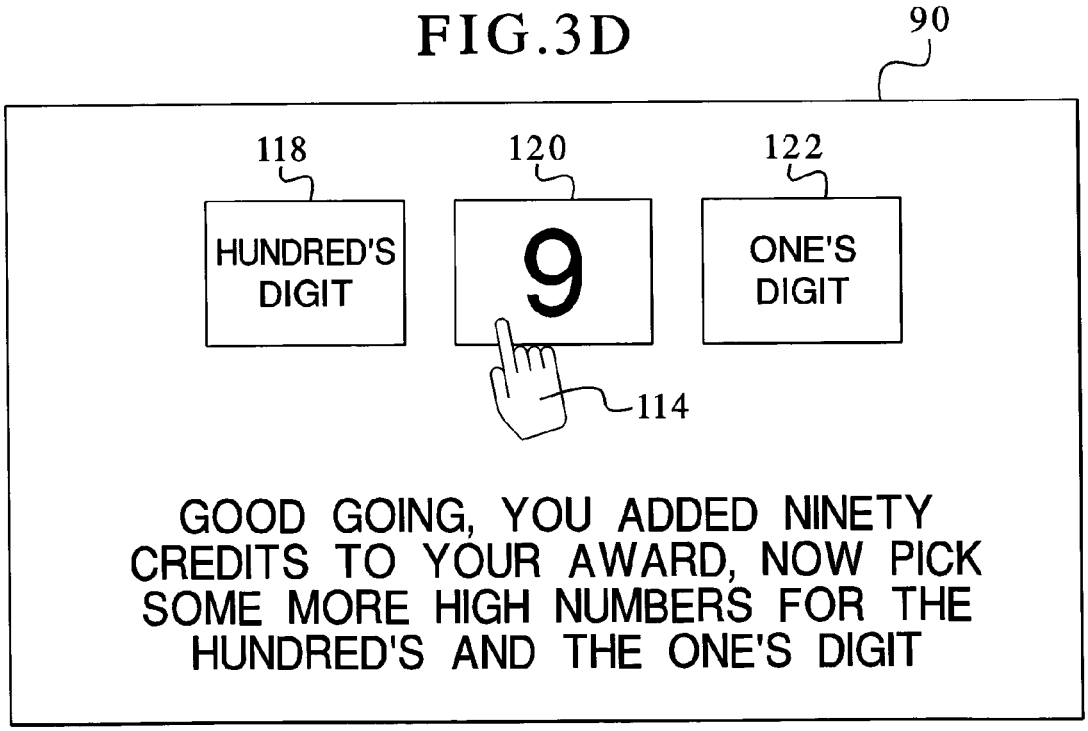

Referring now to FIGS. 3C and 3D, one preferred embodiment of the present invention is illustrated. The screen 80 of FIG. 3C displays the award positions or digits 118, 120 and 122, but does not display the masked numbers or selections 116. The digits may have any desired identifying indicia, such as the "hundreds digit," "tens digit" and "ones digit" as illustrated. In this embodiment, one or more audio, visual or audio visual messages, such as the message 82, instruct the player, e.g., to "pick the first digit of your award."

Gaming device 10 in one preferred embodiment randomly determines a number for each of the player's picks. Gaming device 10, for example, may assign: (i) the number nine to the player's first pick of a digit; (ii) the number three to the player's second pick of a digit; and (iii) the number five to the player's third pick of a digit. It should be appreciated that in this example, the player is best served to pick the hundred's digit 118 first, the one's digit 122 second and the ten's digit 120 third.

Gaming device 10 may be adapted to randomly assign numbers to each of the player's picks before the player actually makes a selection, or the game can make the random assignments as the player makes the selections. Preferably, however, even a contemporaneous assignment gives effect to the player's decision. Giving effect to the player's selection order is further discussed below in connection with FIG. 4 and the database 142 of FIG. 5.

In an alternative embodiment, the gaming device may assign the numbers based on the position that the player selects. In such a case, gaming device 10 assigns a number to the hundred's digit 118, the ten's digit 120 and the one's digit 122 before the player makes any selections. Here, the order that the player selects the digits does not affect the overall award, which is less desirable. Not giving effect to the player's selection order is further discussed below in connection with FIG. 4 and the databases 144 through 148 of FIG. 5.

In the screen 90 of FIG. 3D, after receiving the message 82, "pick the first digit of your award" (FIG. 3C), the player 114 selects the ten's digit 120, and gaming device 10 reveals the nine. The gaming device 10 then displays a second audio, visual or audio-visual message 84, such as, "Good going, you added ninety credits to your award, now pick some more high numbers for the hundred's and the one's digit." The player then selects either the hundred's digit 118 or the one's digit 122, the gaming device 10 reveals a number and this process repeats until each of the digits displays a number, wherein the player's overall award is complete. This preferred embodiment may be adapted to have any number of award positions or digits.

Figure 4:
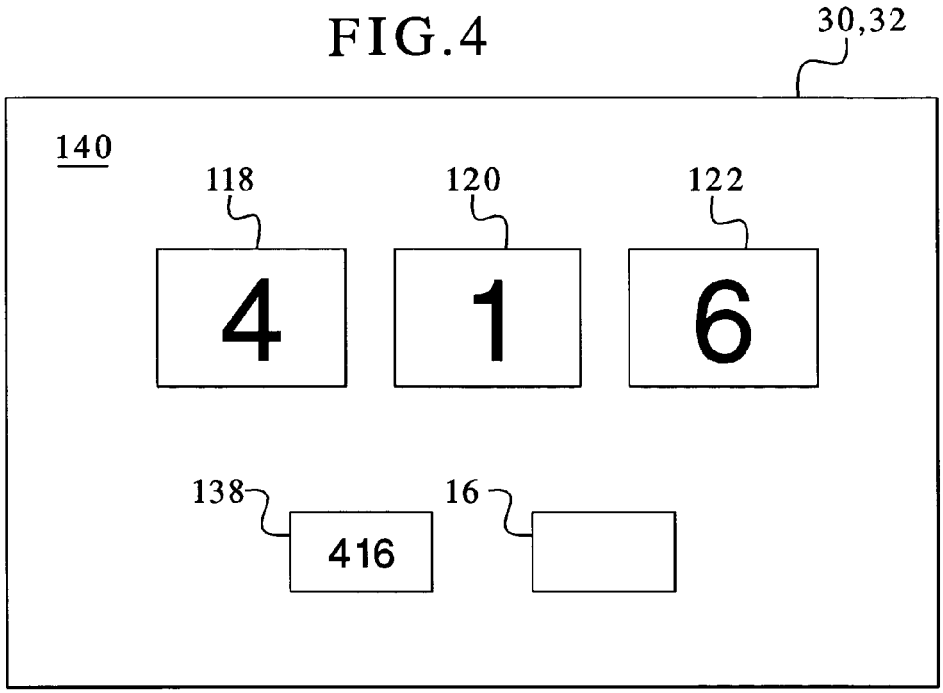
FIG. 4 is a front elevation view of one of the display devices that illustrates the revealing of the player's award.

Referring now to FIG. 4, one of the display devices 30 or 32 illustrates the revealing of the player's award. A screen 140 displays the positions or digits 118, 120 and 122, but not the masked numbers 116. The game of FIGS. 3A and 3B has removed the masked numbers 116 to reveal the player's award of 416, or the game of FIGS. 3C and 3D has reached the point where the player has selected all three digits. The screen 140 also displays a paid display 138 and a simulated credit display 16. The paid display 138 indicates the award that the player has won by placing the masked numbers in the desired positions. The total credit display 16 displays the player's total awards or credits, which includes the additional amount generated by the recent award. The award displayed by the positions 118, 120 and 122 may be game credits or game credit multipliers. The game may be adapted so that the award represents other items of value, such as a number of picks from a prize pool.

The game may reveal the masked numbers 116 all at once or one at a time. If revealed at different times, the game may reveal the masked numbers in the order that the player placed the numbers 116 in the positions (e.g., as the player places a number), from left to right, right to left, or in any other desired manner. If the game generates more masked numbers 116 than positions, the game may be adapted to reveal the unselected numbers 116 at this time or at any other time when the player can no longer select the number 116. Accordingly, the game may continue to display the masked numbers 116 or only the unselected masked numbers 116, if desired.

The game may be adapted to add other features to the reveal sequence to enhance the player's enjoyment and excitement. For example, the game in one embodiment shows all three revealed numbers to the player somewhere on the display device 30 or 32 before displaying which position the numbers belong to. The game in another embodiment audibly announces the generated numbers from the speakers 36 before revealing their positions. Informing the player of the chosen numbers but not their positions enhances the player's anticipation.

In one preferred embodiment, the award is formed by revealing values in the positions or digits 118 through 122, as illustrated. The award is the number created and displayed on the display device 30 or 32. In another embodiment, the game performs a mathematical operation using the generated values. For instance, the game in one implementation multiplies 4×1×6 and provides the player an award of 24. The game may be adapted to employ any combination of addition, multiplication, subtraction or division to form the player's award.

In a further embodiment, the award is formed through a combination of revealing values in the positions or digits and by performing a mathematical operation. For example, instead of displaying 416, the positions 118 through 122 display 4, 3× and 6, respectively. In this embodiment, the game takes the 4 and places it in the ten's digit to form an amount of 46. The game then multiplies the 46 amount by 3 to form the player's overall award. The game also preferably provides a suitable visual grouping display to show the player what is happening. The game could alternatively slide the 6 into the ten's digit, assume a value such as zero for the one's digit, form the amount of 460 and multiply the 460 amount by 3 to determine the player's award.

Figure 5:
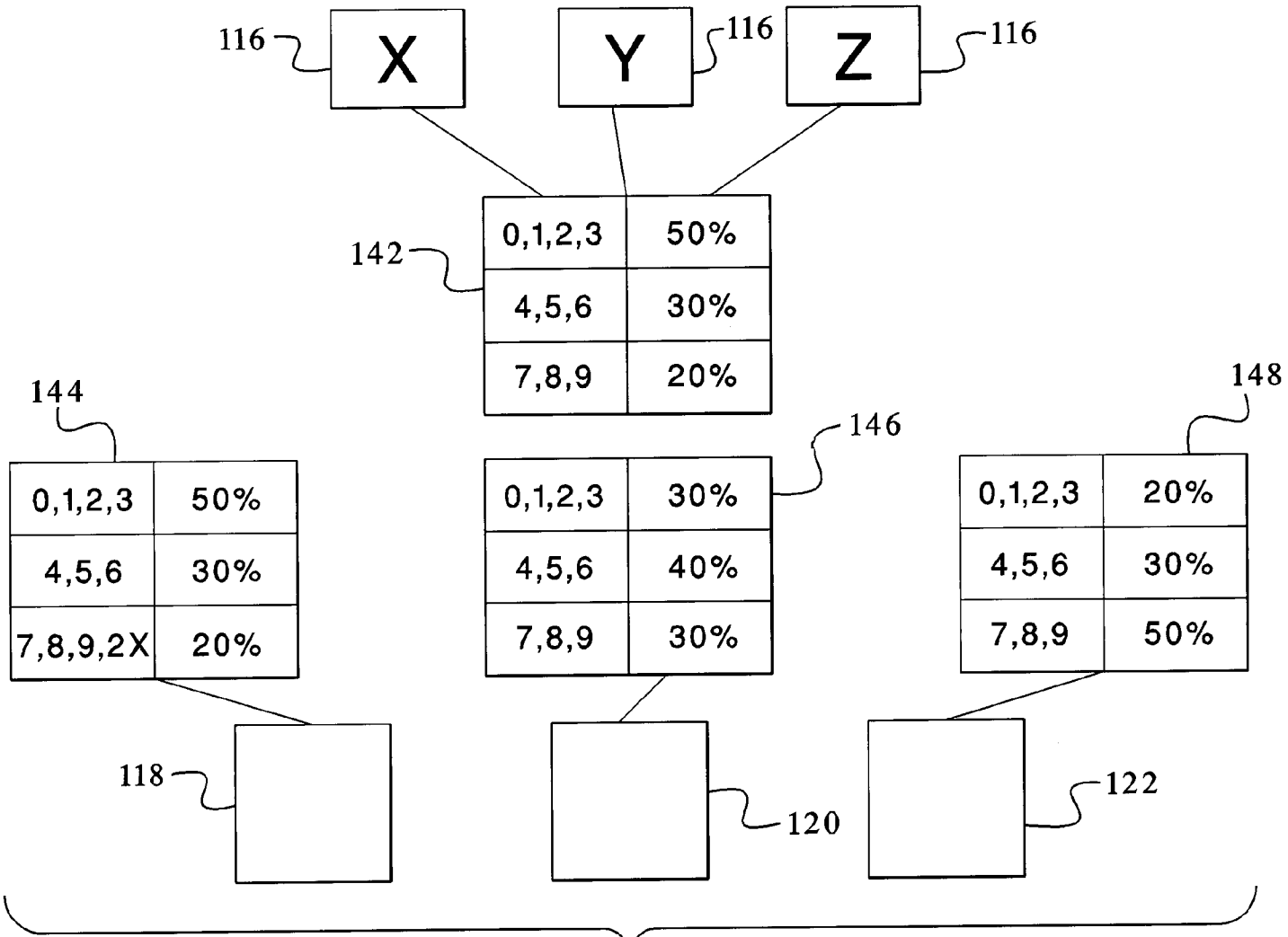
FIG. 5 is a schematic view of various database embodiments that may be employed to reveal the player's award.

Referring now to FIG. 5, the schematic diagram illustrates various database embodiments that may be employed to reveal the player's award. In one preferred embodiment, the player's placement of the masked numbers 116 (FIGS. 3A and 3B) or selection of the digits (FIGS. 3C and 3D) actually determines the award that is issued to the player in the paid display 138. That is, referring to FIG. 5, if the player would have placed the masked numbers 116 or selected digits in a different order, the game would have generated a different award such as 146, 164, 461, 614 and 641. In this embodiment, the game generates a value from a database for each masked number. Gaming device 10 may or may not be enabled to generate a number more than once. In one embodiment, the values are not weighted.

In another embodiment, the numbers or values are weighted, as illustrated by database 142. For each of the masked numbers "X," "Y," and "Z," the game generates and assigns or associates one of the values 0 through 9 from the database 142. The database 142 may also include multipliers or other mathematical modifiers as described above.

In the database 142, it is more likely that the game generates and assigns the 0, 1, 2 or 3 value to the masked numbers 116 (FIGS. 3A and 3B) or to the digits (FIGS. 3C and 3D) than the 4 through 9 values. With the database 142, it is more likely that the game generates and assigns the 4, 5 or 6 value to the masked numbers 116 than the 7 through 9 values. The weighting percentages of the database 142 may be adapted to be weighted as desired by the implementor or not weighted at all. The implementors weight the database so that the resulting award is, on average, in accordance with the desired payout percentage of the gaming device 10.

In another embodiment, the player's placement of the masked numbers 116 (FIGS. 3A and 3B) or selection of the digits (3C and 3D) does not actually affect the award that is issued to the player in the paid display 138. That is, referring to FIG. 4, if the player would have placed the masked numbers 116 or selected the digits in a different order, the game would still have generated the same award, 416. In this embodiment, like the last, the game generates values from weighted or non-weighted databases or based on any suitable probabilities. This embodiment, however, includes maintaining different databases for different positions or digits.

In FIG. 5, the hundred's position 118 has an associated database 144, the ten's position 120 has an associated database 146 and the one's position 122 has an associated database 148. Each database 144 through 148 preferably includes the values 0 through 9 and may also include multipliers or other mathematical modifiers as described above. The databases differ in the weighting of the different values. In the database 144, which is assigned or associated with the hundred's digit, it is most likely that the player obtains a hundred's digit of 0 through 3, second most likely that the player obtains a hundred's digit of 4 through 6 and least likely that the player obtains a hundred's digit of 7 through 9. It should be appreciated that this distribution is associated with the position 118 and is therefore independent of the particular masked number 116 that the player selects for the hundred's digit.

The weighting distribution is different for the tens digit 120, as illustrated by the database 146. Here, the middle values 4 through 6 are generated slightly more often than the lower or higher values. The higher values of 7, 8 and 9 each have a ten percent chance of being generated, while the lower values each have a less than ten percent likelihood of being generated. For the one's digit 122, the database 148 weights the values 0 through 9 such that the highest values are most likely to be generated, the middle values are the second most and lowest values the least most likely to be generated.

In the illustrated embodiment, it is thus more likely to receive a lower value in the hundred's position 118, a middle value, on average, in the ten's position 120 and a higher average value in the one's position 122. Different distributions can obviously be achieved in accordance with a desired payout percentage by varying the weightings of the individual databases. Each of the databases 142 through 148 is programmed and stored in the memory device 40 as is well known. One or more random number generators, which are also preferably stored as software code, generate numbers according to the desired weighting system.

Generating Masked Numbers in a Bonus Game

Figure 6:
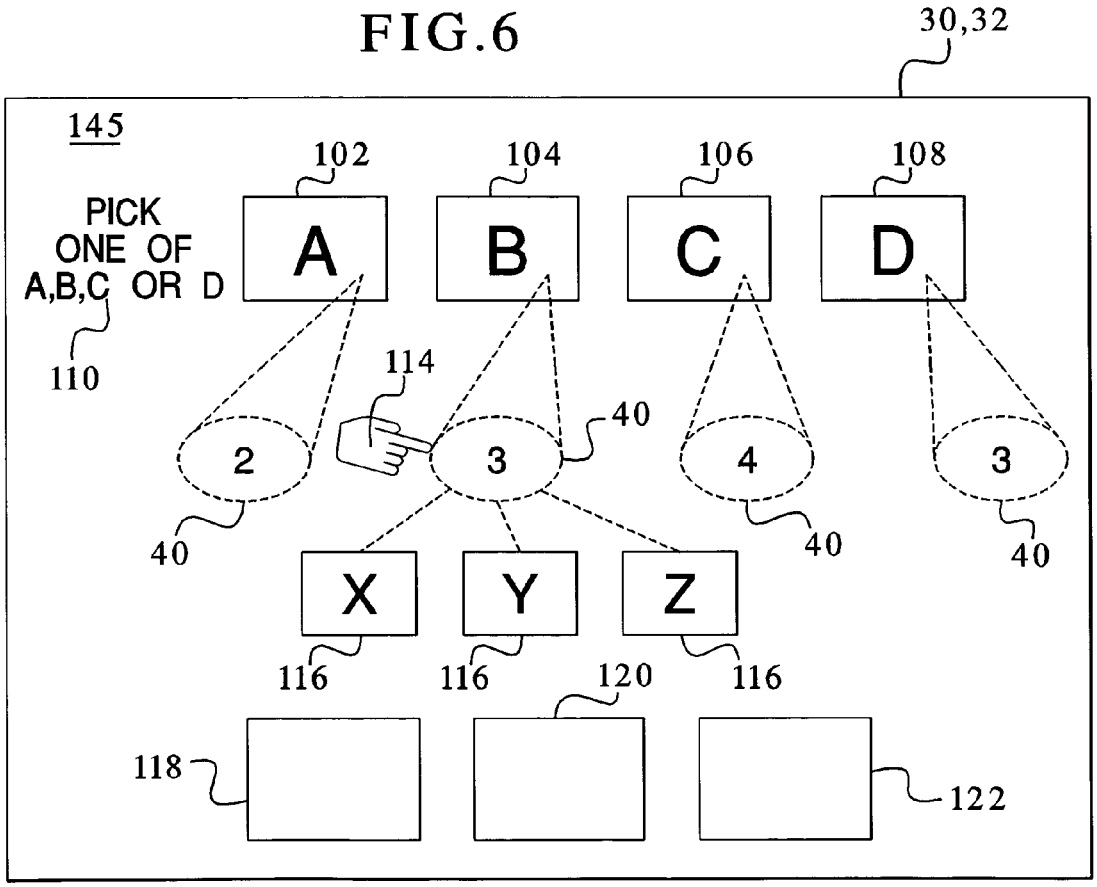
FIG. 6 is a front elevation view of one of the display devices that figuratively illustrates an initial random generation of a number of masked numbers that may form the player's award.

In one embodiment, the game provides a predefined number of masked numbers 116 (FIGS. 3A and 3B) or digits (FIGS. 3C and 3D) and preferably three masked numbers 116 or digits. In one alternative embodiment, the game varies the number of masked numbers 116 or digits. Referring now to FIG. 6, one of the display devices 30 or 32 displays a screen 145 that has an initial generation sequence for determining how many masked numbers 116 (FIGS. 3A and 3B) or digits (FIGS. 3C and 3D) are used to form the player's award. The screen 145 displays four inputs 102 though 108, which are designated to the player by their respective indicia or symbols, "A" through "D." The inputs 102 through 108 are each selectable choices, and the message 110 informs the player to pick one of them.

The screen 145 can present any number of selectable inputs, such as inputs 102 through 108, and is not limited to presenting four as illustrated. The selectable inputs in one embodiment are areas of a touch screen 50 (see FIG. 2) in communication with the processor 38 and a touch screen controller 52. The inputs may alternatively be separate electromechanical input devices, mounted elsewhere on gaming device 10, which are in communication with the processor 38. A message 110 is visually displayed, audibly displayed through speakers 36 or both.

The inputs 102 through 108 are each associated with a quantity of the masked numbers 116 or digits, such as digits 118, 120 and 122, which are stored in an area of the memory device 40. The area of the memory device 40 having the quantity of masked numbers 116 or digits is illustrated here in phantom for purposes of describing the present invention. In the game, the player does not know the quantity of masked numbers 116 or digits associated with any of the selectable inputs.

To simplify the illustration, the screen 100 illustrates one embodiment, wherein the game randomly assigns a quantity of masked numbers 116 to each selectable input 102 through 108. It should be appreciated, however, that gaming device 10 may alternatively be adapted to assign a quantity of digits, such as the digits 118 through 122, to the inputs 102 through 108. Each selectable input is randomly assigned a quantity of masked numbers 116 from a database or table (not illustrated), which is stored in the memory device 40. The database may be weighted such that a particular quantity or set of quantities is assigned more often than another quantity or set of quantities. This embodiment enables the game to reveal the quantities of the masked numbers 116 for the unselected inputs after the player chooses one of the selectable inputs 102 through 108.

In another embodiment (not illustrated), the game does not assign a different quantity of masked numbers 116 to each input 102 through 108; rather, the game randomly assigns a quantity to a particular game. That is, the game generates and displays the same quantity of masked numbers 116 no matter which input the player selects. In this embodiment, the game also picks from a database stored in the memory device 40 that may be weighted such that a particular quantity or set of quantities is assigned more often than another quantity or set of quantities.

In one embodiment, the database is weighted so that it is more likely that the player generates a particular number of, such as three, masked numbers 116. The screen 145 illustrates that if the player selects either the "B" input 104 or the "D" input 108, the game displays three masked numbers 116 on the display device 30 or 32. If the player selects the "A" input 102, the game only displays two masked numbers 116, and if the player selects the "C" input 106, the game displays four masked numbers 116. For the reasons discussed below, the game preferably provides at least two masked numbers 116. As illustrated in this schematic example, when the player 114 picks the "B" input 104, the game generates three masked numbers 116.

Bonus Round Display

The game as illustrated in FIGS. 3A through 6 does not resemble the known primary games of slot poker, keno or blackjack. Indeed, the embodiments illustrated to this point are preferably a bonus game which can be triggered by any of the above mentioned primary games or any other primary game. The bonus game preferably includes indicia and a theme in accordance with a theme of the base game. In one implementation, the theme of the game includes a mother kangaroo and baby kangaroos or joeys.

The joeys can represent either masked numbers 116 or digits, e.g., digits 118 thorough 122. In one implementation, the game is predefined to provide three joeys and three digits or positions. Another implementation employs the selectable inputs 102 through 108, which are each mother kangaroos.

Here, the player selects one of the mother kangaroos and a quantity associated with the selected input appears, e.g., the number "three," whereby this quantity of joeys are shown to come out of the selected mother kangaroo.

In one implementation (FIGS. 3A and 3B), the game asks the player to place the joeys on one of a plurality of predefined award positions or digits in the order that the player desires. In another implementation (FIGS. 3C and 3D), the game asks the player to pick a joey digit to reveal a number of the player's award. Once the joeys are picked, the joey digits each reveal a number and collectively form the player's award. If one of the joeys reveals a multiplier or a mathematical modifier instead of a value, the multiplier multiplies an award formed by the values from the remaining joeys.

Player-Selectable Awards in Combination with Slot

Figure 7:
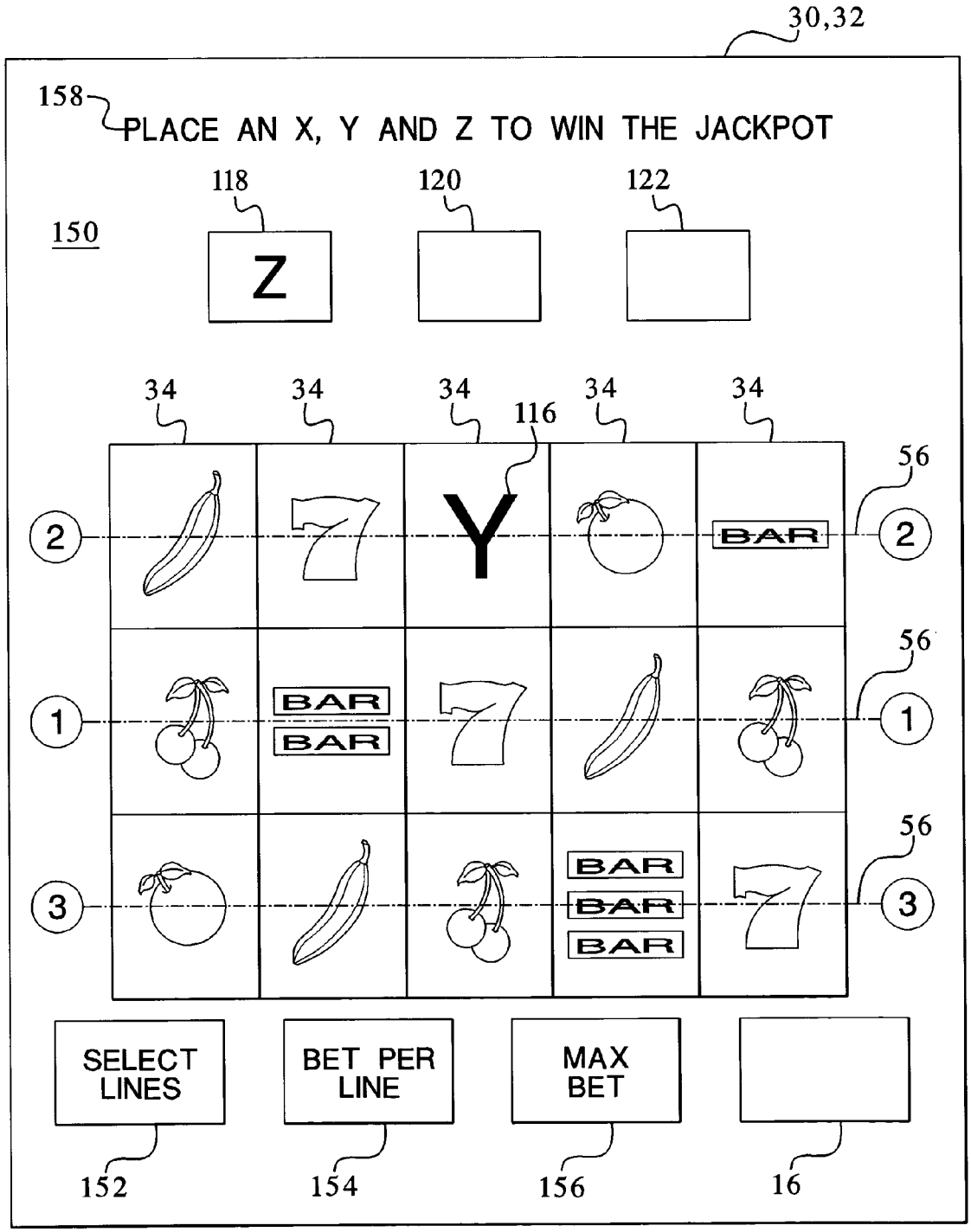
FIG. 7 is a front elevation view of one of the display devices illustrating an embodiment wherein the player-selectable award of the present invention is incorporated into the base or primary game of slot.

Referring now to FIG. 7, a screen 150 illustrates an embodiment wherein the player-selectable award of the present invention is incorporated into the base or primary game of slot. One of the display devices 30 or 32 displays the reels 34 and a plurality of paylines 56 having the functions as described above in connection with FIGS. 1A and 1B. The screen 150 also includes other well known selectable touch screen areas, such as the select lines input 152, bet per line input 154 and max bet input 156. The screen 150 further includes well known indicators, such as the total credit display 16.

The select lines input 152 enables the player to pick whether to play one, two or three paylines 56. The slot machine of the present invention may be adapted to have any number of paylines 56 and typically has one, three, five, nine, fifteen or twenty-five paylines 56. The bet per line input 154 enables the player to wager a desired amount of coins or tokens on the desired number of paylines. The slot machine of the present invention may be adapted to allow the player to wager any amount of coins or tokens per payline and in one preferred embodiment allows the player to wager up to five coins per payline. The max bet input 156 is a convenience input that enables the player to play the maximum amount of coins or tokens on all available paylines upon a single input by the player.

The screen 150 also includes the positions or digits 118 through 122 having the functions as described above in connection with FIGS. 3A through 6. The slot embodiment may be adapted to provide any number of positions, not just three, and the number of positions may vary randomly or according to a preset program. In the illustrated embodiment, as above, the game provides three positions or digits, so that the player's "jackpot" award has three digits, even if one or both the first two digits are zero.

In connection with the slot game, the present invention operates substantially as described above. The main difference is in how the game generates the masked numbers 116. Instead of generating the masked numbers 116 all at once, the slot base game generates the masked numbers 116 intermittently according to the number of masked numbers 116 that the implementors place on the reels 34, the rules of the game, the player's wager and luck.

The implementors dispose masked numbers 116 on the reels 34 to achieve the desired payout percentage of the game. One, a plurality of or all the reels may include masked numbers 116. Each of the reels having masked numbers 116 may be adapted to have one or a plurality of the masked numbers 116. The game may be adapted to require the player to generate a masked number for use with the jackpot award: (i) on an active payline; (ii) on an active payline having max coins wagered; (iii) when all paylines are active; or (iv) when the player plays max coins. The game may alternatively provide a masked number 116 anytime the game generates one anywhere on the reels 34.

The player-selectable award of the present invention can be combined with the base game of slot in many different ways. As indicated by the visual, audio or audio-visual message 158, in one implementation the player must place an "X," "Y" and "Z" masked number 116 in the positions 118, 120 and 122, as before, to win the jackpot award. If the player generates the "X" a number of times in a row, the subsequent generations after the first generation do not help the player win the jackpot. In this implementation, the game may be adapted to associate a value database with the masked numbers 116 or the positions 118 through 122, as described in connection with FIG. 6.

In another implementation, the reels 34 contain masked numbers 116 having the same indicia. That is, instead of "X," "Y" and "Z," the numbers 116 have only "X" or some other desired indicia. The player places the masked numbers 116 in the positions or digits as before. Here, the game preferably assigns a value and thus a value database to the position or digit 118, 120 or 122 with which the player places the number 116.

In a further alternative embodiment, which coincides with the disclosure in connection with FIGS. 3C and 3D, one or more of the reels 34 contains a symbol that enables the player to select one of the digits or positions 118 through 122. One or more players select the digits until each have been selected.

In any implementation, the game may reveal the masked numbers 116 or digit selections as the player places them or alternatively after each position has been selected or has a masked number. If revealed all at once, the game may be further adapted to allow the player a chance to rearrange the selection a limited or unlimited number of times before revealing the award. In this rearrangement, the game would flip flop a non-revealed number placed on one position with a non-revealed number placed on another position. The game would provide a "keep it" or select button (not illustrated), which would enable the player to send a signal to the processor 38 that the current positioning is satisfactory and to reveal the award as selected.

The award in the slot machine embodiment is a secondary or "jackpot" award. The slot machine game generates other base game awards according to a paytable of winning combinations of the symbols presented by the reels 34. The player-selectable award of the present invention, which is in the nature of a bonus or extra award, is likely to be a relatively large award in relation to the base game awards to attract players and to increase the fun and excitement associated with the gaming device 10. Large, one time or intermittent awards of this type are often termed jackpot awards.

The player-selectable award as described in connection with the base game of slot is a persistent award, that is, it takes a series of games or a period of time before a player wins the award. That is, the positions or digits 118 through 122 preferably do not zero out when a player cashes out by selecting the cash out button 26. If a first player generates the "Z" and the "X" and leaves the gaming device 10 before generating the "Y" and the jackpot award, a second player stands in the first player's place (only needs the "Y") upon beginning play. The award may also be progressive and be funded by a percentage, e.g., ten percent, of each wager.

It should be appreciated that the base games of blackjack, poker and keno may be modified to include the player-selectable award feature of the present invention. In either of the card base games of poker and blackjack, designated face cards or cards having other indicia interspersed among the face cards are used as the masked symbols 116. In the base game of keno, designated numbers or other indicia interspersed among the keno numbers are used as the masked symbols 116.

Award Modifications

The game of the present invention, in any of the embodiments previously described, includes modifying the player's award. In one embodiment, the gaming device randomly determines when to modify the player's award. In another embodiment, the gaming device modifies the player's current award when the current award is less than the expected value.

In another embodiment, gaming device 10 provides the award modification as an option. That is, after placing masked numbers 116 in the digit positions or places 118 through 122 (FIGS. 3A and 3B) or selecting each of the digits (3C to 3D), and revealing the corresponding award, the game provides an opportunity or option to the player to change or keep the award. This option may be randomly generated and presented to the player from time to time or, in one embodiment, the game generates the option after each original award generation.

Figure 8:
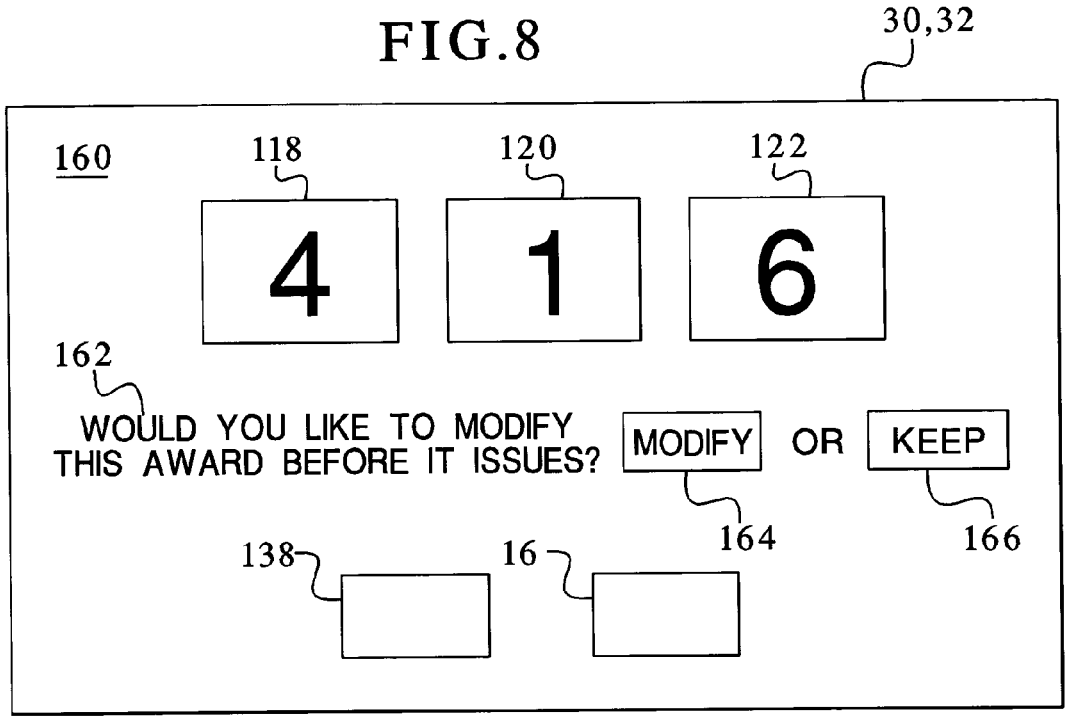
FIG. 8 is a front elevation view of one of the display devices illustrating an award modification option screen of the present invention, wherein the player decides whether to keep or modify a generated award.

Referring now to FIG. 8, a screen 160 generally illustrates the award modification option of the present invention. In this screen, the game has generated the award of 416 but has yet to download or pay the award to the player, whereby the paid display 138 would display the award, and the total credit display 16 would update accordingly. The option includes a suitable visual, audio or audio-visual message 162 inquiring whether the player wishes to modify the original award before it issues. The option also includes a modify input 164 and keep input 166, which are preferably simulated areas of a touch screen 50.

If the player elects to keep the original award by selecting the keep input 166, the game provides it to the player and game play resumes. If the player elects to modify the award by selecting the modify input 164, the game in one embodiment randomly generates one of a number of different modification methods. The random selection of a modification method also applies to embodiments wherein modification is not an option and instead occurs randomly or based on an expected value.

Since the different methods have substantially different potential outcomes, the method generation is preferably weighted, although it does not have to be. Generally, the more drastically the original award may change due to a modification method, the less likely it is that the game generates that modification method.

The modification methods include the following: (i) an award rearrangement or scramble using existing numbers or digits; (ii) a complete regeneration; (iii) an addition of a digit to the original award; (iv) a removal of a digit from the original award; and a multiplication of the original award. Alternative implementations of the award modification embodiment include any combination of less than all of the modification methods.

In the kangaroo/joey theme described above, in one implementation, three joeys or masked numbers 116 appear from the mother kangaroo. The player orders the joeys, and the game reveals an award and an award modification option. In one implementation, the game provides an area of the touch screen 50 which is associated with a displayed help button. When the player presses the help button (not illustrated), the display 30 or 32 provides a help screen (not illustrated) that explains each of the modification methods, i.e., the potential awards and losses associated with each method. If the player chooses to modify the award, another joey or theme related symbol appears from the mother kangaroo and reveals which modification option the player has drawn.

Figure 9:
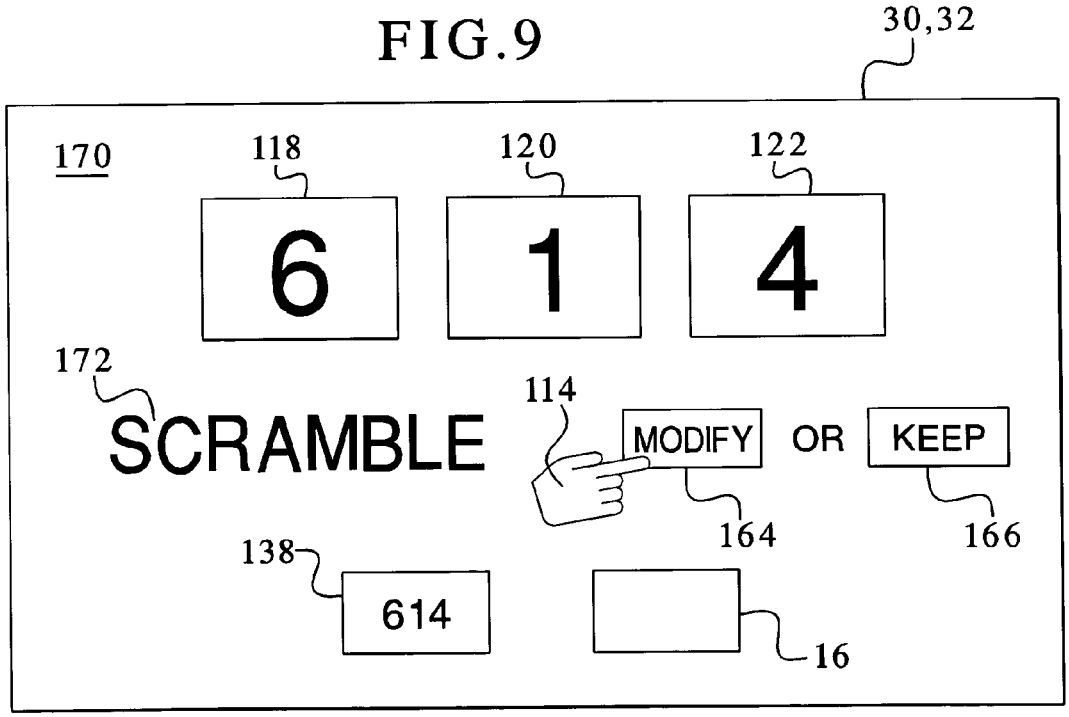
FIG. 9 is a front elevation view of one of the display devices illustrating the award scramble or rearrangement modification method of the present invention.

Referring now to FIG. 9, a screen 170 displays the award rearrangement or scramble modification method of the present invention, wherein one of the display devices 30 or 32 displays the original award of 416 in the digit positions or places 118 through 122. It should be appreciated that the rearrangement option of the present invention may be an option for the bonus and base game embodiments disclosed above in connection with the player-selectable awards. It may also be an option for any award generated via the gaming device 10 and is not limited to the player-selectable awards as herein described. The digits or positions 118 through 122 are, however, helpful in describing the option.

The game provides the scramble modification method to the player according to a predefined or varying probability stored in the memory device 40. Since the scramble modification method maintains the order of magnitude of the player's award (i.e., such as a three digit award) and may result in a higher or lower award (i.e. which results from the change in the order of the numbers in the award positions), this method is generated relatively often. The game can alternatively predefine this option to result from the occurrence of some game event, such as a particular combination of slot symbols, face cards or other event.

The scramble modification option enables the player to flip-flop or scramble the digits, i.e., change the order of the digits in the award. The scramble works in one of two primary ways. Assuming the award has three digits (even if the first and second digits are zero), the game either randomly selects from all six combinations of three digits, including the player's current award, or, from the five remaining combinations besides the current award. That is, if the player decides to risk the award, the game generates a different award, for better or worse. In the above example, the player risking an award of 416 might obtain an award of 146, 164, 461, 614 or 641. In the other implementation, the player might also receive 416 again. In either case, the game in one implementation evenly weights each possibility.

In the screen 170 of FIG. 9, when the player 114 selects the modify input 164, the game displays a suitable symbol or message 172 indicating that the scramble modification method has been generated. The game thereafter scrambles or rearranges the original award and forms a new award of 614. The new award is in one embodiment immediately downloaded to the paid display 138. In an alternative embodiment, the scramble modification method may be adapted to provide multiple rearrangement opportunities. In a further alternative embodiment, the game may be adapted to repeat the entire option process a predetermined number of times.

As described above, the player-selectable award is preferably at least two and most preferably at least three digits. It should be appreciated that the award rearrangement option is inapplicable to an award of a single digit. The award rearrangement option is too simple for an award having two digits. Players would generally choose to rearrange an award of 19 to try to obtain an award of 91 and at the worst wind up with an award of 19 unless a related consolation award was less than the award of 19. Four digits provides a significant number of combinations for the player to understand and also requires a relatively substantial award. Therefore, the rearrangement option is preferably applied to a three digit award.

In an alternative embodiment, the game does not provide an option and instead automatically scrambles or rearranges the award when the expected value of the digits of the current award exceed the current award, i.e., when the smart play is to exercise the rearrangement option. Using the implementation wherein the game selects only from the different permutations of the player's award, in the example where the game generates an award of 416, the expected value after rearranging the award is (146+164+461+614+641)/5=405.2. Thus, even though three out of five results increase the current award of 416, the smart play is to keep the 416 award. The game in the auto-rearrange embodiment therefore does not rearrange the player's award. In this situation, the game may be adapted inform the player that the smart play is to keep the current award, but that the player may rearrange at the risk of obtaining a lower award.

In another alternative embodiment, gaming device 10 automatically and randomly rearranges the player's award. Gaming device 10, for example, may be adapted to rearrange the player's award on average once every ten games, wherein a random generation software generates a rearrangement using the weighted distribution.

Figure 10:
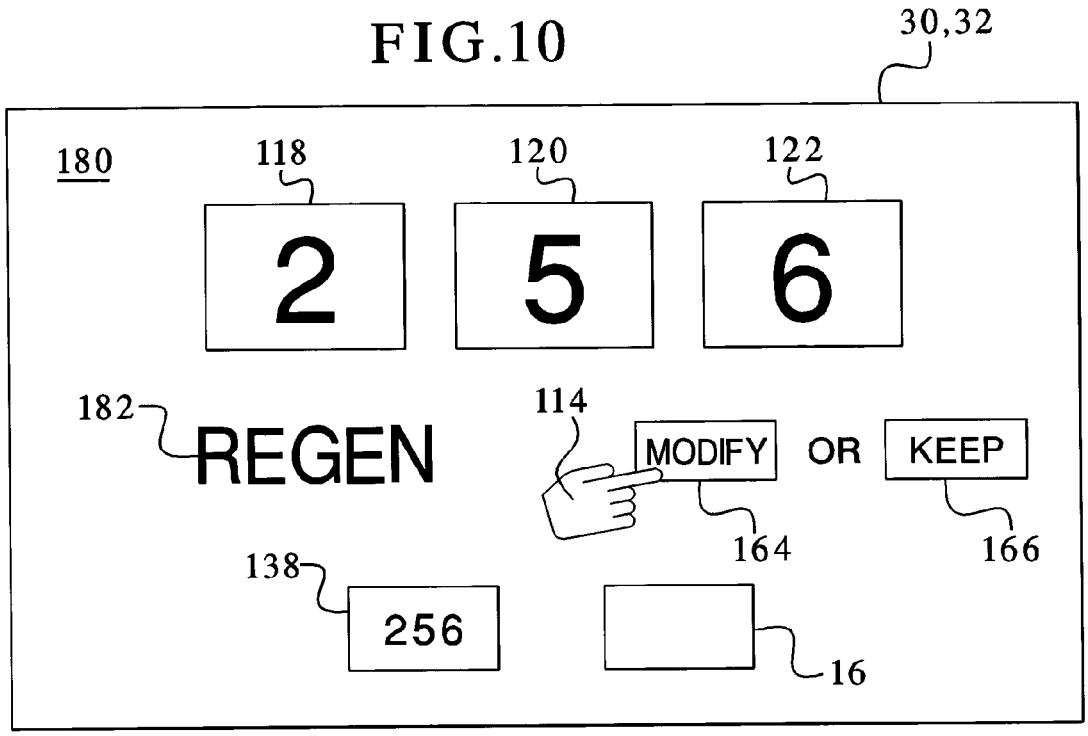
FIG. 10 is a front elevation view of one of the display devices illustrating the award regeneration modification method of the present invention.

Referring now to FIG. 10, a screen 180 displays the award regeneration option method of the present invention, wherein one of the display devices 30 or 32 displays the award of 416 in the award digit positions or places 118 through 122. It should be appreciated that the regeneration option of the present invention may be an option for the bonus and base game embodiments disclosed above in connection with the player-selectable awards.

The game provides the regeneration method to the player according to a predefined or varying probability stored in the memory device 40. Since the regeneration method maintains the order of magnitude of the player's award and may result in a higher or lower award, this method is generated relatively often. The game can alternatively predefine this option to result from the occurrence of some game event, such as a particular combination of slot symbols, face cards or other event.

The regeneration option enables the player to obtain a completely new set of digits, i.e., the new award is not constrained to have the same numbers as the old award. The regeneration in one embodiment includes randomly picking a number from zero to nine for each of the positions 118 ,120 and 122, wherein each number has an equal chance of generation. This option can be favorable for the player who has an original award with low numbered digits or a detriment to the player with a high original award.

In the screen 180 of FIG. 10, when the player 114 selects the modify input 164, the game displays a suitable symbol or message 182 indicating that the regeneration modification method has been generated. The game thereafter regenerates the original award and forms a new award of 256. The new award is in one embodiment immediately downloaded to the paid display 138. In an alternative embodiment, the regeneration modification method may be adapted to provide multiple regeneration opportunities. In a further alternative embodiment, the game may be adapted to repeat the entire option processes a predetermined number of times.

In another alternative embodiment, gaming device 10 automatically and randomly regenerates the player's award. Gaming device 10, for example, may be adapted to randomly regenerate the player's award on average once every ten games. Further alternatively, gaming device 10 may be adapted to regenerate the player's award whenever the award falls below a predefined threshold.

Figure 11:
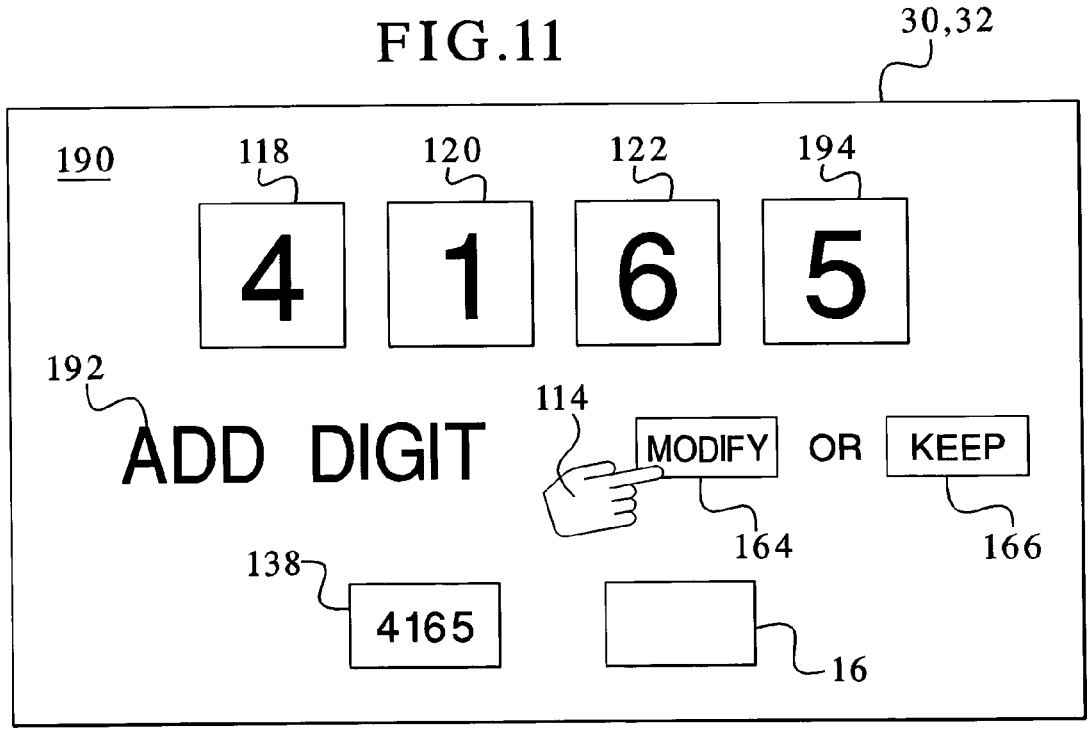
FIG. 11 is a front elevation view of one of the display devices illustrating the add digit modification method of the present invention.

Referring now to FIG. 11, a screen 190 displays the add digit modification option method of the present invention, wherein one of the display devices 30 or 32 displays the award of 416 in the digit positions or places 118 through 122. It should be appreciated that the add digit option of the present invention may be an option for the bonus and base game embodiments disclosed above in connection with the player-selectable awards.

The game provides the add digit method to the player according to a predefined or varying probability stored in the memory device 40. Since the add digit method changes the order of magnitude of the player's award (i.e., the number of digits in the award) and can only increase the original award, this method is infrequently generated. The game can alternatively predefine this option to result from the occurrence of some game event, such as a particular combination of slot symbols, face cards or other event.

The add digit method enables the player to obtain an extra digit, i.e., the new award has the same numbers in the same order as the old award, plus the new award has an extra digit. The add digit method in one embodiment includes randomly picking either the number zero or five and appending it to the right end or one's digit of the original award. The add digit method may be adapted to generate and add any number, zero to nine, in any one of the one's, ten's, hundred's or thousand's digits. The additional number generated obviously has less significance as it is placed in lower digits. It can be seen that this option is highly desirable for the player regardless of the size of the original award.

In another alternative embodiment, gaming device 10 automatically and randomly (as opposed to an option) adds a digit to the player's award. Gaming device 10, for example, may be adapted to add a digit upon the player's placement of a masked number 116 (FIGS. 3A and 3B) or selection of a digit, e.g., digits 118 through 122 (FIGS. 3C and 3D).

In the screen 190 of FIG. 11, when the player 114 selects the modify input 164, the game displays a suitable symbol or message 192 indicating that the add digit modification method has been generated. The game thereafter adds a number (here, either a zero or five) to a digit (here, the one's digit). The game randomly generates the number five and displays it in the new position or digit 194 to form a new award of 4165. The new award is in one embodiment immediately downloaded to the paid display 138. In an alternative embodiment, the game may be adapted to repeat the entire option processes a predetermined number of times.

Figure 12:
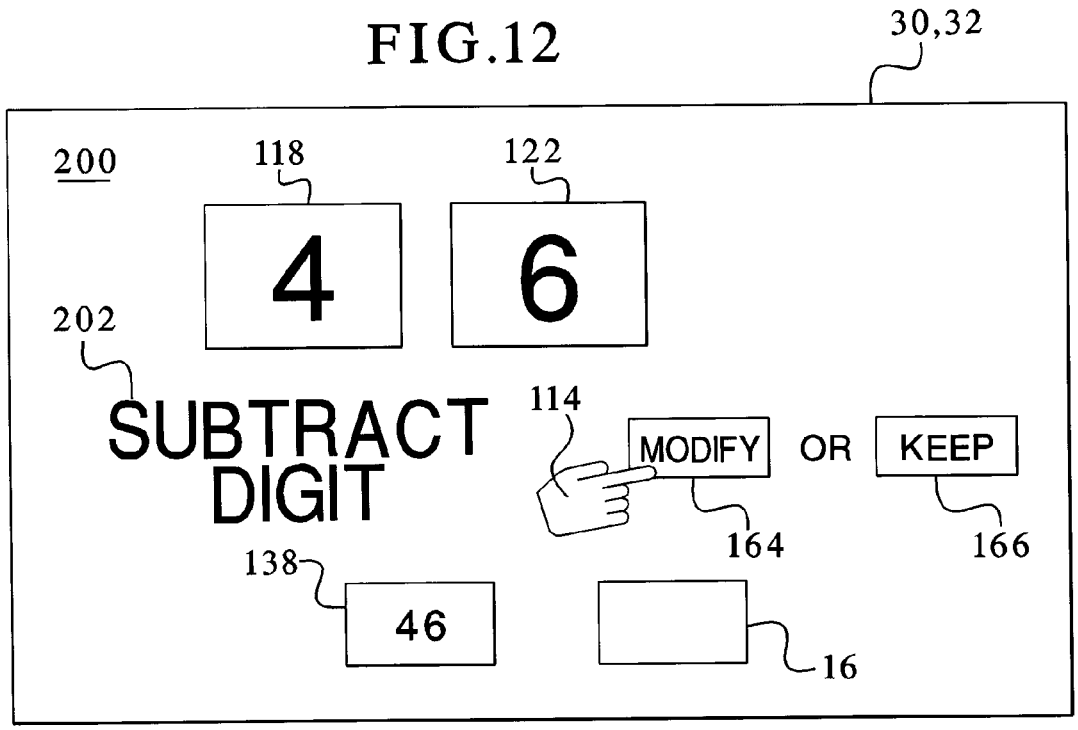
FIG. 12 is a front elevation view of one of the display devices illustrating the subtract digit modification method of the present invention.

Referring now to FIG. 12, a screen 200 displays the subtract digit modification option method of the present invention, wherein one of the display devices 30 or 32 displays the award of 416 in the digit positions or places 118 through 122. It should be appreciated that the subtract digit option of the present invention may be an option for the bonus and base game embodiments disclosed above in connection with the player-selectable awards.

The game provides the subtract digit method to the player according to a predefined or varying probability stored in the memory device 40. Since the subtract digit method changes the order of magnitude of the player's award (i.e., the number of digits in the award) and can only decrease the original award, this method is infrequently generated. The game can alternatively predefine this option to result from the occurrence of some game event, such as a particular combination of slot symbols, face cards or other event.

The subtract digit method removes a digit from the player's original award, e.g., the new award has two out of the three original numbers in the same order as the old award. The subtract digit method in one embodiment includes eliminating the lowest number from the original award. The subtract digit method may however be adapted to randomly eliminate any number from the original award. The actual number eliminated has less significance than the fact that the player's award is losing an order of magnitude. It can be seen that this option is highly undesirable for the player.

In the screen 200 of FIG. 12, when the player 114 selects the modify input 164, the game displays a suitable symbol or message 202 indicating that the subtract digit modification method has been generated. The game thereafter subtracts a number (here, the lowest number). The game eliminates the number one displayed by the former position 120 (FIG. 8) and displays the new award of 46, which is the combination of the numbers displayed by the remaining positions 118 and 122. The new award is in one embodiment immediately downloaded to the paid display 138. In an alternative embodiment, the game may be adapted to repeat the entire option processes a predetermined number of times.

In another alternative embodiment, gaming device 10 automatically and randomly (as opposed to an option) subtracts a digit from the player's award. Gaming device 10, for example, may be adapted to subtract a digit upon the player's placement of a masked number 116 (FIGS. 3A and 3B) or selection of a digit, e.g., digits 118 through 122 (FIGS. 3C and 3D).

Figure 13:
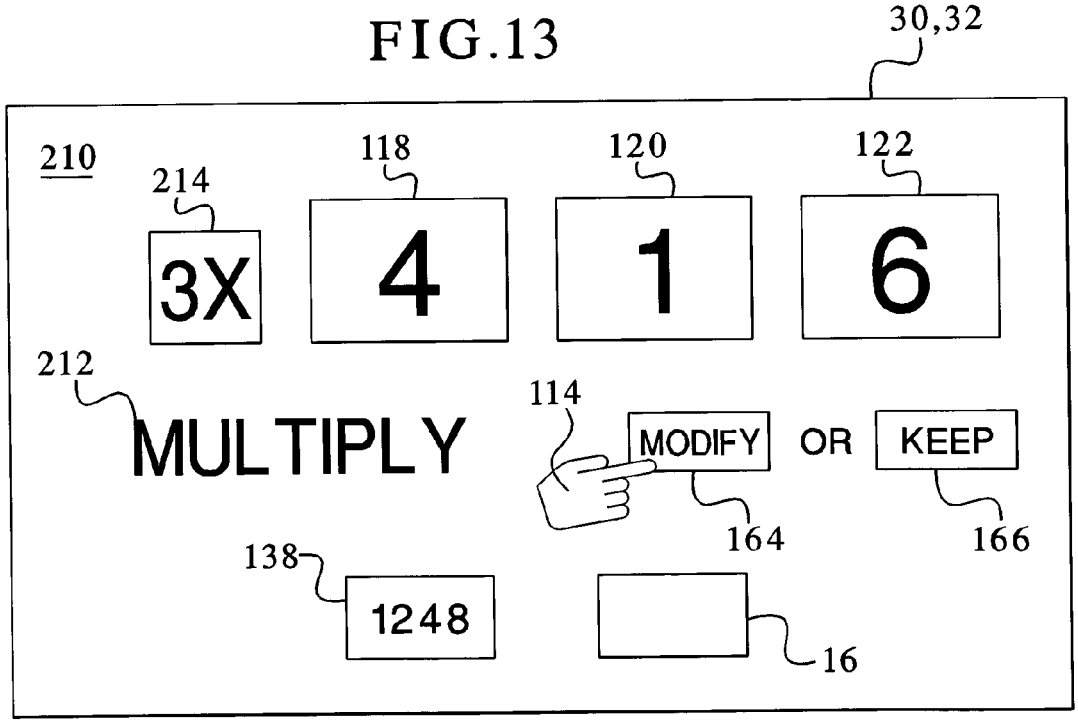
FIG. 13 is a front elevation view of one of the display devices illustrating the multiply modification method of the present invention.

Referring now to FIG. 13, a screen 210 displays the multiply modification option of the present invention, wherein one of the display devices 30 or 32 displays the award of 416 in the digit positions or places 118 through 122. It should be appreciated that the multiply option of the present invention may be an option for the bonus and base game embodiments disclosed above in connection with the player-selectable awards.

The game provides the multiply method to the player according to a predefined or varying probability stored in the memory device 40. Since the multiply method may change the order of magnitude of the player's award and can only increase the original award, this method is intermediately generated. The game can alternatively predefine this option to result from the occurrence of some game event, such as a particular combination of slot symbols, face cards or other event.

The multiply method generates a multiplier and multiplies this number by the player's original award to form a new award. The multiply method in one embodiment includes randomly generating either a 2× or a 3× multiplier. The multiply method may however be adapted to randomly generate any multiplier from a weighted or non-weighted table of multipliers. It can be seen that this option is desirable for the player.

In the screen 202 of FIG. 13, when the player 114 selects the modify input 164, the game displays a suitable symbol or message 212 indicating that the multiply modification method has been generated. The game thereafter generates a multiplier (here, a 2× or 3× multiplier), and thereby multiplies the original award. The game generates a 3× multiplier 214 and multiplies the original award of 416 by three. The result of 1248 is displayed by and downloaded to the paid display 138. In an alternative embodiment, the game may be adapted to display the product in another area of the screen 210, not download the result to the paid display 138 and repeat the entire option processes a predetermined number of times.

In another alternative embodiment, gaming device 10 automatically and randomly (as opposed to an option) multiplies the player's award. Gaming device 10, for example, may be adapted to multiply the player's award upon the placement of a masked number 116 (FIGS. 3A and 3B) or selection of a digit, e.g., digits 118 through 122 (FIGS. 3C and 3D). In such a case, the player places an additional masked number 116 or reselects a digit, so as not to replace a digit or order of magnitude of the award with a multiplier.

Mechanical Digit Display

Referring now to FIGS. 14A to 14D, an alternative embodiment of the present invention includes a mechanical display in one embodiment mounted in a top box or top part of the gaming machine. In one embodiment, the mechanical display 300 is used to display the generated numbers, digits, or other characters, symbols or indicia. In one embodiment, the mechanical display 300 is in the shape of a wheel having a plurality of sections which in one embodiment includes the numbers 0 to 9. The wheel is adapted to rotate or spin and stop at a position wherein an indicator indicates one of the numbers on the wheel. It should be appreciated that any suitable mechanical device can be used in accordance with the present invention to display the numbers or other symbols or indicia.

Figure 14A:
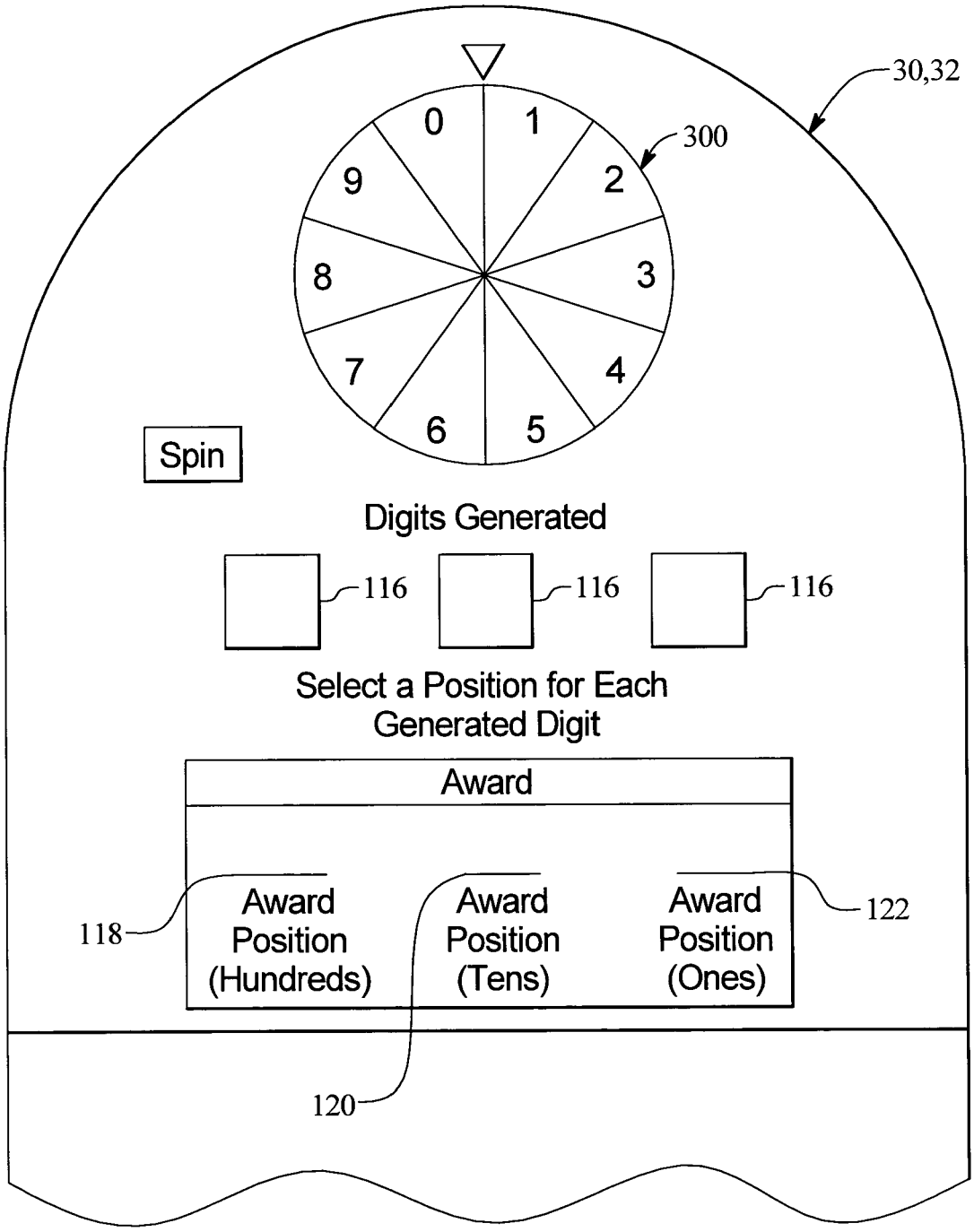
FIGS. 14A, 14B, 14C and 14D are front elevation views of one of the display devices illustrating the number or digit display of the present invention, wherein the digits displayed by the digit display are ordered by the player for an award.

The symbol generated by the gaming machine and displayed to the player is available for placement in one of the digit positions of the award value selected by the player. In a three-digit award, as illustrated in FIG. 14A, the digit positions 118 to 122 include the one's 122, ten's 120, or hundred's place 118 forming an award with a value having a range of 0 to 999.

In one embodiment where numbers 116 are displayed to the player and not masked, it should be appreciated that the player must adopt a strategy for digit placement. Consequently, it is desirable for the player that the numbers initially generated are as high as possible, allowing the player to use the higher number in the more significant positions of a three-digit award, having a higher order of magnitude such as the hundred's or the ten's place. Hence, if the gaming device generates the number "9", the player will choose to place the "9" in the hundred's place of a three-digit award to maximize the effect of the higher number on the award value. Likewise, if the gaming device generates the number "0", the player will choose to place the "0" in the ones place 122 to minimize the effect of a lower number. It follows, then, that the player's choice of position becomes more difficult when a number such as "4" or "5" is generated, especially if the hundred's or ten's places remain unfilled.

In an alternative embodiment, the player must select the digit position of the award value before spinning the wheel. Upon selection of the digit position, the gaming device will generate and display one of the numbers on the mechanical display, and the number will be placed in the digit position selected by the player. Alternatively, the gaming device generates and displays more than one number on the mechanical display to be placed in the selected digit position, giving the player a choice or second chance of obtaining a higher award.

Figure 14B:
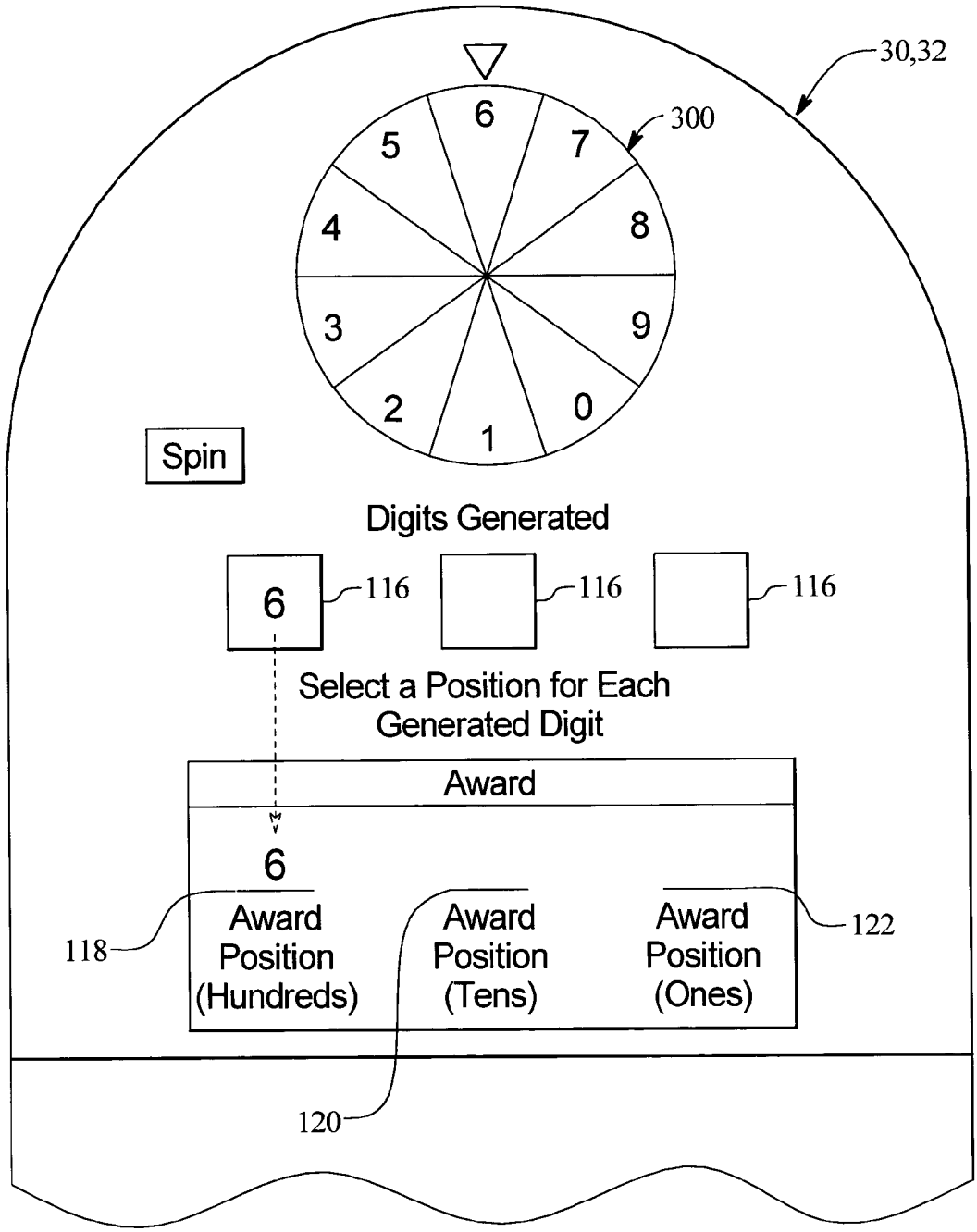

In the example illustrated in FIG. 14B, the gaming machine randomly generates and indicates a "6" on the wheel 300. Once the number has been displayed to the player and before the next number is generated, the game preferably provides a visual, audio or audio-visual message informing the player to select one of the digit positions 118 ,120 or 122 in the award value to place the number. FIG. 14B shows the player to have selected the hundred's position 118 of the award value to place the "6". The player can reason that, because the range of award values for a three-digit award is between 0 and 999 and the median award value is approximately 500, by placing the "6" in the hundreds position, the worst award value that will be achieved is six hundred (if two "0"s are generated for the remaining two award positions)—a value greater than the median award value of 500. Also, in an embodiment where each of the numbers have an equal probability of being selected, the chance that a number greater than "6" will be generated in the remaining number generations is less than the chance that a number less than "6" will be generated.

Figure 14C:
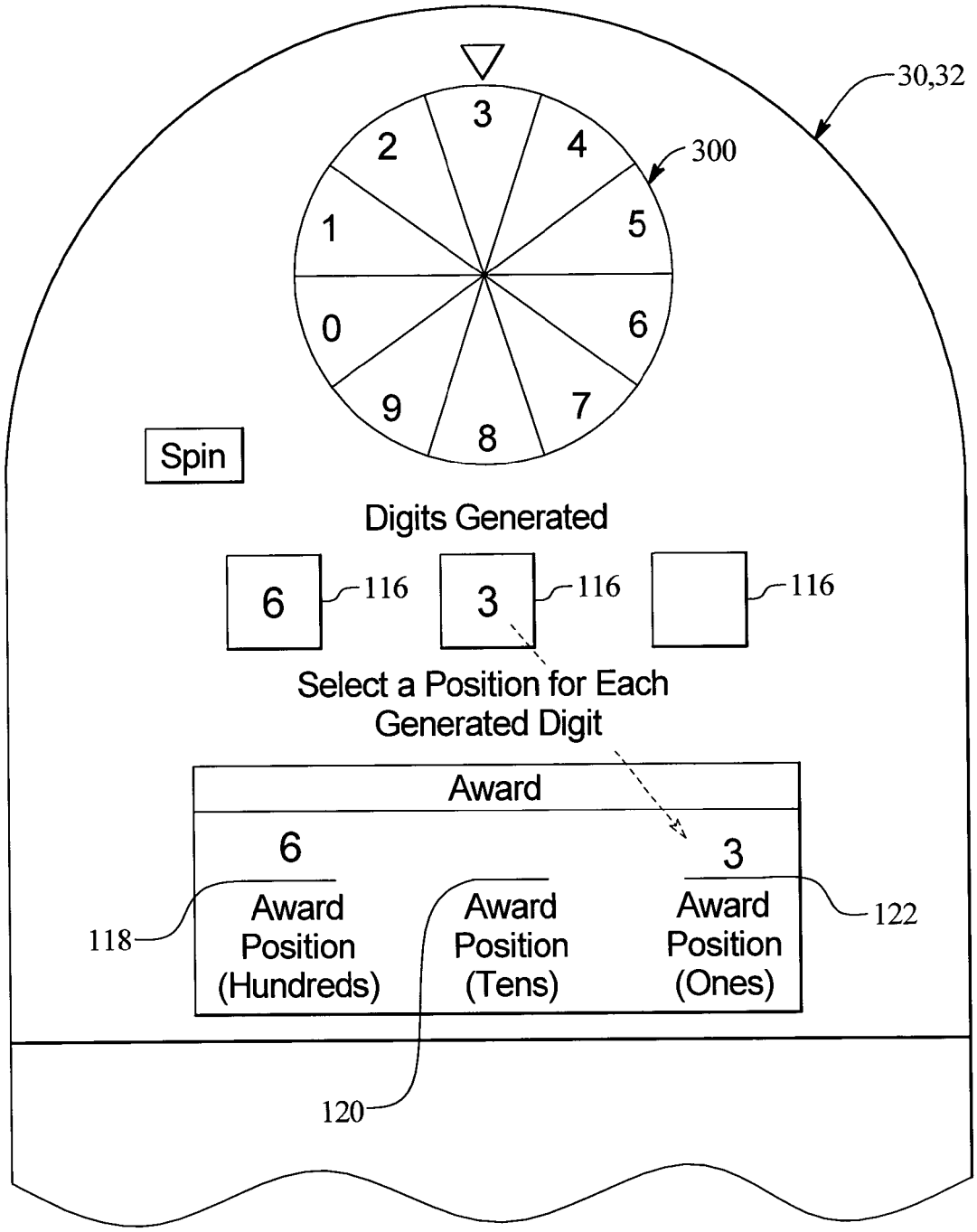

The gaming device in FIG. 14C generates the number "3" displayed by the wheel. The decision by the player to put the "3" in the one's position 122 is based on the greater likelihood that a higher number will be generated in the remaining generation.

Figure 14D:
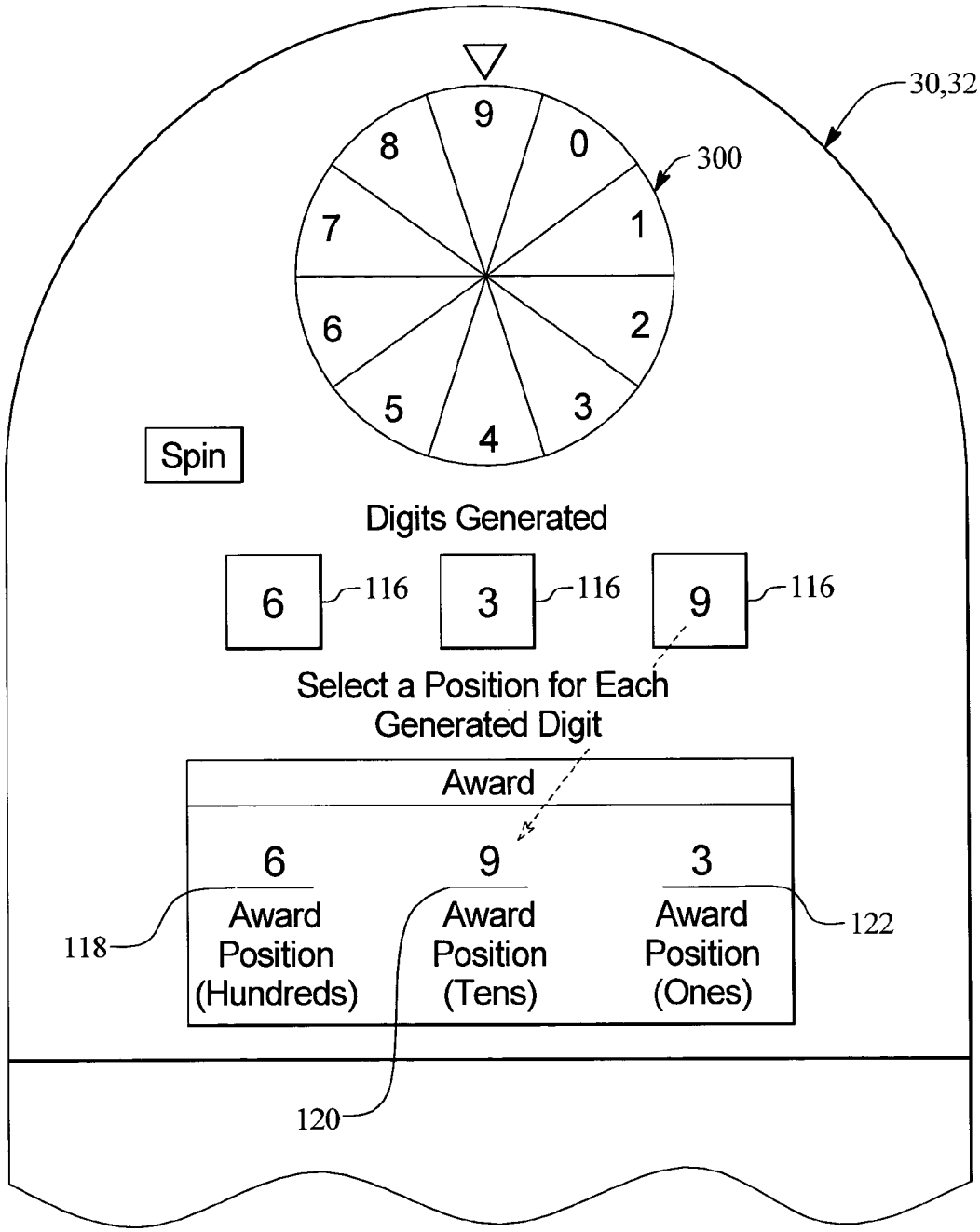

In FIG. 14D, the gaming device generates and displays a "9" which, in one embodiment, must be placed in the only remaining position, the ten's place 120. The resulting award value, then, is 693. Alternatively, the gaming machine may allow the player an additional number of generations (i.e., spins of the wheel display) to fill the remaining award position.

The possible award values in the illustrated example for the three generated numbers 6, 3 and 9, are 369, 396, 639, 693, 936, and 963. Although the player chooses the order in which the numbers are positioned in the award value as the numbers are generated, it should be appreciated that the order in which the numbers are generated by the gaming device affects the likelihood of achieving an award of higher value. For example, if the "9" had appeared first in the sequence of generations, the player would have likely chosen the hundred's position for the "9" and achieved a higher award. In one embodiment, the order in which the numbers are generated by the gaming device is based on a probability associated with each of the numbers. Alternatively, the frequency with which a number is generated may be based on a probability.

Figure 15A:
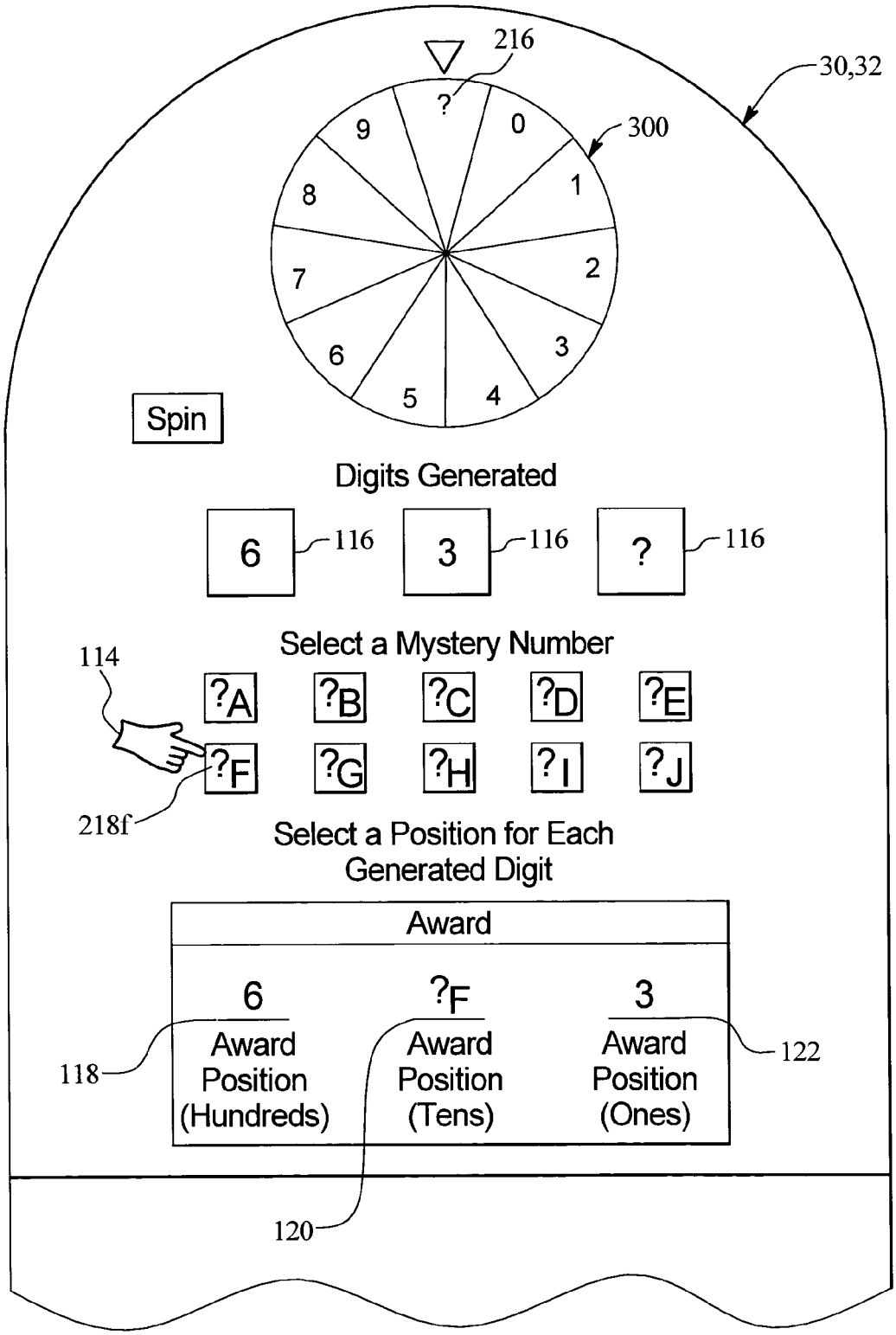
FIGS. 15A and 15B are front elevation views of one of the display devices illustrating the number or digit display of the present invention, wherein the displayed digits and a group of masked digits selected by the player are arranged by the player in for an award.
Figure 15B:
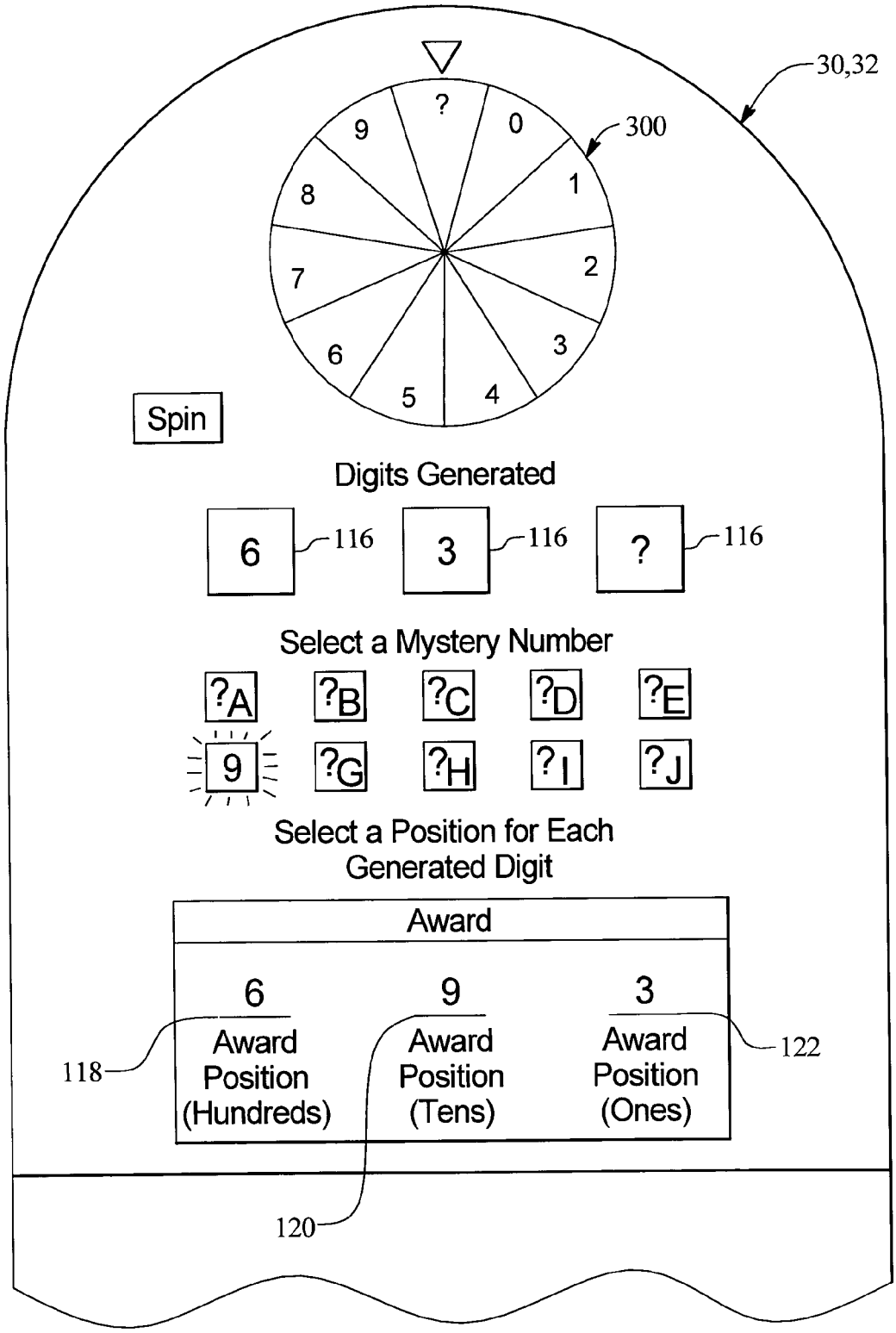
Figure 16:
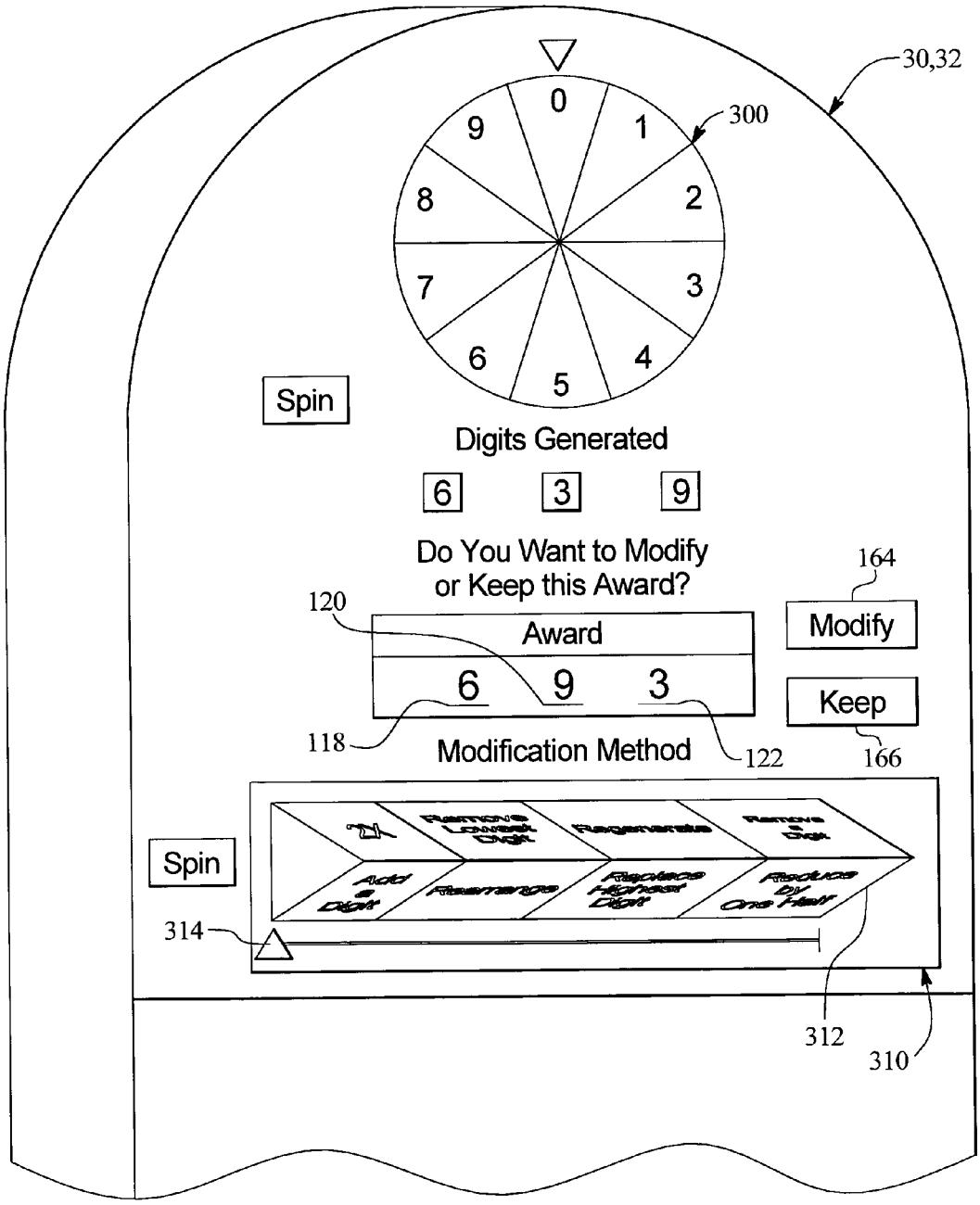
FIG. 16 is a front perspective view of one of the display devices illustrating a rotating prism-shaped award modification display of one embodiment of the present invention, wherein the gaming device enables the player to decide whether to keep or modify a generated award and the gaming device randomly generates one of a plurality of award modification methods to be applied to the award if the player decides to modify the award.

Referring now to FIGS. 15A and 15B, in an alternative embodiment, the mechanical display includes at least one symbol 216 indicating a selection of a masked number from a plurality of masked numbers 218*a* to *j*. If the symbol is generated by the display wheel, the gaming device enables the player to make a single selection from the set of masked numbers 218*a* to *j*. Upon the selection of one of the masked numbers 218*f* by the player, in one embodiment, the number is revealed to the player. The player then determines the place of the selected number among the digit positions 118 to 122 of the award value. Alternatively, as illustrated in FIGS. 15A and 15B, the player determines the position of the masked number 218*f* in the digit positions 118 to 122 of the award value before the number is revealed to the player. In this embodiment, the game can reveal the mystery number 218*f* after the player has selected a digit position 118 to 122 or, alternatively, when the remaining digit positions 118 to 122 are filled. In one embodiment, once the player has placed the generated numbers 116 in all of the digit positions 118 to 122 of the award value to create an original award, an option process illustrated in FIG. 16 is initiated. The option process includes an opportunity for a player to determine whether to keep or modify the original award.

Award Modification Display

Referring now to FIGS. 16 to 28, if a player elects to keep the original award by selecting the keep input 166, the game provides the award to the player. If the player, however, elects to modify the award by selecting the modify input 164, the game in one embodiment generates one of a plurality of different modification methods. In one embodiment of the present invention, the game also employs a mechanical award modification display to display a suitable symbol or message 172 indicating the generated modification method. The game uses the generated modification method to modify the original award and forms a new award.

FIG. 16 illustrates one embodiment of the present invention in which the gaming device 10 provides award modification as an option and employs a mechanical award modification display to display the generated modification methods. As illustrated in FIG. 16, in one embodiment, the award modification display 310 includes a three-sided elongated prism-shaped modification method display 312 and a modifier method indicator 314. In this embodiment, the modification methods are distributed among the three sides of the prism-shaped display. In one embodiment, the prism-shaped display 312 is adapted to rotate along a substantially horizontal rotational axis and adapted to stop to reveal one side of the prism and to display a plurality of different modification methods.

The modifier method indicator 314 is adapted to move simultaneously or sequentially with the rotating prism-shaped display 312. The modifier indicator 314 translates along the length of the prism-shaped display 312. After a predetermined or random duration of time or extent of movement of the display components, the prism-shaped display 312 and the modifier method indicator 314 stop either simultaneously or sequentially to designate the generated modification method to be applied to the player's award. It should be appreciated that any suitable alternative mechanical display devices can be employed to display the award modification methods in accordance with the present invention.

The methods are preferably distributed so that methods that increase and methods that decrease the award appear on the same side of the prism-shaped display 312. This will increase the level of excitement of the player as the modifier indicator 314 moves to select one of the methods. The pending U.S. patent application Ser. No. 10/243,050 assigned to the assignee of the application and entitled, Gaming Device With Rotating Display and Indicator Therefore filed on Sep. 12, 2002, describes certain aspects of the rotating prism display and translating modifier indicator of this embodiment and is hereby incorporated herein by reference.

In a further alternative embodiment, the game may be adapted to repeat the entire option process a predetermined number of times. In one embodiment, the player may be given the option to modify the award after the generation of the modification method by the game. Alternatively, the player may be given a second or further chance to decide whether to modify or keep the modified award.

In FIG. 16, after placing generated numbers 116 in the digit positions 118 to 122 and revealing the corresponding award, here 693, the game provides an opportunity or option to the player to change or keep the award. This option may be randomly generated and presented to the player throughout the game from time to time or, in one embodiment, after each original award generation.

One embodiment of the present invention includes award modification methods in addition to those discussed above. The additional award modification methods include: (i) a replacement of the lowest digit; (ii) a replacement of the highest digit; (iii) a removal of the lowest digit; (iv) a removal of the highest digit; (v) a decrease of the award by a fraction of its original value; (vi) an addition of an amount to at least one of the digit positions; (vii) a subtraction of an amount from at least one of the digit positions; (viii) a rearrangement to produce the lowest possible value; (ix) a rearrangement to produce the highest possible value; (x) a replacement of the digits with the lowest value digit; and (xi) a replacement of the digits with the highest value digit. It should be appreciated that the additional methods can be included in the embodiments discussed above and may be an option made available to the player for the bonus and base game embodiments disclosed above in connection with the player-selectable awards. The modifications may also be an option for any award generated via a gaming device and are not limited to the player-selectable awards as herein described.

Figure 17:
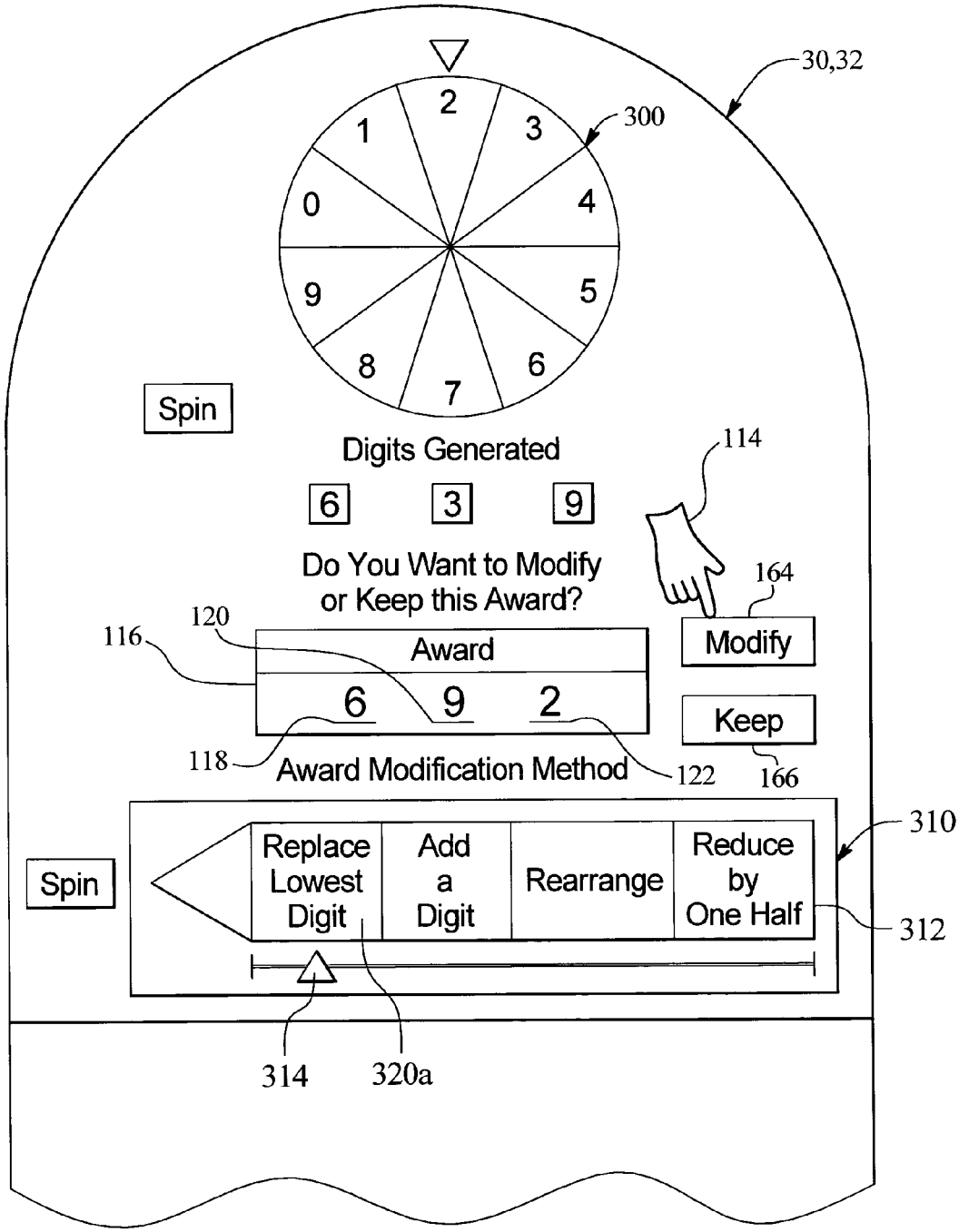
FIG. 17 is a front elevation view of one of the display devices illustrating the replace lowest digit modification method of the present invention.

Referring now to FIG. 17, the mechanical award modification display device 310 displays the replace lowest digit modification method of the present invention, wherein the original award of 693 displayed in the digit positions or places 118 through 122 on one of the display devices 30 or 32 is modified. It should be appreciated that the replace lowest digit option of the present invention may be an option for the bonus and base game embodiments disclosed above in connection with the player-selectable awards.

In one embodiment, the game provides the replace lowest digit method 320*a* to the player according to a predefined or varying probability stored in the memory device 40. Since the replace lowest digit method 320*a* does not change the order of magnitude of the player's award (i.e., the number of digits in the award) and can increase or decrease the original award, this method is, preferably, frequently generated. In an alternative embodiment, the game can predefine this option to result from the occurrence of some game event such as a particular combination of slot symbols, face cards or other event.

The replace lowest digit method 320*a* enables the player to exchange the lowest digit in the award for a potentially higher digit. The replace lowest digit method in one embodiment includes picking the digit of lowest value and replacing the lowest digit with any generated number, zero to nine, preferably in the place occupied by the lowest digit. Alternatively, the replace lowest digit modification method 320*a* may not retain the place of the lowest digit. Rather, the replace lowest digit modification may shift the remaining digits to accommodate the replacement of the lowest digit in other digit positions, e.g., in the one's, ten's, or hundred's place in a three-digit award.

In the display 30, 32 of FIG. 17, when the player 114 selects the modify input 164 and, the award modification display subsequently displays the generated modification method, the game displays a suitable symbol or message 192 indicating that the replace the lowest digit modification method 320*a* has been generated. The game, thereafter, replaces the lowest digit (here, the three in the one's place). In one embodiment, the game randomly generates and displays a number on the wheel 300 and in the digit position occupied by the lowest digit. In this example, the replace lowest digit method replaces the "3" with a "2" randomly generated by the mechanical wheel display 300. The replace lowest digit modification method reduced the award to 692. In illustrating that replacing the lowest digit in the original award may still result in a decrease of the award value an alternative embodiment, the game may be adapted to repeat or allow the player to repeat the generation of a modification method a predetermined number of times.

In another alternative embodiment, gaming device 10 automatically and randomly (as opposed to providing an option to the player) replaces the lowest digit of the player's award. Gaming device 10, for example, may be adapted to replace the lowest digit after the player has filled all of the digit positions 118 to 122 of the award.

Figure 18:
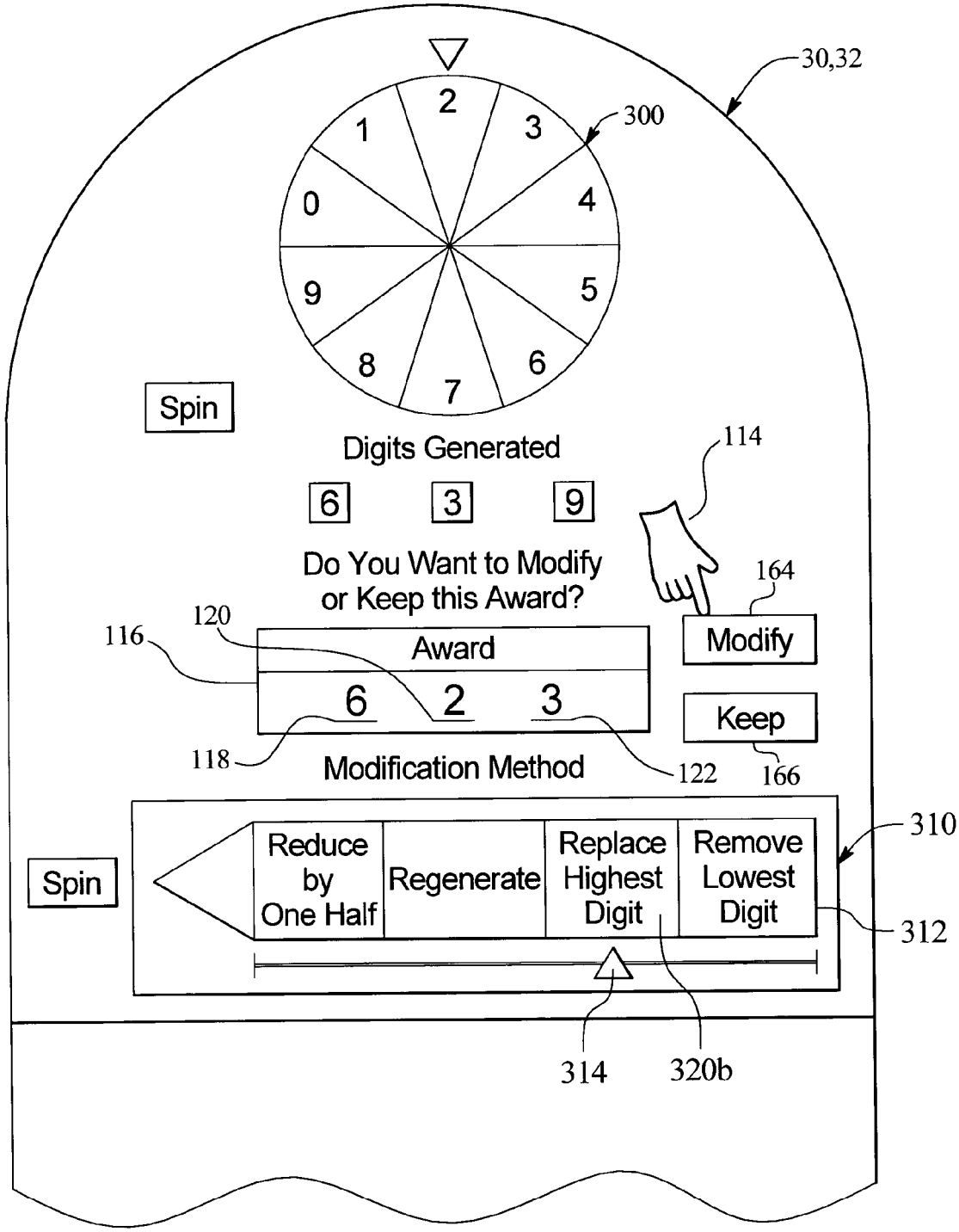
FIG. 18 is a front elevation view of one of the display devices illustrating the replace highest digit modification method of the present invention.

Referring now to FIG. 18, the mechanical award modification display device 310 displays the replace highest digit modification method 320*b* of the present invention, wherein the original award of 693 displayed in the digit positions 118 through 122 on one of display devices 30 or 32 is modified.

The game provides the replace highest digit method 320*b* to the player according to a predefined or varying probability stored in the memory device 40. Since the replace highest digit method 320*b* does not change the order of magnitude of the player's award (i.e., the number of digits in the award) and can increase or decrease the original award, this method is, preferably, frequently generated. The game can alternatively predefine this option to result from the occurrence of some game event such as a particular combination of slot symbols, face cards or other event.

The replace highest digit method 320*b* enables the player to exchange the highest digit in the award for a potentially larger digit. The replace highest digit method 320*b* in one embodiment includes picking the digit of highest value and replacing the highest digit with any generated number, zero to nine, preferably in the place occupied by the highest digit. Alternatively, the replace highest digit modification method 320*b* may not retain the place of the highest digit. Rather, the replace highest digit modification may shift the remaining digits to accommodate the replacement of the highest digit in the other digit positions, e.g., the one's, ten's, or hundred's place in a three-digit award.

In another alternative embodiment, gaming device 10 automatically and randomly (as opposed to an option) replaces the highest digit to the player's award. Gaming device 10, for example, may be adapted to replace the highest digit upon the player's filling of all the award places 116.

In the display 30, 32 of FIG. 18, when the player 114 selects the modify input 164 and the award modification display 310 subsequently displays the generated modification method, the game displays a suitable symbol or message 192 indicating that the replace the highest digit modification method 320*b* has been generated. The game thereafter replaces the highest digit (here, the "9" in the ten's place). The game randomly generates and displays on the wheel 300, or other suitable display mechanism, a number and displays it in the digit position occupied by the highest digit. In this example, the replace highest digit method 320*b* replaces the "9" with a "2" randomly generated and displayed by the mechanical wheel display 300 thereby, reducing the award to 623. In an alternative embodiment, the game may be adapted to repeat or allow the player to repeat the generation of a modification method a predetermined number of times.

In another alternative embodiment, gaming device 10 automatically and randomly (as opposed to providing an option to the player) replaces the highest digit of the player's award. Gaming device 10, for example, may be adapted to replace the highest digit after the player has filled all of the award positions 116.

Figure 19:
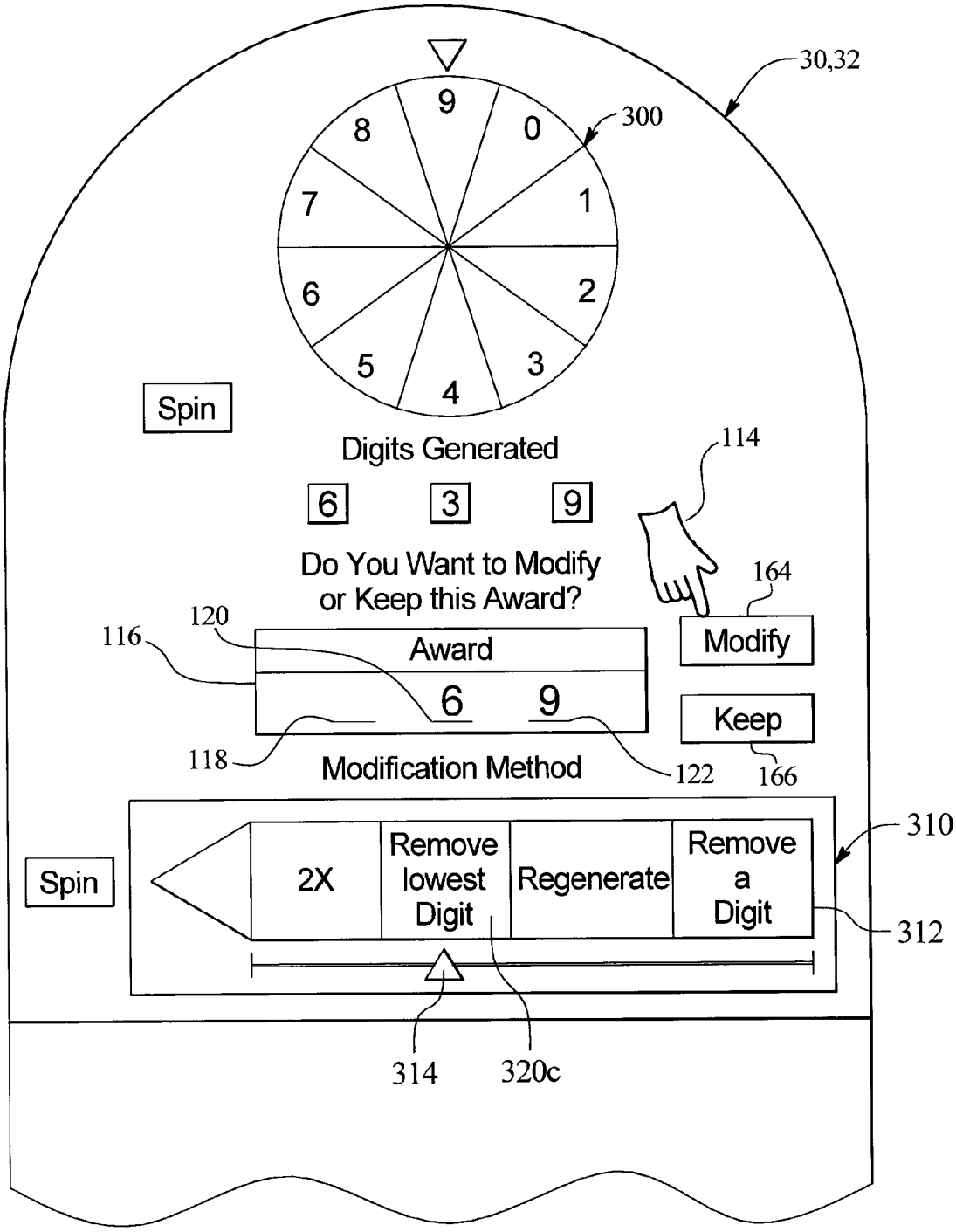
FIG. 19 is a front elevation view of one of the display devices illustrating the remove lowest digit modification method of the present invention.

Referring now to FIG. 19, an alternative display device displays the remove lowest digit modification method 320*c* of the present invention, wherein the original award of 693 displayed in the digit positions 118 through 122 on one of the display of devices 30 or 32 is modified. It should be appreciated that the remove lowest digit option 320*c* of the present invention may be an option for the bonus and base game embodiments disclosed above.

The game provides the remove lowest digit method 320*c* to the player according to a predefined or varying probability stored in the memory device 40. Since the remove lowest digit method 320*c* changes the order of magnitude of the player's award (i.e., the number of digits in the award) and will only decrease the original award, this method is, preferably, infrequently generated. The game can, alternatively, predefine this option to result from the occurrence of some game event such as a particular combination of slot symbols, face cards or other event.

The remove lowest digit method 320*c* selects the digit of lowest value and removes it from the player's original award decreasing the award by an order of magnitude, e.g., the new award has two out of the three original numbers in the same order as the original award. The actual number removed, whether it be the lowest or highest number, has less significance than the fact that the player's award is losing an order of magnitude. It can be seen that this option is highly undesirable for the player. In an alternative embodiment, a zero could be placed in the digit position of the removed digit to retain the order of magnitude of the award value.

In the display 30, 32 of FIG. 19, when the player 114 selects the modify input 164 and the award modification display 310 subsequently displays the generated modification method, the game displays a suitable symbol or message 192 indicating that the remove the lowest digit modification method has been generated. The game thereafter removes the lowest digit (here, the three from the one's place). The game shifts the digits in the hundred's 118 and ten's 120 places and displays them in the ten's 120 and one's places 122 to form a new award of 69. In an alternative embodiment, the game may be adapted to repeat the modification a predetermined number of times.

In another alternative embodiment, gaming device 10 automatically and randomly (as opposed to providing an option to the player) removes the lowest digit to the player's award. Gaming device 10, for example, may be adapted to remove the lowest digit upon the player's placement of a masked number in a digit position or selection of a digit position, e.g., digit positions 118 through 122.

Figure 20:
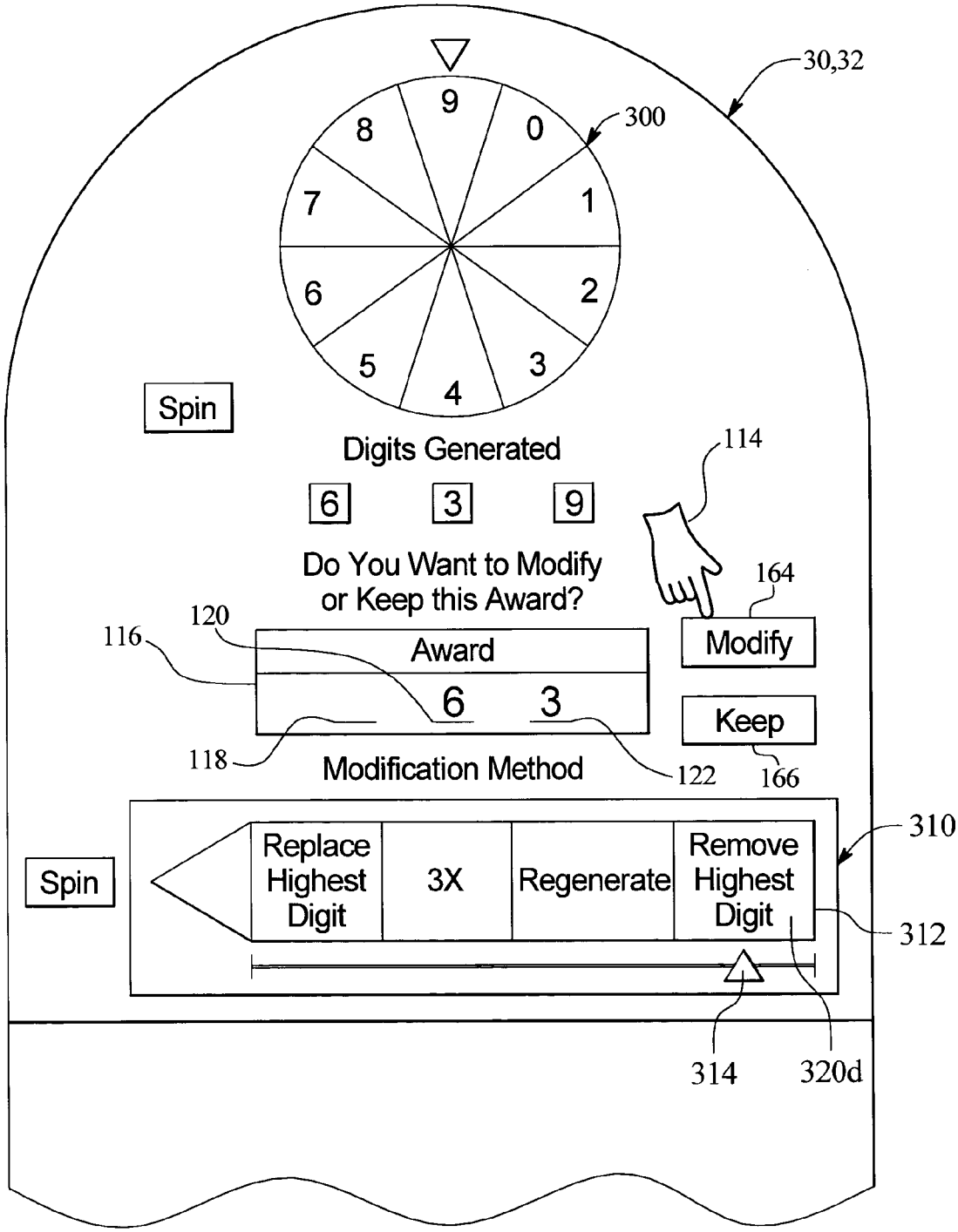
FIG. 20 is a front elevation view of one of the display devices illustrating the remove highest digit modification method of the present invention.

Referring now to FIG. 20, an alternative display device displays the remove highest digit modification method 320*d* of the present invention, wherein the original award of 693 displayed in the digit positions 118 through 122 on one of the display devices 30 or 32 is modified. It should be appreciated that the remove highest digit option 320*d* of the present invention may be an option for the bonus and base game embodiments disclosed above in connection with the player-selectable awards.

The game provides the remove highest digit method 320*d* to the player according to a predefined or varying probability stored in the memory device 40. Since the remove highest digit method 320*d* changes the order of magnitude of the player's award (i.e., the number of digits in the award) and only decreases the original award, this method is, preferably, infrequently generated. The game can, alternatively, predefine this option to result from the occurrence of some game event such as a particular combination of slot symbols, face cards or other event.

The remove highest digit method 320*d* removes the digit of highest value from the player's original award, e.g., the new award has two out of the three original numbers in the same order as the original award but shifted toward the one's place 122. The actual number removed, whether it be the lowest or highest number, has less significance than the fact that the player's award is losing an order of magnitude. It can be seen that this option is highly undesirable for the player. In an alternative embodiment, a zero could be placed in the digit position of the removed digit to retain the order of magnitude of the award value.

In the display 30, 32 of FIG. 20, when the player 114 selects the modify input 164 and the award modification display subsequently displays the generated modification method, the game displays a suitable symbol or message 192 indicating that the remove the highest digit modification method has been generated. The game thereafter removes the highest digit (here, the "9" in the ten's place). The game shifts the digit in the hundred's place 118 to the ten's place 120 to form a new award of 63. In an alternative embodiment, the game may be adapted to repeat the entire modification or modification generation process a predetermined number of times.

In another alternative embodiment, gaming device 10 automatically and randomly (as opposed to providing an option to the player) removes the highest digit to the player's award. Gaming device 10, for example, may be adapted to remove the highest digit upon the player's placement of a masked number 116 or selection of a digit, e.g., digit positions 118 through 122.

Figure 21:
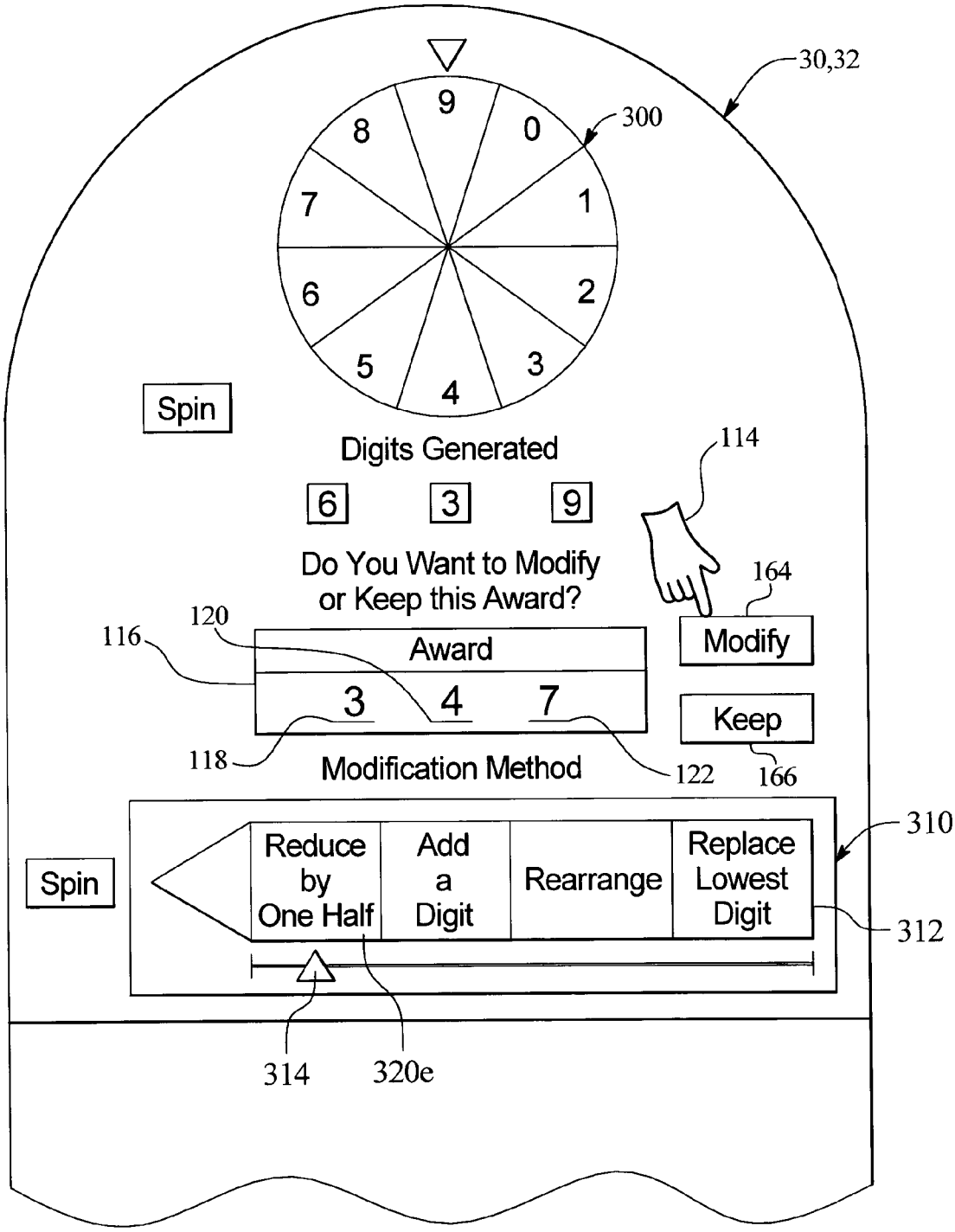
FIG. 21 is a front elevation view of one of the display devices illustrating the reduce by one-half modification method of the present invention.

Referring now to FIG. 21, the award modification display device 310 displays the reduce by one-half modification method 320*e* of the present invention, wherein the original award of 693 displayed in the digit positions or places 118 through 122 on one of the display devices 30 or 32 is modified. It should be appreciated that the reduce by a fractional amount option 320*e* of the present invention may be an option for the bonus and base game embodiments disclosed above.

The game provides the reduce by a fractional (or percentage) amount method 320*e* to the player according to a predefined or varying probability stored in the memory device 40. Since the reduce by a fractional amount method 320*e* can change the order of magnitude of the player's award (i.e., the number of digits in the award) and can only decrease the original award, this method is, preferably, infrequently generated. The game can, alternatively, predefine this option to result from the occurrence of some game event, such as a particular combination of slot symbols, face cards or other event.

The reduce by a fractional amount method 320*e* reduces the player's original award by a fraction of the value of the original award. It should be appreciated that this method can also be considered a variation of the multiply modification method 212 in which the original award value is multiplied by a fractional multiplier rather than a whole number. It can be seen that this option is undesirable for the player.

In the display 30, 32 of FIG. 21, when the player 114 selects the modify input 164 and the award modification display 310 subsequently displays the generated modification method, the game displays a suitable symbol or message indicating that the reduce by one-half modification method has been generated. The game divides the award of 693 by 2 and displays the new award of 347 (346.5 is rounded up to the nearest whole number). Alternatively, the award is divided by a number randomly generated and displayed on the mechanical digit display 300. In an alternative embodiment, the game may be adapted to repeat the entire modification or modification generation process a predetermined number of times.

In another alternative embodiment, gaming device 10 automatically and randomly (as opposed to providing an option to the player) reduces the player's award by a fraction (or percentage) of the original value. Gaming device 10, for example, may be adapted to reduce the award by one-half upon the player's placement of a masked number 116 or selection of a digit, e.g., digit positions 118 through 122.

Figure 23:
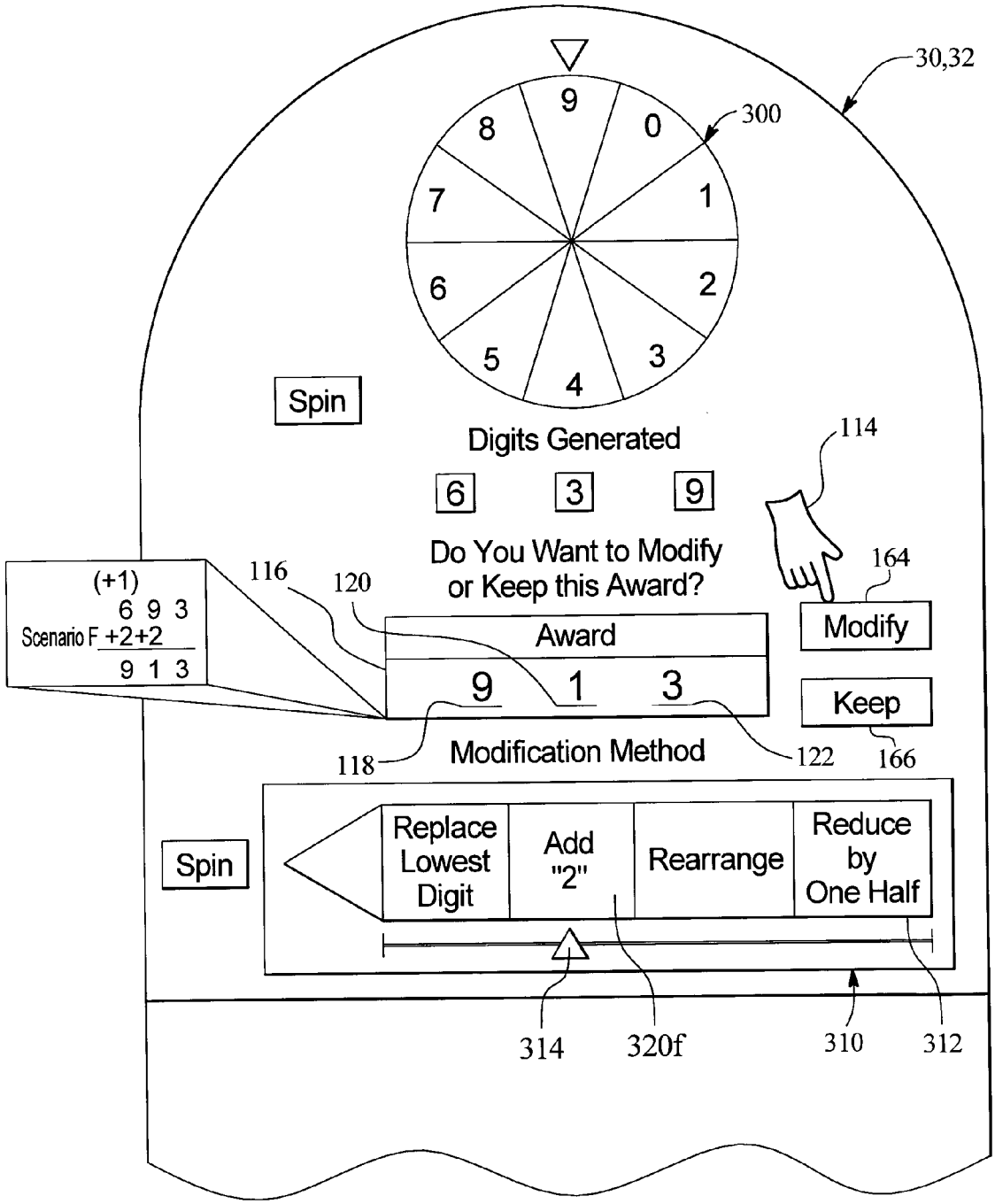
FIG. 23 is a front elevation view of one of the display devices illustrating the add "2"/carry over modification method of the present invention.
Figure 24:
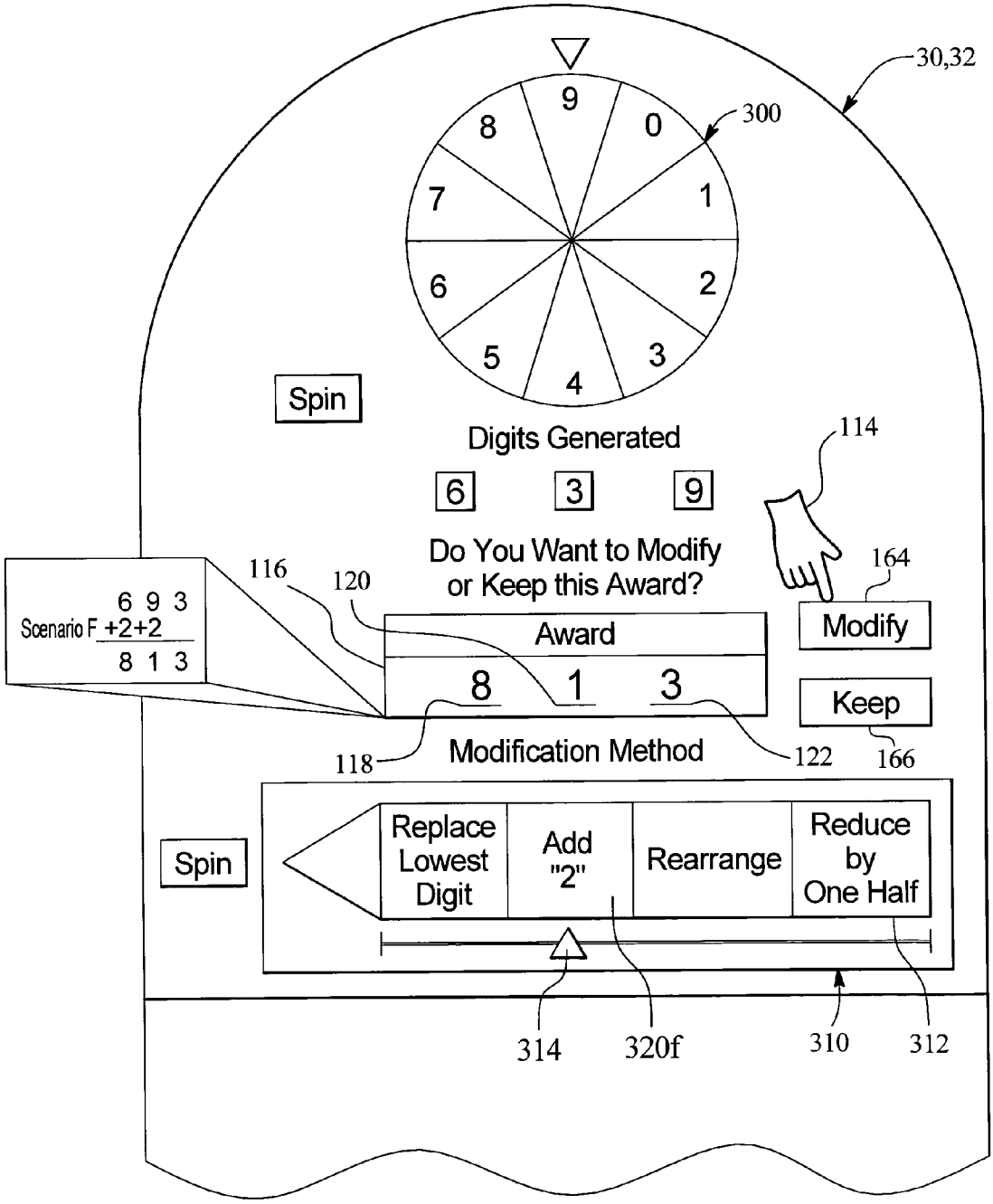
FIG. 24 is a front elevation view of one of the display devices illustrating the add "2"/no carry over modification method of the present invention.

Referring now to FIGS. 22 to 24, the mechanical award modification display device in FIGS. 23 and 24 displays the add amount method such as the add "2" modification method 320*f* of the present invention, wherein the original award of 693 displayed in the digit positions or places 118 through 122 on one of display devices 30 or 32 is modified. It should be appreciated that the add or subtract an amount options of the present invention may be an option for the bonus and base game embodiments disclosed above in connection with the player-selectable awards.

The game provides the add or subtract an amount methods 320*f* to the player according to a predefined or varying probability stored in the memory device 40. Since the add 2 method 320*f* changes the order of magnitude of the player's award (i.e., the number of digits in the award) in limited circumstances and, in a particular embodiment, either increase or decrease the original award, this method is, preferably, frequently generated. The game can alternatively, predefine this option to result from the occurrence of some game event, such as a particular combination of slot symbols, face cards or other event.

In one embodiment, the digit positions to be modified by the add or subtract an amount methods 320*f* are randomly selected based on a probability. FIG. 22 illustrates an example of the probabilities associated with each digit position or combination of digit positions in Scenarios A through G in the add "2" modification of a three-digit award. According to the probability table in FIG. 22, if the add "2" modification method 320*f* is selected by the gaming device, the likelihood that the digits in all three digit positions will each be increased by 2 is 30%. It can be determined from the table (by adding the probabilities associated with each combination where 2 is added to the hundred's place) that the likelihood of 2 being added to the hundred's place 118 is 80%. Likewise, the likelihood of 2 being added to the ten's place 120 is 65%, and to the one's place 122, 65%. Therefore, it can be seen that this option has a high probability of being significant for the player. It should be appreciated that such a probability table can be applied to the subtract an amount modification method.

As illustrated in FIGS. 23 and 24, the add an amount modification method 320*f*, adds 2 to at least one of the digits in the digit positions 118 to 122 of the award. Adding 2 to the hundred's place 118, for instance, increases the award by 200. Similarly, adding 2 to the ten's place 120 increases the award by 20, and by 2 if added to the digit in the one's place 122 for a maximum possible increase of 222. It should be appreciated that any number from 1 to 9, can be added to or subtracted from each of the digit positions of the award in this manner. In one embodiment, the amount or number added to each digit is randomly generated and displayed on the display device such as the mechanical wheel display in the present embodiment.

In the display 30, 32 of FIG. 23, when the player 114 selects the modify input 164 and the mechanical award modification display 310 subsequently displays the generated modification method, the game displays a suitable symbol or message indicating that the add "2" modification method 320*f* has been generated. In an embodiment, adding 2 to a digit of 8 or greater will allow a 1 to be "carried over" into the next highest digit position. For example, in FIG. 23, 2 is added to the ten's and the hundred's digit positions of the award value, 693 (Scenario F having a 20% probability in the example table of FIG. 22). Adding 2 to the 9 in the ten's place yields 11. Therefore, the 1 remains in the ten's place and the other 1 will be carried over into the hundred's place, increasing the 6 to a 7. Adding 2 to the 7 in the hundred's place yields 9 giving the player an award of 913. It should be appreciated that adding 2 to an 8 or 9 in the hundred's position 118 will carry a 1 over to the thousand's place to increase the magnitude of the award. Alternatively, the 1 is not carried over to the next highest digit position when 2 is added to an 8 or a 9. This leaves the player with a 0 in that digit position if the original number was 8 and a 1 in that digit position if the original number was 9 as illustrated in FIG. 24. Therefore, instead of carrying the 1 over to the hundred's position 118 as in FIG. 23 to generate an award of 913, the 1 is not carried over, and only a 2 is added to the original digit, 6. It should be understood that, in this embodiment, the add 2 method 320*f* could decrease rather than increase the award. In the example illustrated in FIGS. 23 and 24, if the add 2 method 32 of modifies the one's 122 and ten's positions 120 of the award of 693 (a 10% probability according to the example distribution illustrated in FIG. 22), the award will be reduced to 615 (9+2=11 with the 1 not being carried over to the hundred's position).

Alternatively, the 1 is not carried over to the next highest digit position when 2 is added to an 8 or a 9 as illustrated in FIG. 24. This leaves the player with a 0 in that digit position if the original number was 8 and a 1 in that digit position if the original number was 9. Therefore, instead of carrying the 1 over to the hundred's position 118 as in FIG. 23 to generate an award of 913, the 1 is not carried over, and only a 2 is added to the original digit, 6. It should be understood that, in this embodiment, the add 2 method 320*f* could decrease rather than increase the award. In the example illustrated in FIGS. 23 and 24, if the add 2 method 320*f* modifies the one's and ten's positions of the award of 693 (Scenario D having a 10% probability according to the example distribution illustrated in FIG. 22), the award will be reduced to 615 (9+2=11 with the 1 not being carried over to the hundred's position).

In the subtract an amount modification method (not illustrated), it should be appreciated that subtracting 2 from a 0 or 1 (equaling −2 or −1, respectively) will, in one embodiment, require "borrowing" from the next highest digit position to reduce the next highest digit position by 1 and increase the modified digit position by 10 before subtracting the amount from the modified digit position. For example if the tens place 120 of an original award of 603 is modified by this embodiment of the subtract 2 modification method the 6 in the next highest digit position to be reduced by 1 to 5, the 0 in the modified tens position 120 will be increased by 10 to 10, and the 2 will be subtracted from the 10 in the tens position 120 to yield an 8. The resulting award is, therefore, 583.

In an alternative embodiment, the 1 is not borrowed from the next highest digit position and the modified digit position retains the absolute value of the modification. For example, if a player has an original award of 603 and the subtract 2 modification method is generated and applied to the tens position 120 of the award, 2 is subtracted from 0 to yield −2. The absolute value of −2 is 2, and the modified award becomes 623 and no other digit position is decreased by a borrowed amount. In this embodiment of the subtract an amount modification method, the award can actually increase rather than decrease. It should be appreciated that other variations and combinations of the embodiments presented above are contemplated by the invention.

In an alternative embodiment, the game may be adapted to repeat the entire modification or modification generation process a predetermined number of times. In another alternative embodiment, gaming device 10 automatically and randomly (as opposed to an option) adds an amount to one or more digits of the original award. Gaming device 10, for example, may be adapted to add an amount to one or more digits of the original award upon the player's placement of a masked number 116 or selection of a digit, e.g., digit positions 118 through 122.

Figure 25:
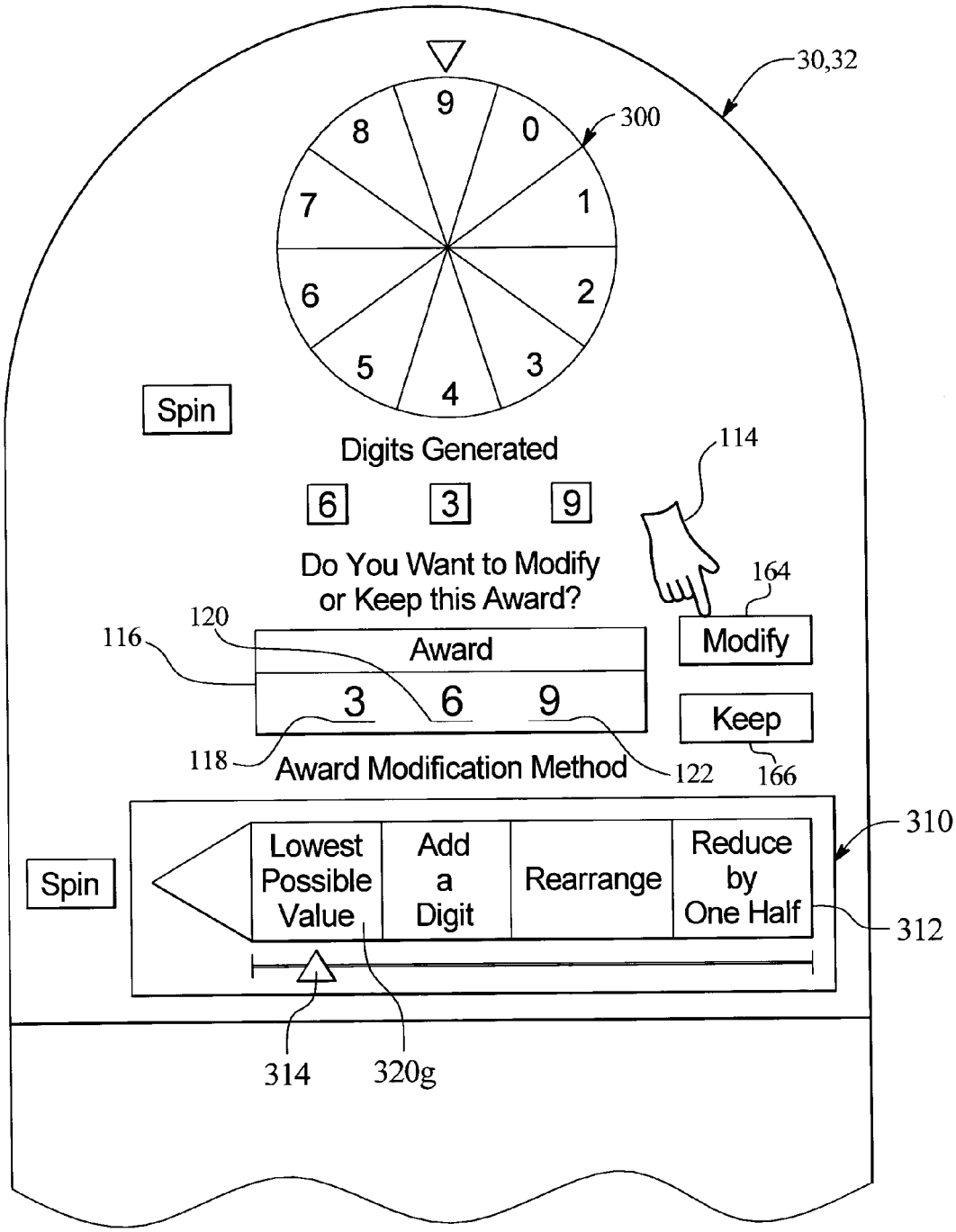
FIG. 25 is a front elevation view of one of the display devices illustrating the lowest possible value modification method of the present invention.

Referring now to FIG. 25, the mechanical award modification display device displays the lowest possible value method 320*g* of the present invention, wherein the original award of 693 displayed in the digit positions or places 118 through 122 on one of display devices 30 or 32 is modified. It should be appreciated that the lowest possible value option of the present invention may be an option for the bonus and base game embodiments disclosed above in connection with the player-selectable awards.

The game provides the lowest possible value method 320*g* to the player according to a predefined or varying probability stored in the memory device 40. Since the lowest possible value method 320*g* does not change the order of magnitude of the player's award (i.e., the number of digits in the award), this method can be relatively frequently generated. The game can alternatively, predefine this option to result from the occurrence of some game event, such as a particular combination of slot symbols, face cards or other event.

In one embodiment, illustrated in FIG. 25 the lowest possible value modification method 320*g*, creates the lowest possible value using the digits generated in the game by rearranging the digits in the digit positions. The digits with the lowest value are rearranged to the digit positions with the highest magnitude in an order which produces the lowest possible value.

In the display 30, 32 of FIG. 25, when the player 114 selects the modify input 164 and the mechanical award modification display 310 subsequently displays the generated modification method, the game displays a suitable symbol or message indicating that the lowest possible value modification method 320*g* has been generated. The lowest digit of the three numbers generated by the gaming device is the 3 which is rearranged to the digit position with the highest order of magnitude in the award value, the hundred's position 118. Likewise, the 6 is rearranged to the digit position with the next highest order of magnitude, the ten's position 120. The 9, as the highest value, is similarly rearranged to the digit position of the lowest order of magnitude, the one's position 122 to produce a final award value of 369, the lowest possible value able to be produced from the three generated digits. It should be appreciated that, in this embodiment, the lowest possible value method 320*g* would have no effect on an award value with the same digits in each digit position.

In an alternative embodiment, the game may be adapted to repeat the entire modification or modification generation process a predetermined number of times. In another alternative embodiment, gaming device 10 automatically and randomly (as opposed to an option) rearranges the digits of the original award to produce the lowest value. Gaming device 10, for example, may be adapted to rearrange the digits of the original award to produce the lowest value upon the player's placement of a masked number 116 in one of the digit positions 118 through 122 or upon the selection of a digit.

Figure 26:
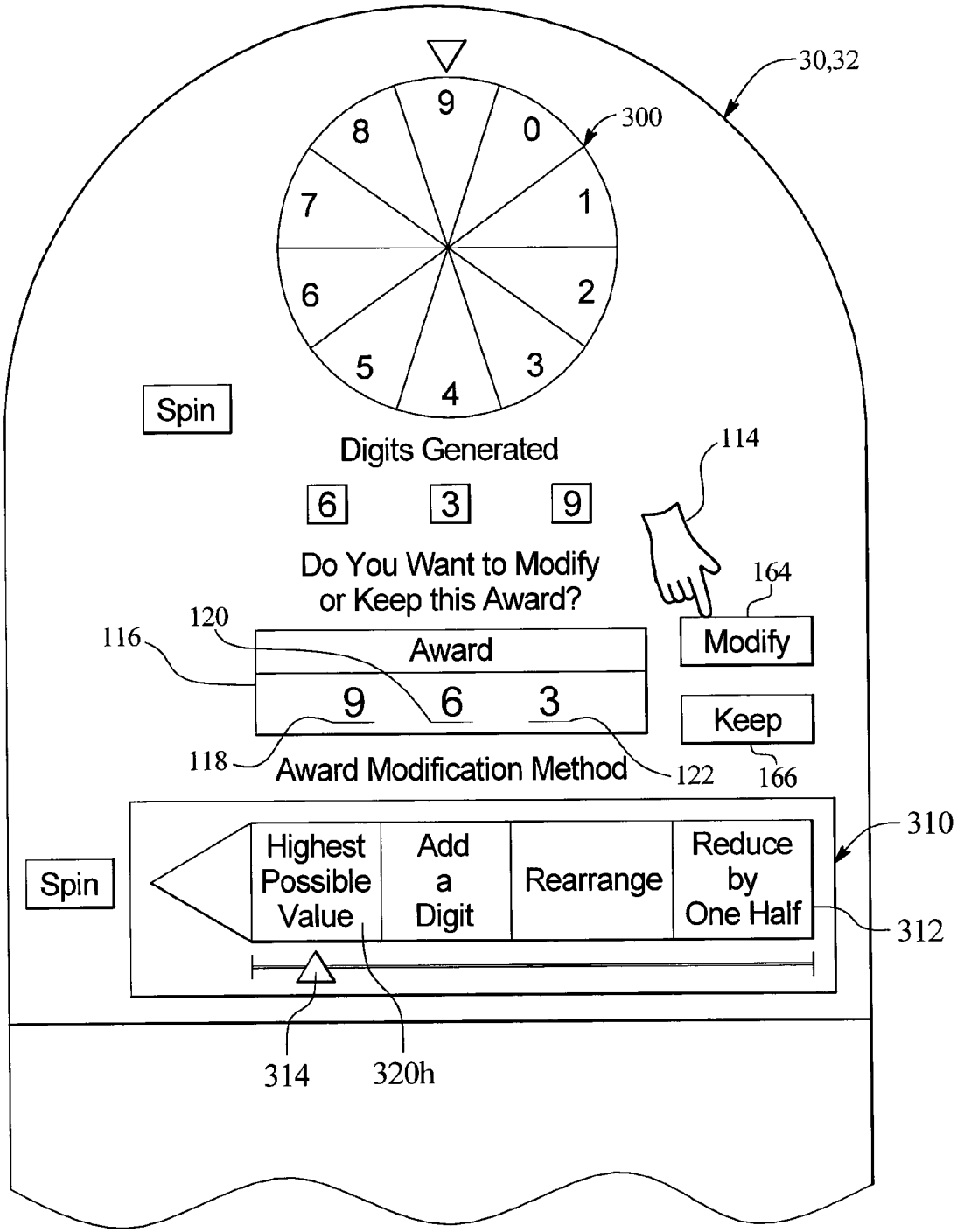
FIG. 26 is a front elevation view of one of the display devices illustrating the highest possible value modification method of the present invention.

Referring now to FIG. 26, the mechanical award modification display device displays the highest possible value method 320*h* of the present invention, wherein the original award of 693 displayed in the digit positions or places 118 through 122 on one of display devices 30 or 32 is modified. It should be appreciated that the highest possible value option of the present invention may be an option for the bonus and base game embodiments disclosed above in connection with the player-selectable awards.

The game provides the highest possible value method 320*h* to the player according to a predefined or varying probability stored in the memory device 40. Since the highest possible value method 320*h* does not change the order of magnitude of the player's award (i.e., the number of digits in the award), this method can be relatively frequently generated. The game can alternatively, predefine this option to result from the occurrence of some game event, such as a particular combination of slot symbols, face cards or other event.

In one embodiment, illustrated in FIG. 26 the highest possible value modification method 320*h*, creates the highest possible value using the digits generated in the game by rearranging the digits in the digit positions. The digits with the highest value are rearranged to the digit positions with the highest magnitude in an order which produces the highest possible value.

In the display 30, 32 of FIG. 26, when the player 114 selects the modify input 164 and the mechanical award modification display 310 subsequently displays the generated modification method, the game displays a suitable symbol or message indicating that the highest possible value modification method 320*h* has been generated. The highest digit of the three numbers generated by the gaming device is the 9 which is rearranged to the digit position with the highest order of magnitude in the award value, the hundred's position 118. Likewise, the 6 is rearranged to the digit position with the next highest order of magnitude, the ten's position 120. The 3, as the lowest value, is similarly rearranged to the digit position of the lowest order of magnitude, the one's position 122 to produce a final award value of 963, the highest possible value able to be produced from the three generated digits. It should be appreciated that, in this embodiment, the highest possible value method 320*h* would have no effect on an award value with the same digits in each digit position.

In an alternative embodiment, the game may be adapted to repeat the entire modification or modification generation process a predetermined number of times. In another alternative embodiment, gaming device 10 automatically and randomly (as opposed to an option) rearranges the digits of the original award to produce the highest value. Gaming device 10, for example, may be adapted to rearrange the digits of the original award to produce the highest value upon the player's placement of a masked number 116 in one of the digit positions 118 through 122 or upon the selection of a digit.

Figure 27:
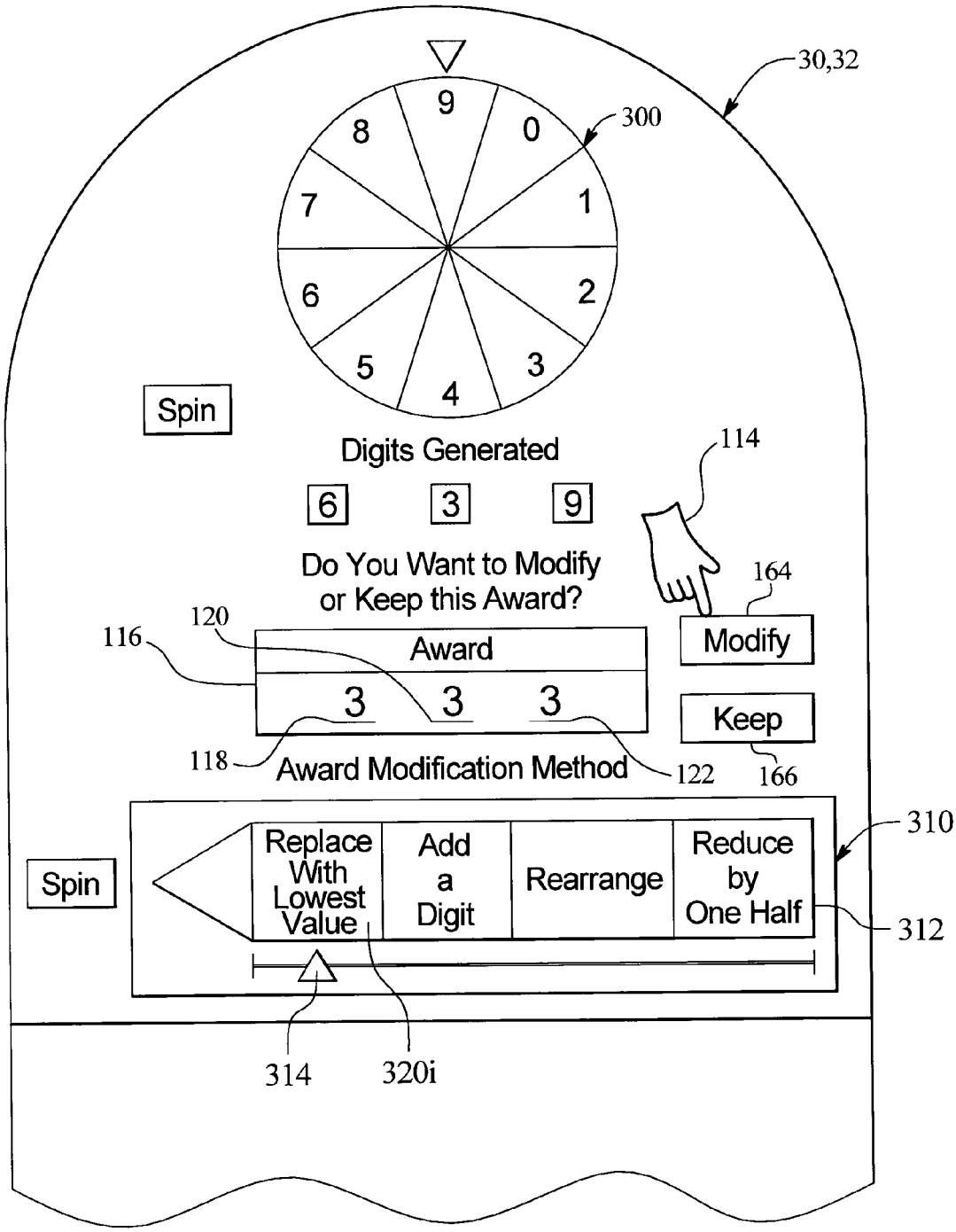
FIG. 27 is a front elevation view of one of the display devices illustrating the replace with lowest value modification method of the present invention.

Referring now to FIG. 27, the mechanical award modification display device displays the replace with lowest value method 320*i* of the present invention, wherein the original award of 693 displayed in the digit positions or places 118 through 122 on one of display devices 30 or 32 is modified. It should be appreciated that the replace with lowest value option of the present invention may be an option for the bonus and base game embodiments disclosed above in connection with the player-selectable awards.

The game provides the replace with lowest value method 320*i* to the player according to a predefined or varying probability stored in the memory device 40. Since the replace with lowest value method 320*i* does not change the order of magnitude of the player's award (i.e., the number of digits in the award), this method can be relatively frequently generated. The game can alternatively, predefine this option to result from the occurrence of some game event, such as a particular combination of slot symbols, face cards or other event.

In one embodiment, illustrated in FIG. 27 the replace with lowest value modification method 320*i*, replaces all of the digits of the award value 116 with the digit with the lowest value generated by the gaming device. In the display 30, 32 of FIG. 27, when the player 114 selects the modify input 164 and the mechanical award modification display 310 subsequently displays the generated modification method, the game displays a suitable symbol or message indicating that the replace with lowest value modification method 320*i* has been generated. The lowest digit of the three numbers generated by the gaming device is the 3 which is used to replace all of the other digits in the award value. Therefore, the 3 will replace the 6 originally in the hundred's position 122 and the 9, originally in the one's position 122, to produce a modified award value of 333. It should be appreciated that, in this embodiment, the replace with lowest value method 320*i* would have no effect on an award value with the same digits in each digit position.

In an alternative embodiment, the game may be adapted to repeat the entire modification or modification generation process a predetermined number of times. In another alternative embodiment, gaming device 10 automatically and randomly (as opposed to an option) replaces the digits of the original award with the digit with the lowest value. Gaming device 10, for example, may be adapted to replace the digits of the original award with the digit with the lowest value upon the player's placement of a masked number 116 in one of the digit positions 118 through 122 or upon the selection of a digit.

Figure 28:
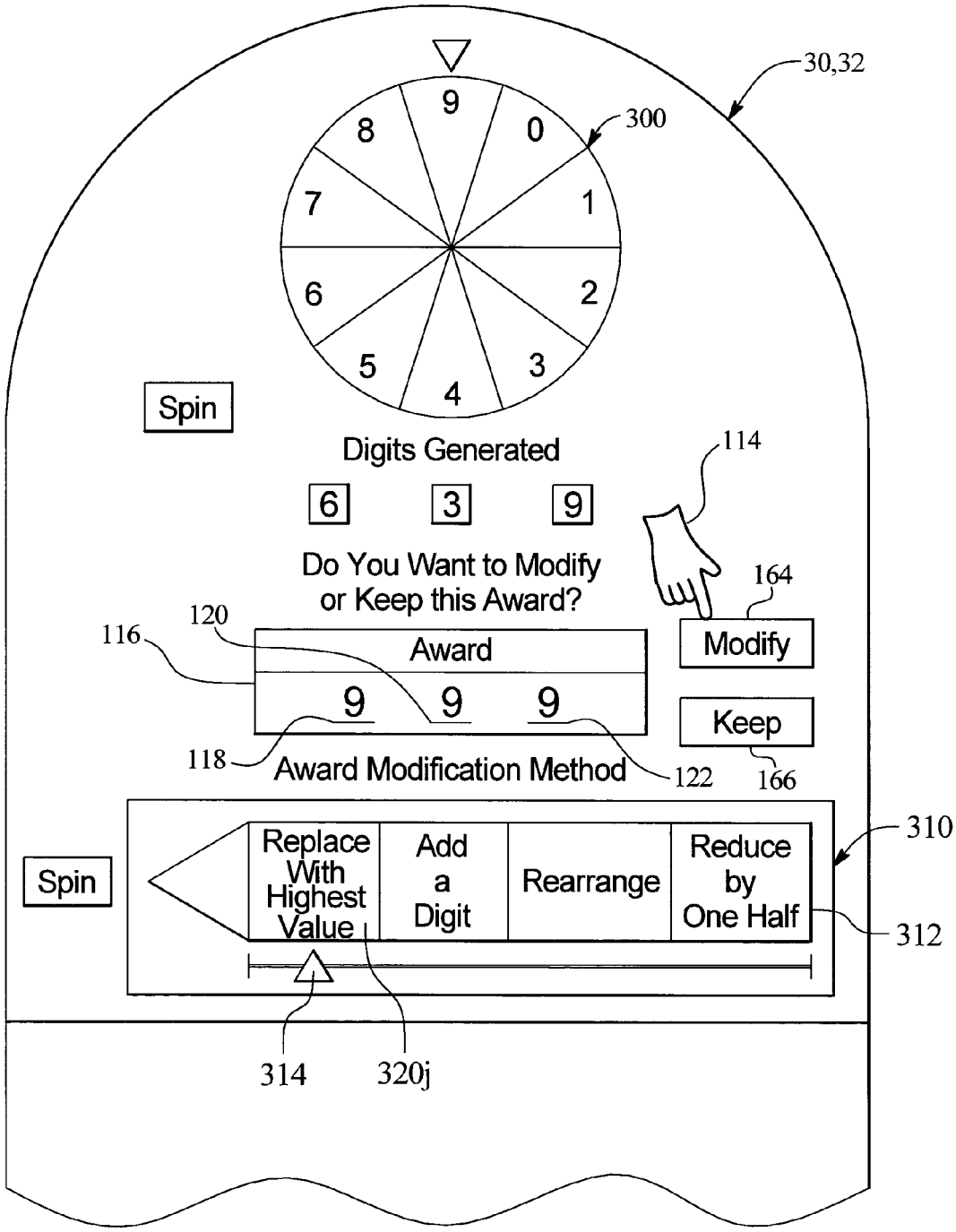
FIG. 28 is a front elevation view of one of the display devices illustrating the replace with highest value modification method of the present invention.

Referring now to FIG. 28, the mechanical award modification display device displays the replace with highest value method 320*j* of the present invention, wherein the original award of 693 displayed in the digit positions or places 118 through 122 on one of display devices 30 or 32 is modified. It should be appreciated that the replace with highest value option of the present invention may be an option for the bonus and base game embodiments disclosed above in connection with the player-selectable awards.

The game provides the replace with highest value method 320*j* to the player according to a predefined or varying probability stored in the memory device 40. Since the replace with highest value method 320*j* does not change the order of magnitude of the player's award (i.e., the number of digits in the award), this method can be relatively frequently generated. The game can alternatively, predefine this option to result from the occurrence of some game event, such as a particular combination of slot symbols, face cards or other event.

In one embodiment, illustrated in FIG. 28 the replace with highest value modification method 320*j*, replaces all of the digits of the award value 116 with the digit with the highest value generated by the gaming device. In the display 200 of FIG. 28, when the player 114 selects the modify input 164 and the mechanical award modification display 310 subsequently displays the generated modification method, the game displays a suitable symbol or message indicating that the replace with highest value modification method 320*j* has been generated. The highest digit of the three numbers generated by the gaming device is the 9 which is used to replace all of the other digits in the award value. Therefore, the 9 will replace the 6 originally in the hundred's position 118 and the 3, originally in the ten's position 120, to produce a modified award value of 999. It should be appreciated that, in this embodiment, the replace with highest value method 320*j* would have no effect on an award value with the same digits in each digit position.

In an alternative embodiment, the game may be adapted to repeat the entire modification or modification generation process a predetermined number of times. In another alternative embodiment, gaming device 10 automatically and randomly (as opposed to an option) replaces the digits of the original award with the digit with the highest value. Gaming device 10, for example, may be adapted to replace the digits of the original award with the digit with the highest value upon the player's placement of a masked number 116 in one of the digit positions 118 through 122 or upon the selection of a digit.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) display a plurality of player-selectable digit positions, (b) select and display a first digit from a plurality of digits, (c) after selecting and displaying said first digit, enable a player to select a first one of said displayed digit positions for said selected first digit, (d) after the player selects said first one of the displayed digit positions for the selected first digit, associate and display said selected first digit with the displayed first one of the digit positions selected by the player, (e) after the player selects said first one of the displayed digit positions for the first digit and the first digit is associated and displayed with the selected first one of the displayed digit positions, select and display a second digit from the plurality of digits, (f) after displaying said second digit, enable the player to select a second one of said displayed digit positions for said selected second digit, (g) after the player selects said second one of the digit positions for the selected second digit, associate and display said selected second digit with the displayed second one of the digit positions selected by the player, and (h) determine and display an award based on an order of the digits associated with the digit positions selected by the player.

2. The gaming device of claim 1, wherein the display device includes a mechanical display configured to display the plurality of digits.

3. The gaming device of claim 2, wherein the mechanical display is substantially circular.

4. The gaming device of claim 1, wherein the number of player-selectable digit positions is predetermined.

5. The gaming device of claim 1, wherein the digit positions include a one's digit position, a ten's digit position and a hundred's digit position.

6. The gaming device of claim 1, wherein the award has a value of the order of the digits in said digit positions.

7. The gaming device of claim 1, wherein the award is based on a mathematical operation applied to at least two of said digits in said digit positions.

8. The gaming device of claim 1, wherein the plurality of instructions, when executed by the at least one processor, cause the at least one processor to enable the player to rearrange the order of the digits associated with the digit positions at least once.

9. The gaming device of claim 1, which includes a player-selectable modify input, wherein activation of the modify input initiates an award modification method.

10. The gaming device of claim 9, wherein the plurality of instructions, when executed by the at least one processor, cause the at least one processor to select one of the award modification methods to apply to the award.

11. The gaming device of claim 9, wherein the award modification method is selected from the group consisting of: rearranging the digits of an award; regenerating an award; adding a digit to an award; subtracting a digit from an award; multiplying an award; replacing a lowest digit of an award; replacing a highest digit of an award; removing a lowest digit from an award; removing a highest digit from an award; reducing an award by a fraction of the original value of said award; adding an amount to at least one of the digits of an award; subtracting an amount from at least one of the digits of an award; rearranging the generated digits in each of the digit positions to produce the lowest possible award; rearranging the generated digits in each of the digit positions to produce the highest possible award; replacing the digits of an award with the lowest generated digit; and replacing the digits of an award with the highest generated digit.

12. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) display a plurality of digit positions;

(b) cause a pick of a first one of a plurality of symbols, wherein said symbols include a plurality of digits and at least one selection symbol;

(c) after the first one of the symbols is picked;

(i) enable a player to associate said first one of the picked symbols with a first one of said digit positions selected by the player; and (ii) if the picked first one of the symbols is the selection symbol:

(A) enable the player to pick one of a plurality of selections, wherein one of a plurality of the digits is associated with each selection, and (B) associate and display the digit associated with the selection picked by the player with the first one of the digit positions with which the selection symbol is associated;

(d) after executing (b) and (c),cause a pick of a second one of said symbols;

(e) after the second one of the symbols is picked:

(i) enable the player to associate said second one of the picked symbols with a second one of said digit positions selected by the player; and (ii) if the picked second one of the symbols is the selection symbol:

(A) enable the player to pick one of said plurality of selections, and (B) associate and display the digit associated with the selection picked by the player with the second one of the digit positions with which the selection symbol is associated; and (f) determine and display an award based on an order of digits associated with the digit positions.

13. The gaming device of claim 12, wherein the displayed digits and the selection symbol are displayed on a mechanical display device.

14. The gaming device of claim 12, wherein the mechanical display device is substantially circular.

15. The gaming device of claim 12, wherein the plurality of instructions, when executed by the at least one processor, cause the at least one processor to operate with the at least one display device to reveal to the player the digit associated with the selection symbol if the selection symbol is picked.

16. The gaming device of claim 12, wherein the number of digit positions is predetermined.

17. The gaming device of claim 12, wherein the award is based on combining by a mathematical operation at least two of said digits in said digit positions.

18. The gaming device of claim 12, wherein the plurality of instructions, when executed by the at least one processor, cause the at least one processor to enable the player to rearrange the order of the digits associated with the digit positions at least once.

19. The gaming device of claim 12, which includes a player-selectable modify input, wherein activation of the modify input initiates an award modification method.

20. The gaming device of claim 19, wherein the award modification method is selected from the group consisting of: rearranging the digits of an award; regenerating an award; adding a digit to an award; subtracting a digit from an award; multiplying an award; replacing a lowest digit of an award; replacing a highest digit of an award; removing a lowest digit from an award; removing a highest digit from an award; reducing an award by a fraction of the original value of said award; adding an amount to at least one of the digits of an award; subtracting an amount from at least one of the digits of an award rearranging the generated digits in each of the digit positions to produce the lowest possible award; rearranging the generated digits in each of the digit positions to produce the highest possible award; replacing the digits of an award with the lowest generated digit; and replacing the digits of an award with the highest generated digit.

21. The gaming device of claim 12, which includes at least one award modification method, and wherein the plurality of instructions, when executed by the at least one processor, cause the at least one processor to randomly determine if an award modification method will be applied to the award.

22. A gaming device comprising:

at least one display device including at least one mechanical display device configured to display a plurality of digits;

at least one input device;

at least one processor; and at least one memory device which stores a plurality of instructions, which when executed by the at least one processor, cause the at least one processor to operate with the at least one display device and the at least one input device to:

(i) after a first selection by a player of a first one of a plurality of player-selectable digit positions, select a first one of the plurality of digits displayed by the at least one mechanical display device and display the selected first one of the digits in the selected first one of the digit positions, (ii) after the first one of the plurality of digits is displayed in the selected first one of the digit positions and after a second selection by the player of a second one of the digit positions, select a second one of the plurality of digits displayed by the at least one mechanical display device and display the selected second one of the digits in the selected second one of the digit positions; and (iii) provide an award to the player, said award including a plurality of the digits associated with the digit positions selected by the player, wherein the order of said digits indicates a value of the award.

23. The gaming device of claim 22, wherein the mechanical display device includes a plurality of sections, wherein one of the plurality of digits is displayed in each section.

24. The gaming device of claim 22, wherein the mechanical display device is substantially circular.

25. The gaming device of claim 22, wherein the mechanical display device is adapted to rotate and stop at a position wherein an indicator indicates one of the plurality of digits.

26. The gaming device of claim 22, which includes at least one selection symbol displayed by the mechanical display device, said selection symbol indicating a selection of at least one of a plurality of selections, wherein one of the plurality of digits is associated with each selection.

27. The gaming device of claim 26, wherein the plurality of selections are displayed by a mechanical display device.

28. A gaming device comprising:

a cabinet;

at least one display device including a moveable mechanical display device supported by the cabinet, said mechanical display device having a plurality of different modification methods displayed thereon;

at least one processor; and at least one memory device which stores a plurality of instructions, which when executed by the at least one processor, cause the at least one processor to operate with the at least one display device for a play of a game to:

(a) cause the mechanical display device to move to simultaneously display a plurality of the modification methods to a player;

(b) cause an indicator to move to indicate one of the modification methods which is displayed when the mechanical display device stops moving;

(c) display an original award including a plurality of digits associated with a plurality of digit positions, wherein the order of said digits displays a value of the original award; and (d) display and provide to the player a modified award including a modification of the digits of the original award based on the modification method indicated by the indicator and mechanical display device.

29. The gaming device of claim 28, wherein each modification method is associated with one of a plurality of sections of the mechanical display device.

30. The gaming device of claim 28, wherein the mechanical display device includes a plurality of surfaces, each said surface displaying at least one of the modification methods.

31. The gaming device of claim 28, wherein the mechanical display device is prism-shaped having three sides.

32. The gaming device of claim 31, wherein at least one modification method is displayed on each side of the mechanical display device.

33. The gaming device of claim 28, wherein the mechanical display device is positioned on a longitudinally extending rotational axis.

34. The gaming device of claim 33, wherein the indicator is operable to move substantially parallel to the longitudinal rotational axis.

35. The gaming device of claim 28, wherein the mechanical display device is configured to rotate along a rotational axis and to stop to reveal at least one modification method.

36. The gaming device of claim 35, wherein the rotational axis is substantially horizontally disposed.

37. The gaming device of claim 28, which includes means for oscillating the indicator relative to the mechanical display device.

38. The gaming device of claim 37, wherein the oscillation of the indicator is substantially parallel to the rotational axis of the mechanical display.

39. The gaming device of claim 28, wherein the movement of the indicator is coordinated with the movement of the mechanical display device to designate one of the award modification methods to be applied to the award.

40. The gaming device of claim 28, wherein the indicator moves simultaneously with the movement of the mechanical display device.

41. The gaming device of claim 28, wherein the plurality of instructions, when executed by the at least one processor, cause the at least one processor to operate to control the movement of the mechanical display and the movement of the indicator.

42. The gaming device of claim 28, which includes a predetermined sequence that causes the mechanical display and the indicator to move simultaneously.

43. The gaming device of claim 28, which includes a predetermined sequence that causes the indicator to move after the mechanical display stops rotating.

44. The gaming device of claim 28, which includes a predetermined sequence that causes the indicator to pass by each of the modification methods of the modification methods at least once before stopping to indicate one of the displayed modification methods.

45. The gaming device of claim 28, wherein the movement of the mechanical display and the movement of the indicator are controlled by a random generation.

46. The gaming device of claim 28, wherein the movement of the mechanical display and the movement of the indicator are individually controlled by separate random generations.

47. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) display a plurality of player-selectable digit positions;

(b) enable a player to select an order of said plurality of digit positions, (c) select and display a first one of a plurality of digits, (d) after said first one of the digits is selected and displayed, associate and display the selected first one of the digits with a first one of the digit positions based on the order of said plurality of digit positions selected by the player, (e) after the selected first one of the digits is associated and displayed with the first one of the digit positions, select and display a second one of said digits, (f) after said second one of the digits is selected and displayed, associate and display the selected second one of the digits with a second one of the digit positions based on the order of said plurality of digit positions selected by the player, and (g) determine and display an award to provide to the player based on an order of the digits associated with the digit positions.

48. The gaming device of claim 47, wherein the order of the digits associated with the digit positions is based on the order of the plurality of digit positions selected by the player and the order in which the digits are selected and displayed.

49. The gaming device of claim 47, wherein the display device includes a mechanical display configured to display the plurality of digits.

50. The gaming device of claim 49, wherein the mechanical display is substantially circular.

51. The gaming device of claim 47, wherein the number of player-selectable digit positions is predetermined.

52. The gaming device of claim 47, wherein the digit positions include a one's digit position, a ten's digit position and a hundred's digit position.

53. The gaming device of claim 47, wherein the award has a value of the order of the digits in said digit positions.

54. The gaming device of claim 47, wherein the award is based on a mathematical operation applied to at least two of said digits in said digit positions.

55. The gaming device of claim 47, wherein the plurality of instructions, when executed by the at least one processor, cause the at least one processor to enable the player to rearrange the order of the digits associated with the digit positions at least once.

56. The gaming device of claim 47, which includes a player-selectable modify input, wherein activation of the modify input initiates an award modification method.

57. The gaming device of claim 56, wherein the plurality of instructions, when executed by the at least one processor, cause the at least one processor to select one of a plurality of award modification methods to apply to the award.

58. The gaming device of claim 56, wherein the award modification method is selected from the group consisting of: rearranging the digits of an award; regenerating an award; adding a digit to an award; subtracting a digit from an award; multiplying an award; replacing a lowest digit of an award; replacing a highest digit of an award; removing a lowest digit from an award; removing a highest digit from an award; reducing an award by a fraction of the original value of said award; adding an amount to at least one of the digits of an award; subtracting an amount from at least one of the digits of an award; rearranging the generated digits in each of the digit positions to produce the lowest possible award; rearranging the generated digits in each of the digit positions to produce the highest possible award; replacing all of the digits of an award with the lowest generated digit; and replacing all of the digits of an award with the highest generated digit.

59. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) display a plurality of digits and a plurality of player-selectable digit positions, (b) enable a player to select a first one of said digit positions, (c) after said first one of the digit positions is selected, select and display a first one of said digits, (d) after said first one of the digits is selected and displayed, associate and display said selected first one of the digits with the first one of the digit positions selected by the player, (e) after said selected first one of the digits is associated and displayed with the first one of the digit positions selected by the player, enable the player to select a second one of said digit positions, (f) after said second one of the digit positions is selected, select and display a second one of said digits, (g) after said second one of the digits is selected and displayed, associate and display said selected second one of the digits with the second one of the digit positions selected by the player, and (h) determine and display an award based on an order of the digits associated with the digit positions selected by the player.

60. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) display a plurality of symbols, wherein said symbols include a plurality of digits and at least one selection symbol, (b) display a plurality of selections, wherein one of a plurality of the digits is associated with each selection, (c) display a plurality of digit positions, (d) enable a player to pick a first one of said digit positions, (e) after said first one of the digit positions is picked, cause a pick of a first one of said symbols, (f) after said first one of the symbols is picked:

(i) associate and display said picked first one of the symbols with the first one of the digit positions picked by the player, (ii) if the picked first one of the symbols is the selection symbol:

(A) enable the player to pick one of said plurality of selections, and (B) associate and display the digit associated with the selection picked by the player with the digit position with which the selection symbol is associated, (g) after executing (d) to (f), enable a player to pick a second one of the digit positions, (h) after said second one of the digit positions is picked, cause a pick of a second one of said symbols, (i) after said second one of the symbols is picked:

(i) associate and display said picked second one of the symbols with the second one of the digit positions picked by the player, and (ii) if the picked second one of the symbols is the selection symbol:

(A) enable the player to pick one of said plurality of selections, and (B) associate and display the digit associated with the selection picked by the player with the digit position with which the selection symbol is associated, and (j) determine and display an award based on an order of digits associated with the digit positions.

* * * * *